US012064063B2

(12) United States Patent
Bartman et al.

(10) Patent No.: US 12,064,063 B2
(45) Date of Patent: Aug. 20, 2024

(54) AUTOMATED TOILET SEAT COVER DISPENSER

(71) Applicant: GPCP IP HOLDINGS LLC, Atlanta, GA (US)

(72) Inventors: Daniel Joseph Bartman, Combined Locks, WI (US); John Patrick Laitala, Greenville, WI (US); John William Grosz, Jr., Ripon, WI (US); Timothy Andrew Robertson, Appleton, WI (US); Ted Allen Casper, Kaukauna, WI (US); Jacob Charles Dahl, Menasha, WI (US)

(73) Assignee: GPCP IP HOLDINGS LLC

( * ) Notice: Subject to any disclaimer, the term of this patent is extended or adjusted under 35 U.S.C. 154(b) by 263 days.

(21) Appl. No.: 17/028,003

(22) Filed: Sep. 22, 2020

(65) Prior Publication Data

US 2021/0085136 A1 Mar. 25, 2021

Related U.S. Application Data

(60) Provisional application No. 62/992,200, filed on Mar. 20, 2020, provisional application No. 62/904,161, filed on Sep. 23, 2019.

(51) Int. Cl.
*A47K 13/22* (2006.01)
*A47K 10/34* (2006.01)
(Continued)

(52) U.S. Cl.
CPC ..... *A47K 13/22* (2013.01); *A47K 10/34* (2013.01); *A47K 10/36* (2013.01);
(Continued)

(58) Field of Classification Search
CPC ..... A47K 10/34; A47K 10/3625; A47K 10/3612; A47K 10/36; A47K 17/003;
(Continued)

(56) References Cited

U.S. PATENT DOCUMENTS 1,419,212 A 6/1922 Green et al.
1,582,645 A 4/1926 Findley
(Continued)

FOREIGN PATENT DOCUMENTS

CA 1115459 A 1/1982
CA 1165053 A 4/1984
(Continued)

OTHER PUBLICATIONS

"HYSO D3 Micro Automatic Door Handle Sanitizer;" Aug. 2010; retrieved Nov. 30, 2020 from https://www.aston-pharma.com/_productFiles/40/HYSOD3Micro_SpecSheet.pdf.
(Continued)

*Primary Examiner* — Nhat Chieu Q Do

(57) ABSTRACT

Some sheet product dispensers disclosed herein are configured to dispense from a sheet product roll that includes a plurality of predetermined portions that are designed for providing a toilet seat cover. A line of perforations separates consecutive portions. A motor operates to drive the drive roller to cause movement of the sheet product along a dispensing pathway to position a leading predetermined portion of the sheet product into a dispensing position such that the trailing edge of the leading predetermined portion is positioned within the housing and the leading edge of the leading predetermined portion is positioned outside the dispensing chute to enable removal of the leading predetermined portion. Staged dispensing is utilized to help maintain hygiene, while still quickly providing the dispense. Perforation tear assist features are provided to aid in proper
(Continued)

separation of the line of perforations, such as to help maintain integrity of the dispensed portion.

29 Claims, 51 Drawing Sheets

(51) Int. Cl.

| | |
|---|---|
| ***A47K 10/36*** | (2006.01) |
| ***A47K 13/16*** | (2006.01) |
| ***A47K 17/00*** | (2006.01) |
| ***B65H 35/00*** | (2006.01) |
| *A47K 10/38* | (2006.01) |

(52) U.S. Cl.
CPC ..... *A47K 10/3612* (2013.01); *A47K 10/3625* (2013.01); *A47K 13/165* (2013.01); *A47K 17/003* (2013.01); *B65H 35/0006* (2013.01); *B65H 35/006* (2013.01); *A47K 2010/3668* (2013.01); *A47K 2010/3881* (2013.01)

(58) Field of Classification Search
CPC .... A47K 2010/3668; A47K 2010/3881; B65H 35/006; B65H 35/0006
USPC ..... 225/10
See application file for complete search history.

(56) References Cited

U.S. PATENT DOCUMENTS 1,722,523 A 7/1929 Benjamin
1,856,083 A 5/1932 Sather
2,198,458 A 4/1940 Otis
2,266,958 A 12/1941 Corbin
2,424,680 A 7/1947 Doyle
2,624,597 A 1/1953 Winans
2,967,010 A 1/1961 Cuffey
3,001,646 A 9/1961 Cooper
3,187,949 A 6/1965 Mangel
3,228,347 A 1/1966 Corsette
3,237,571 A 3/1966 Corsette
3,250,444 A 5/1966 Ward
3,268,136 A 8/1966 Huffman
3,332,547 A 7/1967 Rowe
3,351,240 A 11/1967 Gray
3,379,136 A 4/1968 Corsette
3,379,189 A 4/1968 Staples
3,394,866 A 7/1968 Milton
3,419,189 A 12/1968 Taisho
3,463,039 A 8/1969 Silver
3,495,571 A 2/1970 Evans
3,627,176 A 12/1971 Sailors
3,632,020 A 1/1972 Nixon et al.
3,666,144 A 5/1972 Winder
3,693,198 A 9/1972 Tromp
3,751,738 A 8/1973 Vairo
3,753,262 A 8/1973 Watsky
3,756,453 A 9/1973 Griffioen et al.
3,796,185 A 3/1974 Boone
3,802,606 A 4/1974 Gust
3,865,271 A 2/1975 Gold
3,910,229 A 10/1975 Spencer
3,963,048 A 6/1976 Bowman
3,972,447 A 8/1976 Fegley
3,995,321 A 12/1976 Johnson
3,999,221 A 12/1976 Hannigan
4,018,419 A 4/1977 Monpetit
4,050,105 A 9/1977 Marceaux
4,079,862 A 3/1978 Fegley
4,106,135 A 8/1978 Mannheim
4,144,987 A 3/1979 Kishi
4,185,661 A 1/1980 Gill et al.
4,245,671 A 1/1981 Kosugui
4,274,560 A 6/1981 Cater
4,277,001 A 7/1981 Nozawa
4,297,750 A 11/1981 Lutz
4,339,109 A 7/1982 Kawata et al.
4,389,003 A 6/1983 Meshberg
4,442,552 A 4/1984 Bolick et al.
4,454,963 A 6/1984 Fegley
4,494,747 A 1/1985 Graef et al.
4,531,547 A 7/1985 Hadden
4,552,179 A 11/1985 Tarusawa et al.
4,557,426 A 12/1985 Siciliano
4,569,467 A 2/1986 Kaminstein
4,627,117 A 12/1986 Morishita
4,662,009 A 5/1987 Hefty
4,667,846 A 5/1987 Marceau
4,720,880 A 1/1988 Barreau
4,721,265 A 1/1988 Hawkins
4,735,347 A 4/1988 Schultz et al.
4,766,617 A 8/1988 Thygesen et al.
4,796,825 A 1/1989 Hawkins
4,798,312 A 1/1989 Scheiber
4,830,235 A 5/1989 Miller
4,875,242 A 10/1989 Albrecht et al.
4,882,875 A 11/1989 Green
4,884,299 A 12/1989 Rose
4,884,720 A 12/1989 Whigham et al.
4,887,321 A 12/1989 MacLean
4,913,399 A 4/1990 Migliori
4,921,131 A 5/1990 Binderbauer et al.
4,926,504 A 5/1990 Higuchi et al.
4,926,505 A 5/1990 Higuchi et al.
4,928,325 A 5/1990 Higuchi et al.
4,935,967 A 6/1990 Cour
4,944,046 A 7/1990 Huh et al.
4,963,406 A 10/1990 Gooding et al.
4,964,543 A 10/1990 Scheiber
4,975,990 A 12/1990 Chan
4,979,237 A 12/1990 Hazar et al.
D314,829 S 2/1991 Brock
4,998,559 A 3/1991 McAuliffe
5,029,729 A 7/1991 Madsen et al.
5,134,961 A 8/1992 Giles et al.
5,203,036 A 4/1993 Juushi
5,253,372 A 10/1993 Boker
5,255,861 A 10/1993 Lerner
D343,086 S 1/1994 Wood
5,277,559 A 1/1994 Schultz
5,295,272 A 3/1994 Juushi
5,312,021 A 5/1994 Nelson
5,374,029 A 12/1994 Bailey
5,383,580 A 1/1995 Winder
5,417,258 A 5/1995 Privas
5,427,277 A 6/1995 Bierend et al.
5,438,711 A 8/1995 Higuchi et al.
5,443,084 A 8/1995 Saleur
5,445,189 A 8/1995 Yamamuro et al.
5,456,626 A 10/1995 Ming-Kang
5,464,125 A 11/1995 Daansen
5,465,878 A 11/1995 Armijo et al.
5,492,247 A 2/1996 Shu et al.
5,513,832 A 5/1996 Becker et al.
5,535,783 A 7/1996 Asou et al.
5,551,096 A 9/1996 Gardner
5,561,867 A 10/1996 Roginsky
5,590,424 A 1/1997 Matsunaga et al.
5,622,282 A 4/1997 Yazawa et al.
5,702,031 A 12/1997 Meshberg et al.
5,746,728 A 5/1998 Py
5,791,520 A 8/1998 Tichenor
5,799,895 A 9/1998 Michaud et al.
5,802,974 A 9/1998 McNeil
5,809,568 A 9/1998 Morris-Jones
5,819,314 A 10/1998 Jackson
5,839,688 A 11/1998 Hertel et al.
5,887,759 A 3/1999 Ayigbe
5,918,778 A 7/1999 Schultz
5,934,667 A 8/1999 Miki
5,937,448 A 8/1999 Brill et al.
5,984,049 A 11/1999 Lammers
5,996,628 A 12/1999 Najmolhoda et al.

(56) References Cited

U.S. PATENT DOCUMENTS 6,038,708 A 3/2000 Schreck
6,039,212 A 3/2000 Singh
6,047,856 A 4/2000 Meshberg et al.
6,061,827 A 5/2000 Lampson et al.
6,068,157 A 5/2000 Kamiya
6,079,305 A 6/2000 Bloch et al.
6,086,042 A 7/2000 Scott et al.
6,151,716 A 11/2000 Patterson et al.
6,209,751 B1 4/2001 Goodin et al.
6,212,693 B1 4/2001 D'Aleo
6,216,925 B1 4/2001 Garon
6,267,297 B1 7/2001 Contadini et al.
6,273,313 B1 8/2001 Noll et al.
6,282,716 B1 9/2001 Patterson et al.
6,293,442 B1 9/2001 Mollayan
6,293,486 B1 9/2001 Byrd et al.
6,308,346 B1 10/2001 Brill et al.
6,315,268 B1 11/2001 Cornea et al.
6,343,714 B1 2/2002 Tichenor
6,346,153 B1 2/2002 Lake et al.
6,349,851 B1 2/2002 Lu
6,363,825 B1 4/2002 Hagleitner
6,409,093 B2 6/2002 Ulczynski et al.
6,415,962 B1 7/2002 Bougamont et al.
6,419,122 B1 7/2002 Chown
6,435,372 B1 8/2002 Blacker et al.
6,450,198 B1 9/2002 Bouteille et al.
6,497,345 B1 12/2002 Wilker et al.
6,527,249 B2 3/2003 Niimi et al.
6,581,500 B1 6/2003 Kietaibl
6,607,103 B2 8/2003 Gerenraich et al.
6,612,468 B2 9/2003 Pritchett et al.
6,619,616 B1 9/2003 Sudani et al.
6,669,166 B2 12/2003 Enomoto et al.
6,688,334 B2 2/2004 Kawamura et al.
6,695,246 B1 2/2004 Elliott et al.
6,736,348 B1 * 5/2004 Formon ..... A47K 10/3687 242/563
6,739,578 B2 5/2004 Barton et al.
D490,935 S 6/2004 Zadro
6,757,917 B2 7/2004 Kamysz et al.
6,780,372 B2 8/2004 Gray
6,783,110 B2 8/2004 Hirota et al.
6,813,784 B1 11/2004 Thompson
6,820,821 B2 11/2004 Linstedt et al.
6,854,684 B2 2/2005 Byrd et al.
6,877,636 B2 4/2005 Speckhart et al.
6,883,787 B2 4/2005 Allen
6,892,620 B2 5/2005 Kapiloff
6,918,513 B1 7/2005 Downey
6,928,929 B1 8/2005 McNeil
6,929,838 B1 8/2005 McNeil
6,966,076 B2 11/2005 Kamysz et al.
6,974,091 B2 12/2005 McLisky
6,983,686 B2 1/2006 Vaughn et al.
6,996,859 B1 2/2006 Alonso et al.
7,003,814 B2 2/2006 Kamysz et al.
7,040,566 B1 5/2006 Rodrian et al.
7,044,421 B1 5/2006 Omdoll et al.
7,089,854 B2 8/2006 McNeil
7,101,441 B2 9/2006 Kennard
7,118,088 B2 10/2006 Hirota
7,155,749 B1 1/2007 Gelbart et al.
7,163,139 B2 1/2007 Marie et al.
7,168,597 B1 1/2007 Jones et al.
7,226,034 B2 6/2007 Stark et al.
7,242,307 B1 7/2007 LeBlond et al.
7,254,845 B1 8/2007 Morad
7,303,099 B2 12/2007 Ophardt
7,320,418 B2 1/2008 Sassoon
7,325,767 B2 2/2008 Elliott et al.
7,325,768 B2 2/2008 Byrd et al.
7,354,015 B2 4/2008 Byrd et al.
7,370,826 B2 5/2008 Neveu
7,374,066 B2 5/2008 Jackson et al.
7,384,505 B2 6/2008 Zoller et al.
7,398,944 B2 7/2008 Lewis et al.
7,407,065 B2 8/2008 Hooks et al.
7,469,425 B2 12/2008 DeStefano
7,497,214 B2 3/2009 Hodson
7,520,447 B2 4/2009 Engelen et al.
7,624,897 B2 12/2009 Bloc
7,641,077 B2 1/2010 Law et al.
7,669,735 B1 3/2010 Alleyne
7,681,765 B2 3/2010 Muderlak
7,707,661 B2 5/2010 Issachar
7,708,166 B2 5/2010 Ophardt
7,726,630 B2 6/2010 Cripps et al.
7,743,945 B2 6/2010 Lu
7,757,899 B2 7/2010 Van Heijden
7,770,874 B2 8/2010 Ophardt et al.
7,774,096 B2 8/2010 Goerg et al.
7,774,869 B2 8/2010 Massey
7,775,458 B2 8/2010 Linstedt et al.
7,779,839 B2 8/2010 Pocock et al.
7,783,380 B2 8/2010 York et al.
D623,453 S 9/2010 Benedetti
7,814,582 B2 10/2010 Reddy et al.
7,878,371 B2 2/2011 Sassoon
7,938,340 B2 5/2011 Anderson et al.
7,954,405 B2 6/2011 Kling
7,954,674 B2 6/2011 Roy et al.
7,987,756 B2 8/2011 Lewis et al.
7,996,108 B2 8/2011 Yardley
7,998,121 B2 8/2011 Stringham
8,002,150 B2 8/2011 Ophardt et al.
8,016,978 B2 9/2011 Sauter et al.
8,070,017 B2 12/2011 Green
8,079,498 B2 12/2011 Anderson et al.
8,091,738 B2 1/2012 Ciavarella
8,152,116 B2 4/2012 Westberg
8,160,742 B2 4/2012 Goerg et al.
8,165,716 B1 4/2012 Goeking et al.
D658,604 S 5/2012 Egawa et al.
8,261,941 B2 9/2012 Woo et al.
8,261,942 B2 9/2012 Chen
8,261,950 B2 9/2012 Cittadino et al.
8,268,429 B2 9/2012 McNeil et al.
8,272,540 B2 9/2012 Ophardt et al.
8,283,013 B2 10/2012 Feldmann et al.
8,287,976 B2 10/2012 Hupp
8,287,977 B2 10/2012 McNeil et al.
8,308,027 B2 11/2012 Law et al.
8,336,740 B1 12/2012 Daansen
8,342,363 B2 1/2013 Carpenter et al.
8,365,965 B2 2/2013 Ophardt
8,371,479 B2 2/2013 Luft
8,383,223 B2 2/2013 Barredo
8,387,827 B2 3/2013 Helf et al.
8,418,724 B2 4/2013 Suzuki et al.
8,418,889 B2 4/2013 Pritchett et al.
D681,649 S 5/2013 Fletcher et al.
8,443,725 B2 5/2013 McNeil et al.
8,464,912 B2 6/2013 Ophardt et al.
8,464,914 B2 6/2013 Lulla et al.
8,468,938 B2 6/2013 Redd
8,474,664 B2 7/2013 Ophardt et al.
8,479,957 B2 7/2013 Ophardt
8,496,137 B2 7/2013 Alfaro et al.
8,535,483 B2 9/2013 McNeil et al.
8,540,227 B2 9/2013 Buri
D690,720 S 10/2013 Waldman
8,544,785 B2 10/2013 Pelland et al.
8,556,122 B2 10/2013 Helf et al.
8,590,743 B2 11/2013 Beland et al.
8,590,750 B2 11/2013 Warby et al.
8,599,007 B2 12/2013 Larsson et al.
8,600,547 B2 12/2013 Petersen et al.
8,668,116 B2 3/2014 Ciavarella et al.
8,734,392 B2 5/2014 Stadelhofer
D706,283 S 6/2014 Pedraza et al.
8,740,015 B2 6/2014 McLisky
8,746,504 B2 6/2014 Beland et al.
8,746,510 B2 6/2014 Cittadino et al.

(56) References Cited

U.S. PATENT DOCUMENTS 8,763,526 B2 7/2014 McNeil et al.
8,777,062 B2 7/2014 Ciavarella
8,777,065 B2 7/2014 Knopow et al.
8,802,211 B2 8/2014 Cattacin et al.
8,807,398 B2 8/2014 Sundberg et al.
8,807,475 B2 8/2014 Rodrian et al.
8,814,008 B2 8/2014 Anderson et al.
8,815,171 B2 8/2014 Wagner
8,826,470 B2 9/2014 Helf et al.
8,833,691 B1 9/2014 Zosimadis
8,844,437 B2 9/2014 Baggot et al.
8,844,766 B2 9/2014 Zaima et al.
D716,325 S 10/2014 Brudnicki
D716,327 S 10/2014 Schoger et al.
8,870,030 B2 10/2014 Demarest et al.
8,876,383 B2 11/2014 Doll et al.
8,881,945 B2 11/2014 Gasper et al.
8,887,954 B2 11/2014 Carpenter et al.
8,888,013 B2 11/2014 McLisky
8,899,449 B2 12/2014 Daansen
D721,084 S 1/2015 Kimball et al.
8,960,588 B2 2/2015 Byrd et al.
8,985,398 B2 3/2015 Demarest et al.
8,991,647 B2 3/2015 Meyers
9,061,821 B2 6/2015 Helf et al.
9,089,622 B2 7/2015 Helf et al.
9,095,242 B2 8/2015 Wang
9,132,954 B2 9/2015 Nilsson et al.
D746,295 S 12/2015 Arai et al.
9,204,625 B2 12/2015 Furner
D746,828 S 1/2016 Arai et al.
D748,648 S 2/2016 Kim et al.
D750,101 S 2/2016 Bates et al.
9,254,490 B2 2/2016 Pike
9,254,954 B2 2/2016 Davideit et al.
9,259,848 B2 2/2016 Hupp et al.
D751,108 S 3/2016 Caldwell
D754,446 S 4/2016 Yang et al.
D754,686 S 4/2016 Mandeville
D755,201 S 5/2016 Kim
9,353,881 B2 5/2016 Chang
9,375,745 B2 6/2016 Finch
D760,729 S 7/2016 Cole
D760,761 S 7/2016 Willis
9,382,053 B2 7/2016 Doll et al.
9,394,096 B2 7/2016 Betts et al.
D763,288 S 8/2016 Mistry et al.
D764,491 S 8/2016 Green et al.
D764,516 S 8/2016 Lamparelli
9,409,372 B2 8/2016 Hada et al.
9,428,898 B1 8/2016 Clements
D767,297 S 9/2016 Madsen et al.
9,456,718 B1 10/2016 Myatt
9,457,951 B2 10/2016 Carpenter et al.
9,486,932 B2 11/2016 Baggot et al.
D773,202 S 12/2016 Madsen et al.
D773,849 S 12/2016 Criswell et al.
D775,195 S 12/2016 Caldwell et al.
9,522,775 B2 12/2016 Bellinger et al.
9,527,656 B2 12/2016 Walters et al.
D775,497 S 1/2017 Roche et al.
9,532,684 B2 1/2017 Hoefte et al.
9,541,213 B2 1/2017 Zieger
D778,292 S 2/2017 Mochizuki et al.
D780,303 S 2/2017 Kassouni
D780,870 S 3/2017 Hamilton
9,604,811 B2 3/2017 Case et al.
D784,360 S 4/2017 Harder et al.
D784,361 S 4/2017 Graham et al.
D787,526 S 5/2017 Lee et al.
D787,527 S 5/2017 Wilberding
D787,536 S 5/2017 Pantelis
D787,552 S 5/2017 Napper et al.
D788,165 S 5/2017 Bunyard et al.
9,649,400 B2 5/2017 Furner et al.
D788,792 S 6/2017 Alessandri et al.
9,694,199 B2 7/2017 Duquet et al.
D794,649 S 8/2017 Niijima et al.
D794,666 S 8/2017 Havaldar et al.
D795,903 S 8/2017 Chen et al.
9,717,377 B2 8/2017 Cattacin et al.
D796,520 S 9/2017 Klar et al.
D797,765 S 9/2017 Su et al.
D798,311 S 9/2017 Golden et al.
D798,316 S 9/2017 Bradley et al.
D798,886 S 10/2017 Prophete et al.
D799,498 S 10/2017 Graham et al.
D800,144 S 10/2017 Anderson
D801,347 S 10/2017 Zhu et al.
D801,349 S 10/2017 Day et al.
D801,350 S 10/2017 Rejkowski et al.
D801,986 S 11/2017 Pirklbauer
D801,992 S 11/2017 Fischbach
D802,008 S 11/2017 Zhang et al.
D802,603 S 11/2017 Bickel et al.
D803,230 S 11/2017 Jaini et al.
D803,233 S 11/2017 Wilberding
D803,234 S 11/2017 Day et al.
D803,247 S 11/2017 Mistry et al.
D803,870 S 11/2017 Landry et al.
D804,492 S 12/2017 Graham et al.
D807,076 S 1/2018 Kapiloff et al.
9,950,892 B2 4/2018 Slovut et al.
9,963,314 B2 5/2018 Case et al.
10,005,197 B2 6/2018 Kien et al.
10,149,583 B2 12/2018 Vuylsteke et al.
10,314,445 B2 6/2019 Vuylsteke et al.
10,383,487 B2 8/2019 Hagleitner
10,383,489 B2 8/2019 Case et al.
10,392,217 B2 8/2019 Case et al.
10,398,264 B2 9/2019 Rozek et al.
10,433,683 B2 10/2019 Beadles et al.
10,531,770 B2 1/2020 Case
10,548,437 B2 * 2/2020 Borke ..... A47K 10/3612
2001/0014980 A1 8/2001 Patterson et al.
2001/0040169 A1 11/2001 Kohno
2002/0162164 A1 11/2002 Kamysz et al.
2003/0052136 A1 3/2003 Weng
2003/0132254 A1 7/2003 Giangreco
2003/0159201 A1 8/2003 Kamysz et al.
2003/0172449 A1 9/2003 Kamysz et al.
2003/0196257 A1 10/2003 Kamysz et al.
2003/0205580 A1 11/2003 Yahav
2003/0208836 A1 11/2003 Bankemper
2004/0035976 A1 2/2004 Byrd et al.
2004/0041057 A1 3/2004 Byrd et al.
2004/0135027 A1 7/2004 Elliott et al.
2004/0154949 A1 8/2004 Lenhard et al.
2005/0039293 A1 2/2005 McReynolds et al.
2005/0133752 A1 6/2005 Purvines et al.
2005/0183194 A1 8/2005 Haile
2006/0049208 A1 3/2006 Daansen
2006/0060615 A1 3/2006 McLisky
2006/0163416 A1 7/2006 Byrd et al.
2007/0014961 A1 1/2007 Schneider et al.
2007/0034149 A1 2/2007 Gonzalez
2007/0044928 A1 3/2007 Shannon et al.
2007/0051742 A1 3/2007 Qiu
2007/0084099 A1 4/2007 Sarbo et al.
2007/0209099 A1 9/2007 Issachar
2007/0220664 A1 9/2007 Getahun et al.
2007/0236110 A1 10/2007 Kling
2008/0022872 A1 1/2008 Nanisetty et al.
2008/0156896 A1 7/2008 Anderson et al.
2008/0172768 A1 7/2008 DeStefano
2008/0235857 A1 10/2008 Tzeng
2008/0256694 A1 10/2008 Wilbarger
2008/0272208 A1 11/2008 Anderson et al.
2008/0277501 A1 11/2008 Everett
2008/0290113 A1 11/2008 Helf
2008/0290120 A1 11/2008 Helf
2008/0309441 A1 12/2008 Anderson
2009/0047461 A1 2/2009 Sporrong

(56) References Cited

U.S. PATENT DOCUMENTS

| | | | | |
|---|---|---|---|---|
| 2009/0057478 | A1* | 3/2009 | Conner | A47K 10/36 242/564 |
| 2009/0090737 | A1 | 4/2009 | Franco | |
| 2009/0293183 | A1 | 12/2009 | Wei | |
| 2010/0044407 | A1 | 2/2010 | Yardley | |
| 2010/0155432 | A1 | 6/2010 | Christianson | |
| 2010/0269653 | A1* | 10/2010 | Larsson | A47K 10/3625 83/72 |
| 2010/0275912 | A1 | 11/2010 | Lulla et al. | |
| 2010/0288851 | A1 | 11/2010 | Davies | |
| 2011/0210137 | A1 | 9/2011 | Kling | |
| 2011/0276178 | A1 | 11/2011 | Petersen et al. | |
| 2011/0308405 | A1 | 12/2011 | McNeil et al. | |
| 2012/0043353 | A1 | 2/2012 | Davideit et al. | |
| 2012/0104141 | A1* | 5/2012 | Troutman | A47K 10/36 242/563 |
| 2012/0152973 | A1 | 6/2012 | Granger | |
| 2012/0175540 | A1 | 7/2012 | Hase | |
| 2012/0216342 | A1 | 8/2012 | Vaniakin | |
| 2013/0112715 | A1 | 5/2013 | Ophardt | |
| 2013/0193249 | A1 | 8/2013 | Orozco et al. | |
| 2013/0213995 | A1 | 8/2013 | Horel et al. | |
| 2013/0264507 | A1 | 10/2013 | Schnelker et al. | |
| 2014/0135245 | A1 | 5/2014 | Annaheim et al. | |
| 2014/0224893 | A1 | 8/2014 | Finch | |
| 2014/0252042 | A1 | 9/2014 | Cittadino | |
| 2014/0259337 | A1 | 9/2014 | Melvin et al. | |
| 2014/0259340 | A1 | 9/2014 | Cox | |
| 2014/0346704 | A1 | 11/2014 | Sartini et al. | |
| 2014/0349056 | A1 | 11/2014 | Sartini et al. | |
| 2015/0125343 | A1 | 5/2015 | Hall | |
| 2015/0165635 | A1 | 6/2015 | Pringal et al. | |
| 2016/0051098 | A1 | 2/2016 | Marietta-Tondin et al. | |
| 2016/0121350 | A1 | 5/2016 | Yeung | |
| 2016/0131267 | A1 | 5/2016 | Daansen | |
| 2016/0193618 | A1 | 7/2016 | Sacchet et al. | |
| 2016/0256020 | A1 | 9/2016 | Yasui | |
| 2016/0280422 | A1 | 9/2016 | Dorrance | |
| 2016/0309969 | A1 | 10/2016 | Brants | |
| 2016/0353945 | A1 | 12/2016 | Osborne | |
| 2016/0353946 | A1 | 12/2016 | Osborne | |
| 2016/0353947 | A1 | 12/2016 | Osborne | |
| 2016/0362051 | A1 | 12/2016 | Clair-Chalupka | |
| 2017/0008692 | A1 | 1/2017 | Davideit et al. | |
| 2017/0042390 | A1 | 2/2017 | Rubenson et al. | |
| 2017/0164793 | A1 | 6/2017 | Staub | |
| 2017/0251884 | A1 | 9/2017 | Carignan et al. | |
| 2017/0259292 | A1 | 9/2017 | Choi et al. | |
| 2017/0290473 | A1* | 10/2017 | Borke | A47K 10/3687 |
| 2017/0332852 | A1 | 11/2017 | Shimon | |
| 2017/0354984 | A1 | 12/2017 | Beal | |
| 2018/0049487 | A1 | 2/2018 | Blackshear | |
| 2018/0049609 | A1 | 2/2018 | Vuylsteke et al. | |
| 2018/0106431 | A1 | 4/2018 | Timm et al. | |
| 2018/0127195 | A1 | 5/2018 | Ramsey | |
| 2018/0154533 | A1 | 6/2018 | Busch et al. | |
| 2018/0177348 | A1* | 6/2018 | Swanson | A47K 10/3827 |
| 2018/0263433 | A1 | 9/2018 | Osborne | |
| 2018/0325334 | A1* | 11/2018 | Casper | A47K 10/38 |
| 2019/0104897 | A1 | 4/2019 | Vuylsteke et al. | |
| 2019/0125144 | A1 | 5/2019 | Vuylsteke et al. | |
| 2019/0239701 | A1 | 8/2019 | Ray | |
| 2019/0282044 | A1 | 9/2019 | Vuylsteke et al. | |
| 2020/0055658 | A1 | 2/2020 | Casper | |
| 2020/0329927 | A1 | 10/2020 | Han et al. | |

FOREIGN PATENT DOCUMENTS

| | | | |
|---|---|---|---|
| CA | 1184542 | A | 3/1985 |
| CA | 1220902 | A | 4/1987 |
| CA | 2260322 | C | 8/2002 |
| CA | 2555022 | C | 11/2011 |
| CA | 2552123 | C | 3/2012 |
| CA | 2572341 | C | 4/2013 |
| CA | 2975970 | A1 | 8/2016 |
| CA | 2982366 | A1 | 11/2016 |
| CA | 2988638 | C | 7/2020 |
| CN | 2486091 | Y | 4/2002 |
| CN | 2794408 | Y | 7/2006 |
| CN | 100393264 | C | 6/2008 |
| CN | 201146840 | Y | 11/2008 |
| CN | 103307213 | B | 1/2016 |
| CN | 209269525 | U | 8/2019 |
| DE | 2732965 | C2 | 12/1982 |
| DE | 202013000668 | U1 | 12/1982 |
| DE | 2808590 | C2 | 8/1983 |
| DE | 3341469 | A1 | 5/1985 |
| DE | 3342921 | C2 | 11/1987 |
| DE | 8804967 | U1 | 7/1988 |
| DE | 8806609 | U1 | 7/1988 |
| DE | 3329157 | C2 | 8/1989 |
| DE | 3916371 | A1 | 11/1990 |
| DE | 4217878 | A1 | 12/1993 |
| DE | 19546850 | A1 | 6/1997 |
| DE | 29622548 | U1 | 7/1997 |
| DE | 10033876 | A1 | 1/2002 |
| DE | 20316635 | U1 | 1/2004 |
| DE | 202006002677 | U1 | 6/2006 |
| EP | 292946 | A1 | 11/1988 |
| EP | 316865 | A1 | 5/1989 |
| EP | 334315 | A1 | 9/1989 |
| EP | 417834 | A1 | 3/1991 |
| EP | 488877 | A1 | 6/1992 |
| EP | 312053 | B1 | 1/1993 |
| EP | 2135539 | A1 | 12/2009 |
| EP | 2522265 | A1 | 11/2012 |
| EP | 2214542 | B1 | 8/2016 |
| EP | 2142060 | B1 | 8/2019 |
| FR | 2395003 | A1 | 1/1979 |
| FR | 2616422 | A1 | 12/1988 |
| FR | 2622183 | A2 | 4/1989 |
| FR | 2742036 | B1 | 1/1998 |
| FR | 2848590 | B1 | 10/2005 |
| GB | 618311 | A | 2/1949 |
| GB | 653297 | A | 5/1951 |
| GB | 2108170 | A | 5/1983 |
| GB | 2058867 | B | 4/1984 |
| GB | 2208122 | A | 3/1989 |
| GB | 2214536 | A | 9/1989 |
| GB | 2208122 | B | 11/1991 |
| GB | 2425544 | A | 11/2006 |
| JP | S63-154566 | A | 6/1988 |
| JP | H01-212521 | A | 8/1989 |
| JP | H01-293825 | A | 11/1989 |
| JP | H03-1830 | A | 1/1991 |
| JP | H05-84155 | A | 4/1993 |
| JP | H05-95851 | A | 4/1993 |
| JP | H05-95852 | A | 4/1993 |
| JP | H05-146375 | A | 6/1993 |
| JP | H05-184480 | A | 7/1993 |
| JP | H0556731 | B2 | 8/1993 |
| JP | H0580892 | B2 | 8/1993 |
| JP | H07-37591 | Y2 | 8/1995 |
| JP | 2571243 | B2 | 1/1997 |
| JP | 2642678 | B | 8/1997 |
| JP | 2651193 | B2 | 9/1997 |
| JP | 2652179 | B2 | 9/1997 |
| JP | 2685782 | B2 | 12/1997 |
| JP | 2694873 | B2 | 12/1997 |
| JP | 2699089 | B2 | 1/1998 |
| JP | 2777721 | B2 | 7/1998 |
| JP | 2844823 | B2 | 1/1999 |
| JP | 2852523 | B2 | 2/1999 |
| JP | 3071865 | B2 | 7/2000 |
| JP | 2002113398 | A | 4/2002 |
| JP | 2003246380 | A | 9/2003 |
| KR | 200176337 | Y1 | 3/2000 |
| KR | 20050005743 | A | 1/2005 |
| KR | 20110113823 | A | 10/2011 |
| MX | 2009001054 | A | 2/2009 |
| MX | 2010006136 | A | 7/2010 |
| MX | 2017014086 | A | 11/2018 |
| WO | WO 86/05076 | A1 | 9/1986 |

(56) References Cited

FOREIGN PATENT DOCUMENTS

| | | | |
|---|---|---|---|
| WO | WO 90/09137 | A1 | 8/1990 |
| WO | WO 92/04181 | A1 | 3/1992 |
| WO | WO 93/05695 | A1 | 4/1993 |
| WO | WO 95/16381 | A1 | 6/1995 |
| WO | WO 95/19304 | A1 | 7/1995 |
| WO | WO 97/20489 | A1 | 6/1997 |
| WO | WO 99/45803 | A1 | 9/1999 |
| WO | WO 01/41614 | A1 | 6/2001 |
| WO | WO 2001/72194 | A1 | 10/2001 |
| WO | WO 02/094043 | A1 | 11/2002 |
| WO | WO 03/061447 | A1 | 7/2003 |
| WO | WO 03/096861 | A1 | 11/2003 |
| WO | WO 2005/092167 | A1 | 10/2005 |
| WO | WO 2008/115391 | A2 | 9/2008 |
| WO | WO 2009/117113 | A1 | 9/2009 |
| WO | WO 2011/083401 | A2 | 7/2011 |
| WO | WO 2011/116734 | A1 | 9/2011 |
| WO | WO 2014/159686 | A1 | 10/2014 |
| WO | WO 2016/094969 | A1 | 6/2016 |
| WO | WO 2016/124059 | A1 | 8/2016 |
| WO | WO 2016/152881 | A1 | 9/2016 |
| WO | WO 2016/162660 | A1 | 10/2016 |
| WO | WO 2016/169632 | A1 | 10/2016 |
| WO | WO 2017/025707 | A1 | 2/2017 |
| WO | WO 2018/052973 | A1 | 3/2018 |
| WO | WO 2019/098260 | A1 | 5/2019 |

OTHER PUBLICATIONS

Brill Hygienic Products, Inc.; Toilet Seat Cover Dispensers; retrieved Nov. 30, 2020 from https://brillseat.com/toilet-seat-cover-dispensers/.

"Sani-seat;" retrieved Nov. 30, 2020 from https://www.saniseat.com/.

* cited by examiner

AUTOMATED TOILET SEAT COVER DISPENSER

CROSS-REFERENCE TO RELATED APPLICATIONS

This application claims priority to U.S. Provisional Application No. 62/992,200, entitled "Automated Toilet Seat Cover Dispenser", filed Mar. 20, 2020, and U.S. Provisional Application No. 62/904,161, entitled "Automated Toilet Seat Cover Dispenser", filed Sep. 23, 2019; each of which is incorporated by reference herein in its entirety.

FIELD OF THE INVENTION

Example embodiments of the present invention generally relate to dispensers and, more particularly to, sheet product dispensers capable of providing toilet seat covers, such as from sheet product rolls.

BACKGROUND

Sitting on toilet seats, especially public toilet seats, is often undesirable and a user is often nervous about cleanliness of the toilet seat. Flushable toilet seat covers are, thus, often available in the restroom environment to enable a user to cover the toilet seat during use. Such toilet seat covers are often provided in a manual dispenser in interfolded form, which leads to a number of undesirable results. For example, a user may take more than one toilet seat cover at one time, which leads to damaged and wasted toilet seat covers (and often increased incident of toilet clogging when the user flushes extra material down the toilet). Additionally, the crease in the toilet seat cover (required for interfolded form) can make laying the toilet seat cover flat on the toilet seat frustrating and difficult—often requiring additional adjustments and sometimes leading to portions of the toilet seat cover falling into the toilet water. Moreover, such dispensers have hygiene concerns due to, for example, incidental touching of additional toilet seat covers when a user reaches their hand into the dispenser to obtain a toilet seat cover. Further, there is additional exposure of the stored toilet seat covers to the environment due the large hole created to enable a user to obtain a toilet seat cover from the dispenser. Of further note, it can be difficult for a maintainer to track or estimate the amount of toilet seat covers remaining due to the interfolded form and the propensity for users to grab multiple toilet seat covers at one time—all of which leads to difficulty in determining when to replace the supply of toilet seat covers in the dispenser, which often leads to an empty scenario for the dispenser.

BRIEF SUMMARY

Embodiments of the present invention provide automated toilet seat cover dispensers with various features that provide many benefits and improvements over current toilet seat cover dispensers. Notably, however, even providing toilet seat covers in automated dispensers presents many difficulties that embodiments of the present invention overcome. In this regard, in addition to difficulties noted with respect to manual dispensers, even known techniques used in automated dispensers for other types of sheet product, such as paper towel and tissue paper, are not easily translatable to automated toilet seat cover dispensers and do not solve all the difficulties presented with automatically dispensing toilet seat covers.

For example, the length and width of each toilet seat cover sheet must be relatively large (to cover the toilet seat) compared to other typically-sized dispensed portions of sheet product (e.g., paper towel or tissue paper) that are utilized with common automated sheet product dispensers. This leads to larger supplies that need to be stored within the housing and still usable with the dispensing mechanisms. Further, utilizing a rolled format for the toilet seat covers, which removes the undesirable crease, presents challenges due to the large size of the supply and the limited available space in the typical restroom environment (e.g., the size of the stall).

Of further note, the toilet seat covers may be flushable (e.g., capable of passing through the plumbing of the toilet) and, in some embodiments, dispersible (e.g., capable of at least partially disintegrating in water). Whether flushable and/or dispersible, the type of sheet product used to form the toilet seat covers may make it difficult to employ common automatic dispenser techniques used for other types of sheet product. In this regard, since the substrate of the toilet seat cover is made of flushable and/or dispersible paper and the width of the toilet seat cover sheet is relatively large, the toilet seat cover is prone to improper tearing when a user grabs it for a dispense. This can, unfortunately, lead to a wasted toilet seat cover and a frustrating user experience.

Thus, embodiments of the present invention provide systems, methods, and apparatuses for providing a toilet seat cover to a user for use through an automatic dispenser. In this regard, embodiments of the present invention provide automated sheet product dispensers for toilet seat covers that overcome and/or address the above noted difficulties. An example sheet product (e.g., toilet seat cover) dispenser is configured to dispense predetermined portions (e.g., individually-sized toilet seat covers, sheets, etc.) from a sheet product roll. The sheet product roll includes a plurality of the predetermined portions, where a line of perforations separates consecutive predetermined portions. A motor operates to drive a drive roller to cause movement of the sheet product along a dispensing pathway to position a leading predetermined portion of the sheet product into a dispensing position such that the trailing edge of the leading predetermined portion is positioned within the housing and the leading edge of the leading predetermined portion is positioned outside of a dispensing chute to enable removal of the leading predetermined portion of the sheet product (e.g., a user can tear off a single portion corresponding to a toilet seat cover).

Notably, various embodiments of the present invention provide advantageous components/features that improve the dispensing quality and experience for users. For example, due to the substrate being flushable and/or dispersible paper and the relatively long width of each predetermined portion, it can be important to tear the line of perforations appropriately. In this regard, pulling the predetermined portion in an undesirable manner (e.g., at an angle, applying too much pull force on one side, etc.) can result in improper tearing and, thus, a potentially wasted toilet seat cover and frustrating user experience. Thus, embodiments of the present invention have developed one or more features/components to aid in ensuring proper tearing and, thus, providing an intact toilet seat cover to the user.

In some embodiments, an elongated chute (e.g., from the nip of the dispensing mechanism to the end (e.g., exit) of the dispensing chute) can help in ensuring a proper tear occurs when a user pulls on the leading predetermined portion that is in the dispensing position. In this regard, the elongated chute may enable the line of perforations to be positioned along the dispensing pathway in the dispensing chute (so that tearing thereof can occur), but still enable a significant portion of the leading predetermined portion to be contained within the dispensing chute also. This directs a user's pulling force by limiting side pulling of the predetermined portion (which is restricted due to being contained within the dispensing chute).

Notably, however, the relatively long length of each predetermined portion (so as to cover the toilet seat) and the elongated dispensing chute may require a long waiting time for a user to receive a dispense (e.g., the user would have to wait for the entire length of the predetermined portion to dispense each time they activated the dispenser). Thus, in some embodiments, staged dispensing is employed, such as to help maintain hygiene by keeping the "next" leading predetermined portion inside the housing in a staged position, while still enabling a short time period required for advancing the leading predetermined portion to a dispensing position at least partially outside of the housing—thereby maintaining a pleasant user experience.

In some embodiments, the predetermined portions have markings thereon that can be "read" by one or more sensors along the dispensing pathway within the dispenser and used to position the predetermined portions appropriately. For example, the sensor(s) may read the marking and operate the motor accordingly to position the predetermined portion into the staged position or the dispensing position depending on the desired operation at the time.

In some embodiments, perforation tear assist features are provided to aid in proper separation of the line of perforations between the predetermined portions, such as to help ensure occurrence of a proper dispense for a user.

For example, one or more ribs (e.g., protrusions) may be positioned within the dispensing chute at one or more positions along the dispensing pathway. The protrusion(s) may extend into the dispensing pathway and provide increased tension on the predetermined portion when a user pulls on the predetermined portion for a dispense. That increased tension may be directed toward the line of perforations to aid in ensuring proper tearing of the perforations and, thus, providing the desired dispense. In this regard, the dispenser may be configured to align the line of perforations with the one or more protrusions when the predetermined portion is in the dispensing position, such as using markings. In some embodiments, a plurality of ribs can extend into the dispensing pathway at varying heights, which can help direct a tear, such as toward the center of the predetermined portion.

Another example contemplated perforation tear assist feature includes providing a lever within the dispensing pathway that pivots downwardly when a user pulls on the leading predetermined portion to reveal one or more protrusions that align with the line of perforations to spread them apart to help ensure proper separation of the perforations.

A further example perforation tear assist feature includes a brake feature that is configured to interact with the sheet product such that when a user pulls on the leading predetermined portion, the brake feature moves to engage and "brake" one of the drive roller or the nip roller to prevent further sheet product from being pulled through the nip. This also creates tension that can help ensure proper tearing of the line of perforations to ensure a proper dispense. In other embodiments, the motor may be designed to operate to provide an electronic "brake" that may achieve a similar result.

In other embodiments, other perforation tear assist features may be employed with different dispenser configurations. For example, two nips can be used to "pop" or automatically tear the line of perforations to ensure proper removal of the toilet seat cover. In this regard, a first nip (e.g., a drive roller for the first nip) can be operated at a different speed or in a different direction than the second nip (e.g., a drive roller for the second nip) to cause tension that results in tearing of the perforations. A detached predetermined portion (e.g., toilet seat cover) can then be provided to the user. In other example embodiments, the dispenser may employ clamps to hold the predetermined portion to encourage proper tearing (e.g., through increased tension). In still other embodiments, either in conjunction with or instead of perforations, a cutter (e.g., a rotary cutter) can be utilized to separate a predetermined portion.

Some embodiments of the present invention also contemplate other beneficial features/components. For example, a chute extension can extend from the housing to further elongate the dispensing chute and define/direct removal of the leading predetermined portion by the user. In some embodiments, different shapes may be used to block access to certain portions of the leading predetermined portion—thereby forcing removal using the exposed portions. In some embodiments, notifications, such as color (e.g., red or green) indication lights, may be utilized to inform the end user when it is OK to remove the leading predetermined portion.

Another contemplated beneficial feature/component includes providing printed indicia on the toilet seat covers to encourage and direct proper conversion of the dispensed portion for placement and use on the toilet seat. In some embodiments, the sheet product used to form the toilet seat covers can be printed, such as to provide a certain appearance (e.g., embossing, premium quality etc.).

In some embodiments, each predetermined portion may include a series of perforations that can be torn in order to form a center hole corresponding to the opening in the toilet. In some embodiments, certain perforation types can be employed to help direct tearing to form the center hole. For example, a catch portion of a perforation may be angled so as to catch and redirect errant tears and help ensure that the predetermined portion does not get unnecessarily torn (which may otherwise lead to discarding of the torn toilet seat cover). In some embodiments, a finger assist perforation may be used to direct the initial tearing of a user trying to form the center hole.

A further contemplated beneficial feature/component includes providing the activation sensor (e.g., the hand wave sensor) at different positions and oriented at different angles along the housing to prevent inadvertent dispensing. For example, the activation sensor may be angled to look for user interaction (e.g., hand waves) at an upward angle outwardly and forwardly from the housing—which may avoid a user inadvertently activating a dispense when sitting on the toilet seat if the dispenser is mounted behind the toilet. Similarly, the activation sensor may be positioned and oriented to sense downwardly of the dispenser or out to the side of the dispenser.

A further contemplated beneficial feature/component includes providing various monitoring and reporting capabilities, such as with respect to an installed sheet product roll (e.g., the amount of sheet product remaining, whether the roll is authorized, among other things).

In some embodiments, various manufacturing techniques for forming the sheet product rolls are contemplated herein.

In an example embodiment, a sheet product dispenser for dispensing sheet product from a roll of sheet product is provided. The sheet product defines a plurality of sheets separated by a line of perforations. The sheet product dispenser comprises a roll holder configured to support the roll of sheet product and a dispensing mechanism operable to dispense the sheet product from the roll. The sheet product dispenser further includes a dispensing chute defining an elongated portion extending within the dispensing chute from the dispensing mechanism to an end of the dispensing chute. The sheet product dispenser further includes a dispensing pathway extending at least from the roll holder to the end of the dispensing chute. The elongated portion of the dispensing chute defines a length of the dispensing pathway that is at least half of a length of a sheet of the sheet product. The sheet product dispenser further includes a motor operable to cause the dispensing mechanism to move the sheet product along the dispensing pathway, a sensor configured to detect detachment of a leading sheet from the sheet product roll, and a controller. The controller is operable to receive an indication of detachment of the leading sheet from the sensor; and cause, in response to receiving the indication, the motor to operate the dispensing mechanism to move a next leading sheet of the sheet product into a staged position such that the next leading sheet of the sheet product is positioned along the dispensing pathway with a leading edge inside the dispensing chute.

In some embodiments, the sheet product dispenser further comprises an activation sensor. The controller is further operable to receive an indication of user input from the activation sensor; and cause, in response to receiving the indication, the motor to operate the dispensing mechanism to move the next leading sheet from the staged position into a dispensing position such that the next leading sheet is positioned with the leading edge outside of the end of the dispensing chute and a trailing edge inside dispensing chute and along the dispensing pathway downstream of the dispensing mechanism. In some embodiments, the controller is further operable to wait a predetermined amount of time after receiving the indication of detachment of the leading sheet before causing the motor to operate the dispensing mechanism to move the next leading sheet into the staged position.

In some embodiments, when the next leading sheet is in the staged position, the leading edge of the next leading sheet is positioned less than 6 inches from the end of the dispensing chute.

In some embodiments, the roll holder is positioned vertically below a nip of the dispensing mechanism and the end of the dispensing chute is positioned vertically below the roll holder. The dispensing pathway leads upwardly from the roll holder through the nip and back down through the dispensing chute.

In some embodiments, the elongated portion is between 14 inches and 24 inches in length.

In some embodiments, the housing of the sheet product dispenser defines a length between 12 inches and 24 inches, a width between 16 inches and 22 inches; and a depth between 4 inches and 6 inches.

In some embodiments, when the next leading sheet is in the staged position, a trailing edge of the next leading sheet is positioned along the dispensing pathway between the dispensing mechanism and the roll holder.

In another example embodiment, a method for operating a sheet product dispenser to dispense sheet product from a sheet product roll is provided. The method comprises receiving a dispense request and causing, in response to receiving the dispense request, a motor to operate to cause advancement of the sheet product along a dispensing pathway such that a leading predetermined portion of the sheet product moves into a dispensing position with a leading edge of the leading predetermined portion positioned outside of an end of a dispensing chute of the sheet product dispenser and a trailing edge of the leading predetermined portion positioned inside the dispensing chute in a first position. The method further includes determining removal of the leading predetermined portion; and causing, after removal of the leading predetermined portion, the motor to operate to cause further advancement of the sheet product along the dispensing pathway so as to position a next leading predetermined portion in a staged position with a leading edge of the next leading predetermined portion being positioned within the dispensing chute at a second position along the dispensing pathway that is downstream of a dispensing mechanism and upstream of the end of the dispensing chute. The second position is closer to the end of the dispensing chute than the first position.

In some embodiments, causing the motor to operate to cause advancement of the sheet product along the dispensing pathway such that the leading predetermined portion of the sheet product moves into the dispensing position comprises causing the trailing edge of the leading predetermined portion to align with a perforation tear assist feature positioned along the dispensing pathway within the dispensing chute. The perforation tear assist feature is configured to aid in removal of the leading predetermined portion along a line of perforations at the trailing edge of the leading predetermined portion.

In some embodiments, causing the motor to operate to cause advancement of the sheet product along the dispensing pathway such that the leading predetermined portion of the sheet product moves into the dispensing position comprises causing, based on mark detector data from a mark detector, the motor to cease operation to position the leading predetermined portion of the sheet product in the dispensing position. The mark detector is configured to detect one or more markings on the sheet product.

In yet another example embodiment, a system is provided. The system comprises a sheet product roll, wherein the sheet product roll comprises a plurality of predetermined portions. Each of the plurality of predetermined portions defines a toilet seat cover. Consecutive predetermined portions are separated by a line of perforations extending along a width direction of the sheet product. Each of the plurality of predetermined portions includes at least one cut-out or a series of perforations that define at least a portion of a shape corresponding to an opening in a toilet seat. Each of the plurality of predetermined portions define a length extending from a leading edge to a trailing edge. The line of perforations extends along the width direction of the sheet product at the trailing edge. The system further includes a toilet seat cover dispenser comprising a housing with a dispensing chute. The dispenser further includes a roll holder positioned within the housing and configured to support the sheet product roll; a drive roller positioned within the housing; and a nip roller positioned within the housing and configured to, with the drive roller, define a nip that receives sheet product from the sheet product roll. The dispenser further includes a dispensing pathway extending from the roll holder to an end of the dispensing chute; a motor configured to operate to drive the drive roller to cause advancement of the sheet product along the dispensing pathway within the housing; a sensor configured to detect detachment of a leading predetermined portion of the sheet product roll; and a controller. The controller is operable to receive an indication of detachment of the leading predetermined portion from the sensor; and cause, in response to receiving the indication, the motor to operate to cause advancement of the sheet product along the dispensing pathway to move a next leading predetermined portion of the sheet product into a staged position such that the next leading predetermined portion of the sheet product is positioned along the dispensing pathway with a leading edge inside the dispensing chute.

In some embodiments, the system further includes an activation sensor. The controller is further operable to receive an indication of user input from the activation sensor; and cause, in response to receiving the indication, the motor to operate to cause advancement of the next leading predetermined portion from the staged position into a dispensing position such that the next leading predetermined portion is positioned with the leading edge outside of the end of the dispensing chute and a trailing edge inside dispensing chute and along the dispensing pathway downstream of the nip.

In some embodiments, when the new leading predetermined portion is in the staged position, the leading edge of the new leading predetermined portion is positioned less than 6 inches from an end of the dispensing chute.

In some embodiments, the roll holder is positioned vertically below the nip and the end of the dispensing chute is positioned vertically below the roll holder. The dispensing pathway leads upwardly from the roll holder through the nip and back down through the dispensing chute.

In some embodiments, the housing of the toilet seat cover dispenser defines a length between 12 inches and 24 inches, a width between 16 inches and 22 inches; and a depth between 4 inches and 6 inches.

In some embodiments, the system further includes a perforation tear assist feature that is configured to aid in removal of the leading predetermined portion along the line of perforations at the trailing edge of the leading predetermined portion, and wherein the controller is configured to cause the motor to operate to cause the leading predetermined portion to move into the dispensing position such that the trailing edge of the leading predetermined portion aligns with the perforation tear assist feature. In some embodiments, the perforation tear assist feature comprises at least one rib that extends into the dispensing pathway within the dispensing chute such that, when a user pulls on the leading predetermined portion for removal thereof, tension is focused at a position on the sheet product corresponding to the trailing edge of the leading predetermined portion so as to aid in removal via separation of the line of perforations at the trailing edge. In some embodiments, the at least one rib comprises a plurality of ribs that extend into the dispensing pathway at varying heights. In some embodiments, the plurality of ribs are positioned across the width direction so as to each align with a perforation opening of the line of perforations. In some embodiments, the plurality of ribs are positioned across the width direction, wherein at least two gaps between consecutive ribs of the plurality of ribs define different distances. In some embodiments, the plurality of ribs define a stepped reduction in height extending into the dispensing pathway leading from a position proximate a side edge of the line of perforations at the trailing edge of the leading predetermined portion toward a center of the line of perforations at the trailing edge of the leading predetermined portion.

In some embodiments, the perforation tear assist feature comprises a brake feature movable between a first position and a second position. The brake feature comprises a body extending into the dispensing pathway. The brake feature is biased to the first position. When the brake feature is in the second position, the brake feature engages with at least one of the drive roller or the nip roller to prevent further rotation thereof. The brake feature is configured to move to the second position when a user pulls on the leading predetermined portion for removal thereof so as to cause the nip to hold the sheet product therein without enabling further translation therethrough and to create tension in the sheet product to aid in removal of the leading predetermined portion via separation of the line of perforations at the trailing edge. In some embodiments, the brake feature is a roller. The roller further includes at least one rib that extends into the dispensing pathway within the dispensing chute such that, when a user pulls on the leading predetermined portion for removal thereof, tension is focused at a position on the sheet product corresponding to the trailing edge of the leading predetermined portion so as to aid in removal via separation of the line of perforations at the trailing edge In some embodiments, the perforation tear assist feature comprises a lever that is movable between a first position and a second position. The lever comprises a body with a top surface and a hole extending through the body and the top surface. The lever is biased to the first position. The perforation tear assist feature includes a projection that extends toward the dispensing pathway and into the hole of the lever. The projection is configured to focus pressure onto a position of the sheet product when a user pulls on the leading predetermined portion for removal thereof. The top surface is positioned above the projection with respect to the dispensing pathway when the lever is in the first position. The top surface is positioned below a top of the projection with respect to the dispensing pathway when the lever is in the second position. The lever is configured to move to the second position when the user pulls on the leading predetermined portion for removal thereof so as to enable the projection to contact the sheet product to focus pressure onto the sheet product to aid in removal of the leading predetermined portion via separation of the line of perforations at the trailing edge.

In some embodiments, the system further comprises a mark detector configured to detect one or more markings on the sheet product. The controller is configured to cause, based on mark detector data received from the mark detector, the motor to cease operation to position the leading predetermined portion of the sheet product in the dispensing position. In some embodiments, the controller is configured to determine a type or characteristic of the sheet product installed on the roll holder based on the mark detector data received from the mark detector.

In some embodiments, each of the plurality of predetermined portions comprises printed indicia indicating one or more directions for a user regarding converting the predetermined portion into a use configuration using the at least cut-out or the series of perforations.

In some embodiments, the sheet product is dispersible paper-based.

In some embodiments, the system further comprises a chassis configured to move between a stowed position inside the housing and an unstowed position. The roll holder is positioned on the chassis and configured to move with the chassis. The dispensing chute is positioned below the chassis. The sheet product dispenser defines a dispensing pathway leading from the nip roller to behind the chassis and to the dispensing chute.

In yet another example embodiment, a seat cover dispenser for dispensing from a sheet product roll is provided. The dispenser comprises a roll holder for supporting the sheet product roll. The sheet product roll comprises a plurality of predetermined portions, wherein consecutive predetermined portions are separated by a line of perforations extending along a width direction of the sheet product. Each of the plurality of predetermined portions includes at least one cut-out or a series of perforations that define at least a portion of a shape corresponding to an opening in a toilet seat. A width of a predetermined portion of the sheet product roll is between 10 inches and 18 inches and a length of the predetermined portion of the sheet product roll is between 12 inches and 22 inches. The dispenser includes a dispensing mechanism and a dispensing pathway leading through a nip of the dispensing mechanism to a dispensing outlet. A ratio of the length of the predetermined portion of the sheet product roll to a length of a portion of the dispensing pathway extending from the nip to the dispensing outlet is between 0.5 and 1 so as to cover a portion of a leading predetermined portion when the leading predetermined portion is in a dispensing position with a trailing edge at a first position along the dispensing pathway downstream of the nip and a leading edge at a second position outside of the dispensing outlet.

In some embodiments, the ratio of the length of the predetermined portion of the sheet product roll to the length of at least the portion of the dispensing pathway is between 0.6 and 0.8.

In some embodiments, when the leading predetermined portion is in the dispensing position, a line of perforations at the trailing edge of the leading predetermined portion is past the nip along the dispensing pathway.

In some embodiments, when the leading predetermined portion is in the dispensing position, the line of perforations at the trailing edge is aligned with a perforation tear assist feature that is configured to aid in removal of the leading predetermined portion along the line of perforations at the trailing edge.

In yet another example embodiment a sheet product roll of continuous sheet product is provided. The sheet product roll comprises a plurality of predetermined portions. Each of the plurality of predetermined portions define a length extending from a leading edge to a trailing edge. Consecutive predetermined portions are separated by a line of perforations extending along a width direction of the sheet product. The line of perforations extends along the width direction of the sheet product at the trailing edge. Each of the plurality of predetermined portions includes a series of perforations that define at least a portion of a shape corresponding to an opening in a toilet seat. The series of perforations comprise at least one first perforation that comprises a catch portion and a main portion. The main portion defines a length extending along at least a portion of a periphery of the shape corresponding to the opening in the toilet seat. The length defines a start and an end. The catch portion extends from the start of the main portion and defines at least one branch portion extending at a non-zero angle with respect to the main portion that is designed to redirect a tear in the sheet product toward the main portion of the first perforation.

In some embodiments, the series of perforations further comprise a finger assist perforation. The finger assist perforation defines a curved portion corresponding to a shape of a finger or a hand. The finger assist perforation is positioned at a top of the shape corresponding to the opening in the toilet seat.

In some embodiments, the at least one first perforation is positioned such that the start of the main portion is positioned relatively closer to the finger assist perforation than the end of the main portion.

In yet another example embodiment, a sheet product dispenser is provided. The sheet product dispenser includes a housing comprising a dispensing chute and a roll holder positioned within the housing and configured to support a sheet product roll. The sheet product roll comprises a plurality of predetermined portions, wherein consecutive predetermined portions are separated by a line of perforations extending along a width direction of the sheet product. Each of the plurality of predetermined portions includes at least one cut-out or a series of perforations that define at least a portion of a shape corresponding to an opening in a toilet seat. Each of the plurality of predetermined portions define a length extending from a leading edge to a trailing edge. The line of perforations extends along the width direction of the sheet product at the trailing edge. The sheet product dispenser includes a first drive roller positioned within the housing, a first nip roller positioned within the housing and configured to, with the first drive roller, define a first nip that receives sheet product from the sheet product roll, a second drive roller positioned within the housing, and a second nip roller positioned within the housing and configured to, with the second drive roller, define a second nip that receives sheet product from the sheet product roll, wherein the second nip is downstream of the first nip along a dispensing pathway leading from the roll holder to the dispensing chute. The sheet product dispenser further includes at least one motor configured to operate to drive at least one of the first drive roller and the second drive roller to cause movement of the sheet product along the dispensing pathway. The first drive roller is independently operable with respect to the second drive roller. The sheet product dispenser further includes an activation sensor configured to sense user input and a controller. The controller is configured to receive sensor data from the activation sensor, cause, in response to receiving the sensor data, the at least one motor to operate to cause translation of the sheet product along the dispensing pathway to a first position in which the trailing edge of a leading predetermined portion of the sheet product is positioned between the first nip and the second nip, and cause at least one of the first drive roller or the second drive roller to operate such that the first drive roller and the second drive roller operate at different speeds or in different directions to cause separation of the line of perforations at the trailing edge of the leading predetermined portion so as to enable a user to pull the leading predetermined portion from the dispensing chute.

In some embodiments, the controller is further configured to cause the at least one motor to operate to cause the second drive roller to cause dispensing of the leading predetermined portion through the dispensing chute after separation of the line of perforations.

In some embodiments, the sheet product dispenser further includes a mark detector configured to detect one or more markings on the sheet product, and the controller is configured to cause, based on mark detector data received from the mark detector, the motor to cease operation to position the leading predetermined portion of the sheet product such that the trailing edge of the leading predetermined portion is between the first nip and the second nip.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 4A:
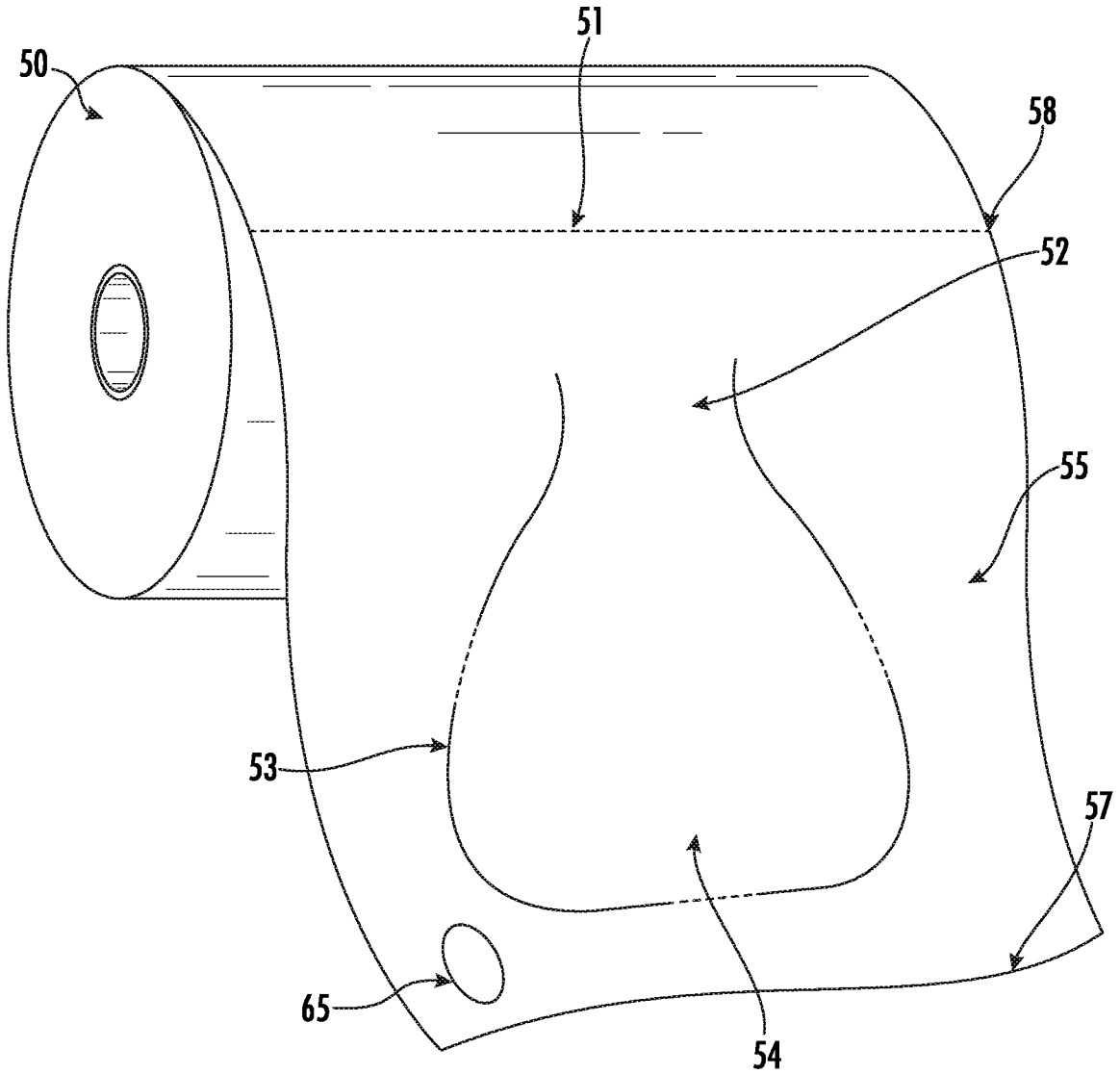
FIG. 4A shows an example sheet product roll, such as for use with the example sheet product dispensers described herein, in accordance with some embodiments discussed herein.
Figure 4B:
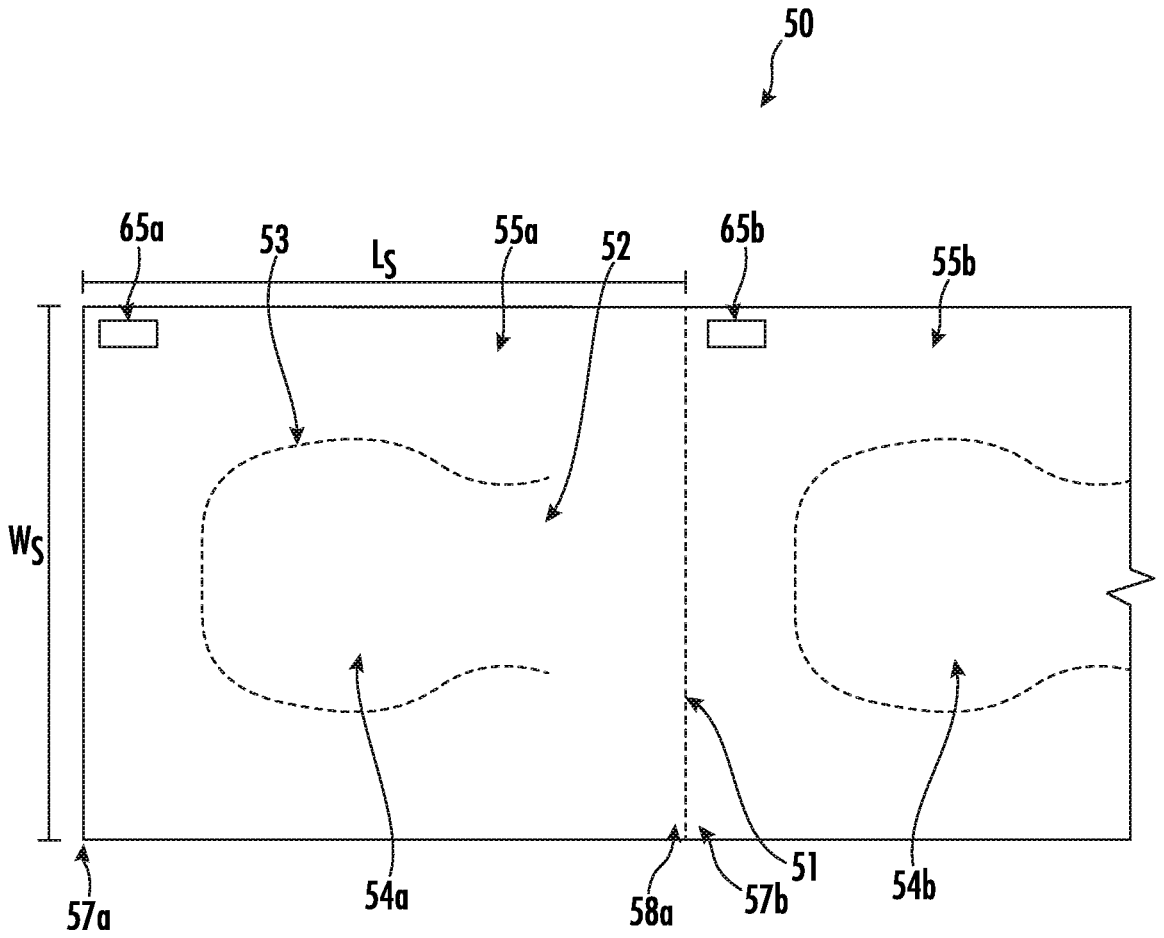
FIG. 4B illustrates a portion of an example sheet product roll, showing a leading predetermined portion, in accordance with some embodiments discussed herein.
Figure 4C:
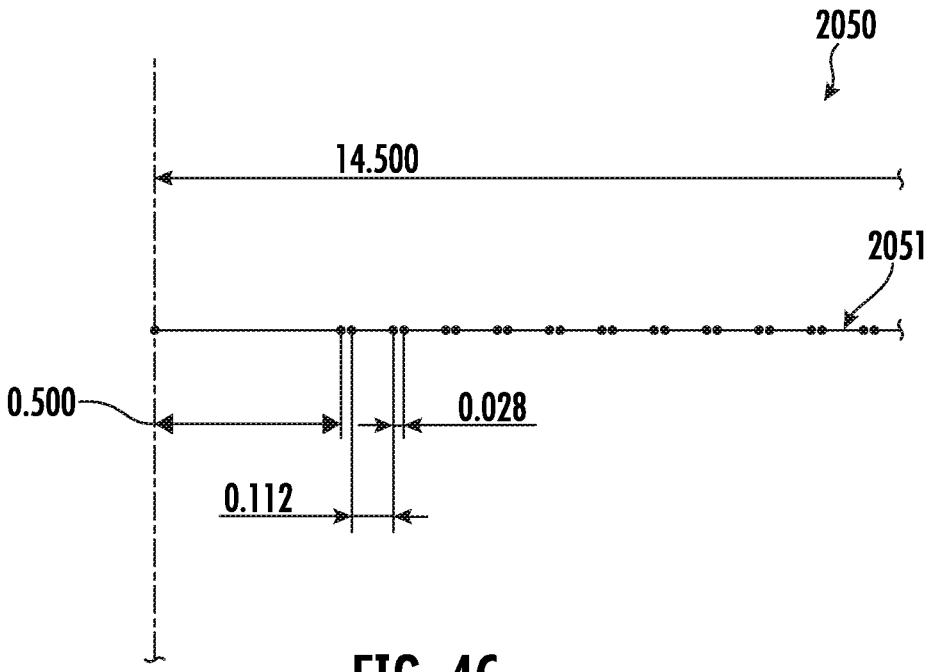
Figure 4D:
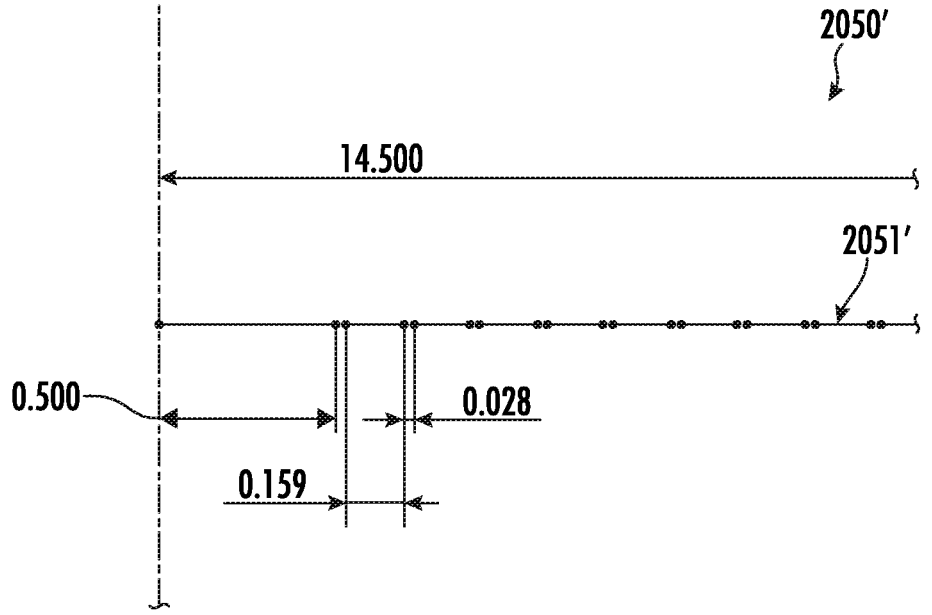
Figure 4E:
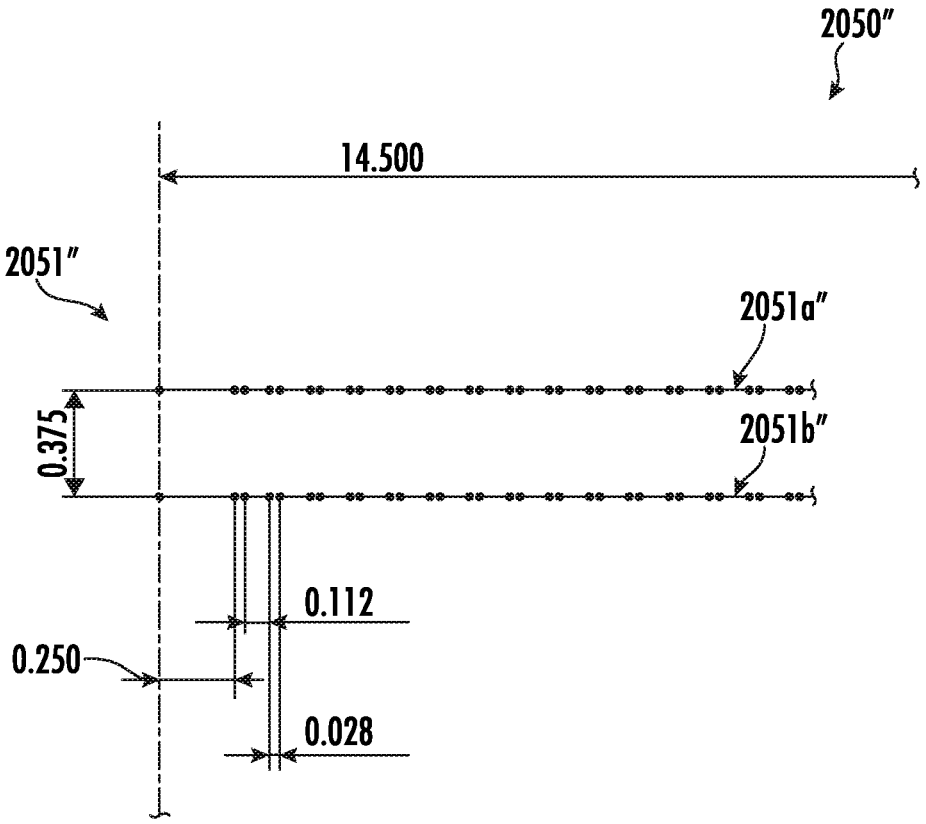
Figure 4F:
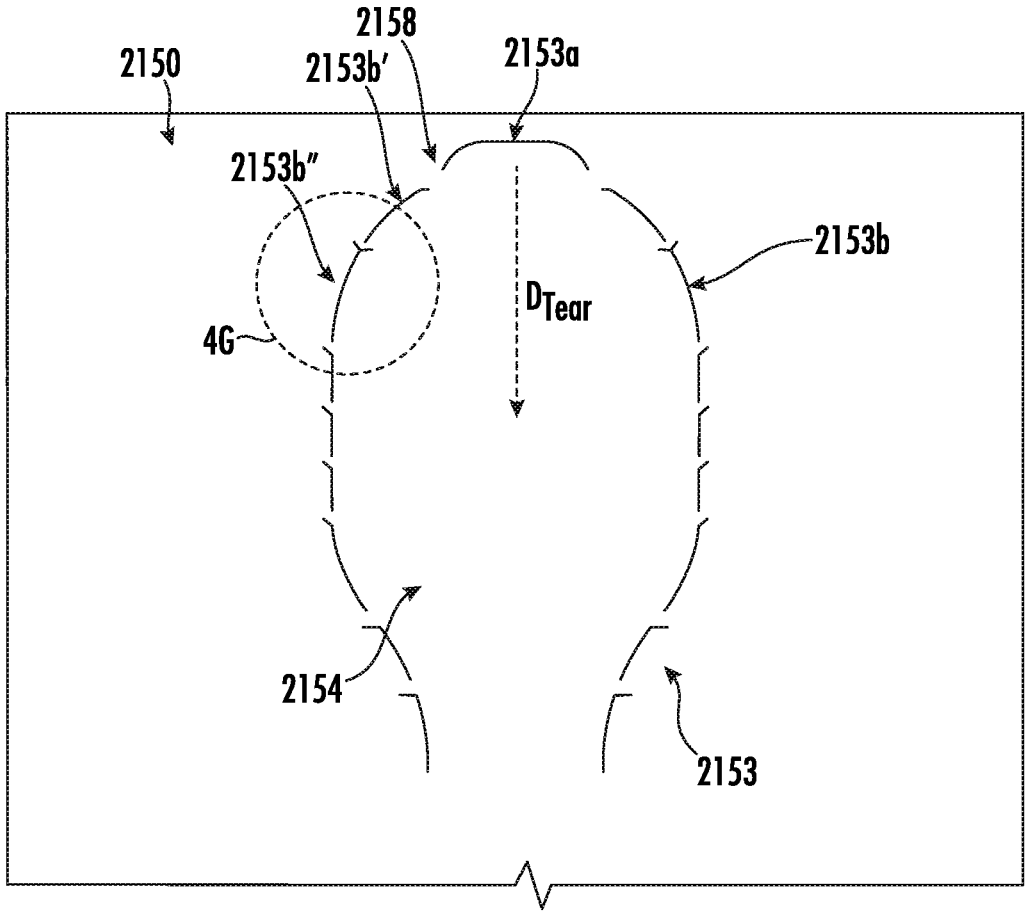
Figure 4G:
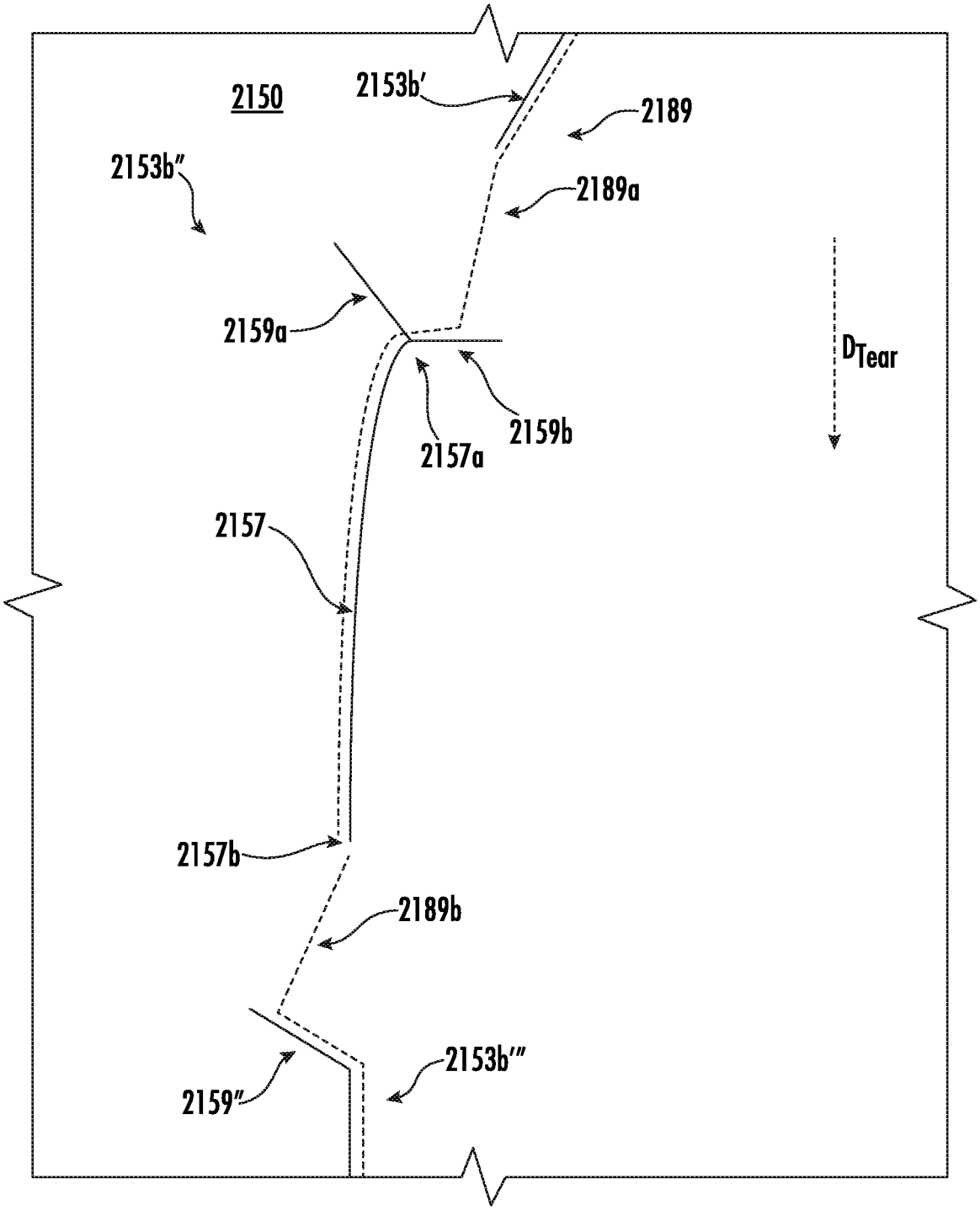
Figure 4H:
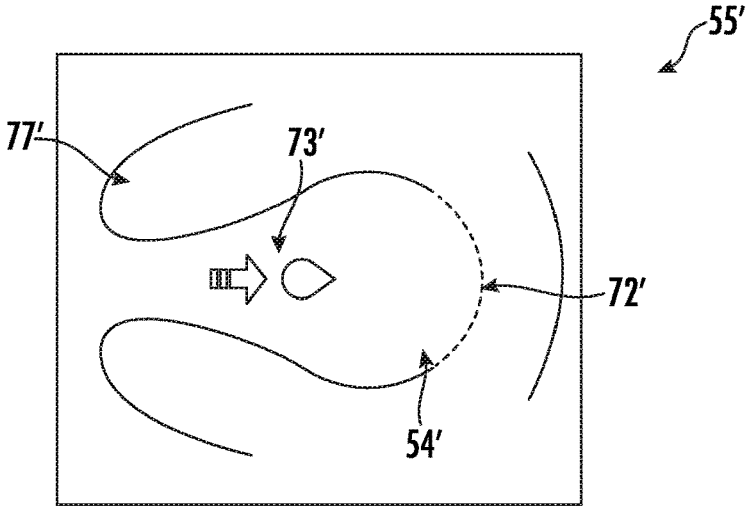
Figure 4I:
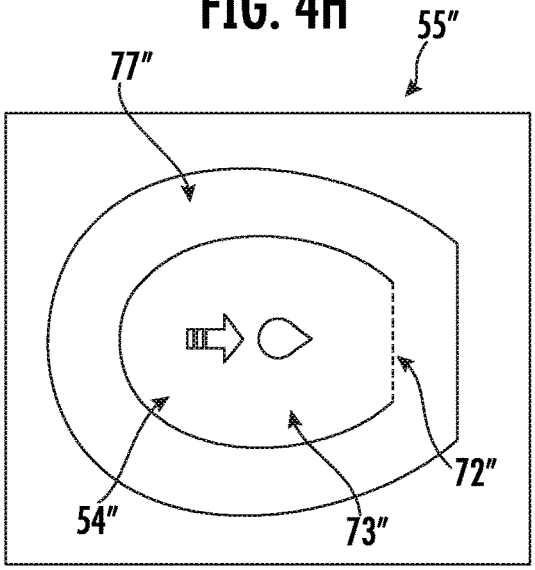
Figure 4J:
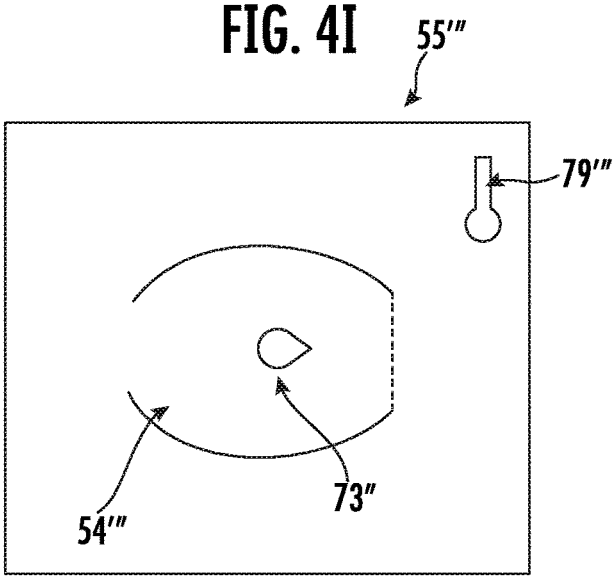
Figure 4K:
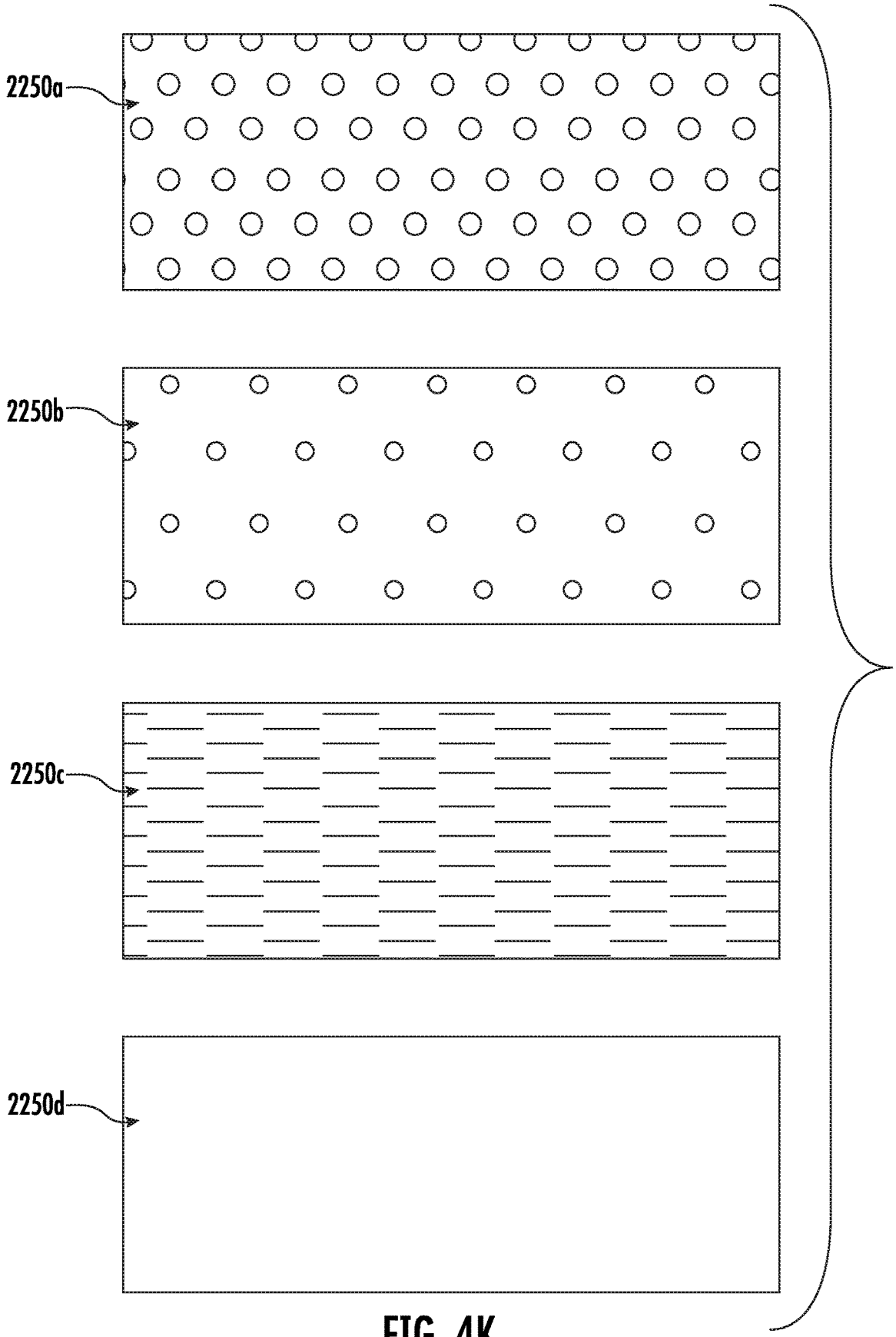
Figure 5:
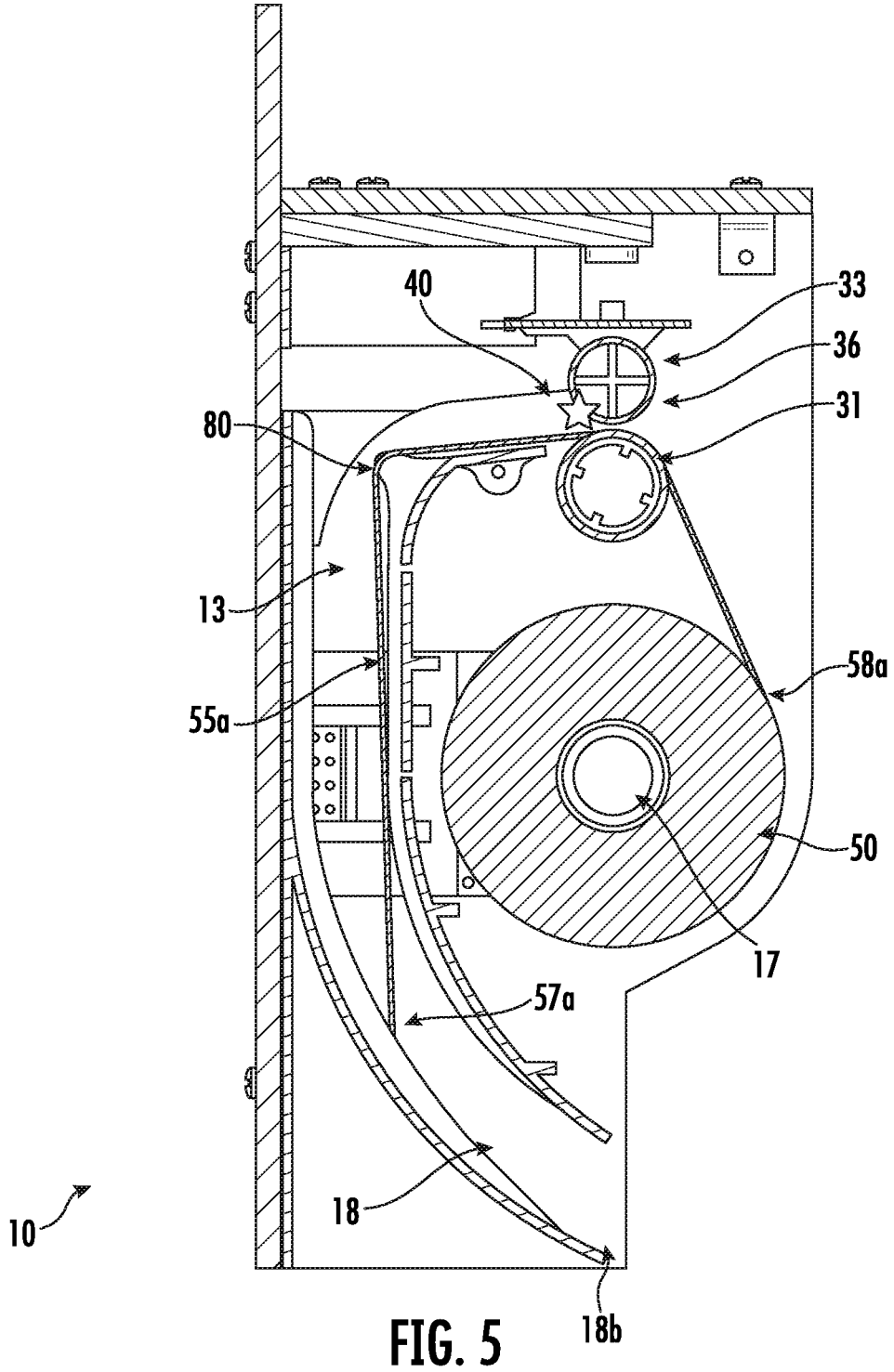
Figure 6:
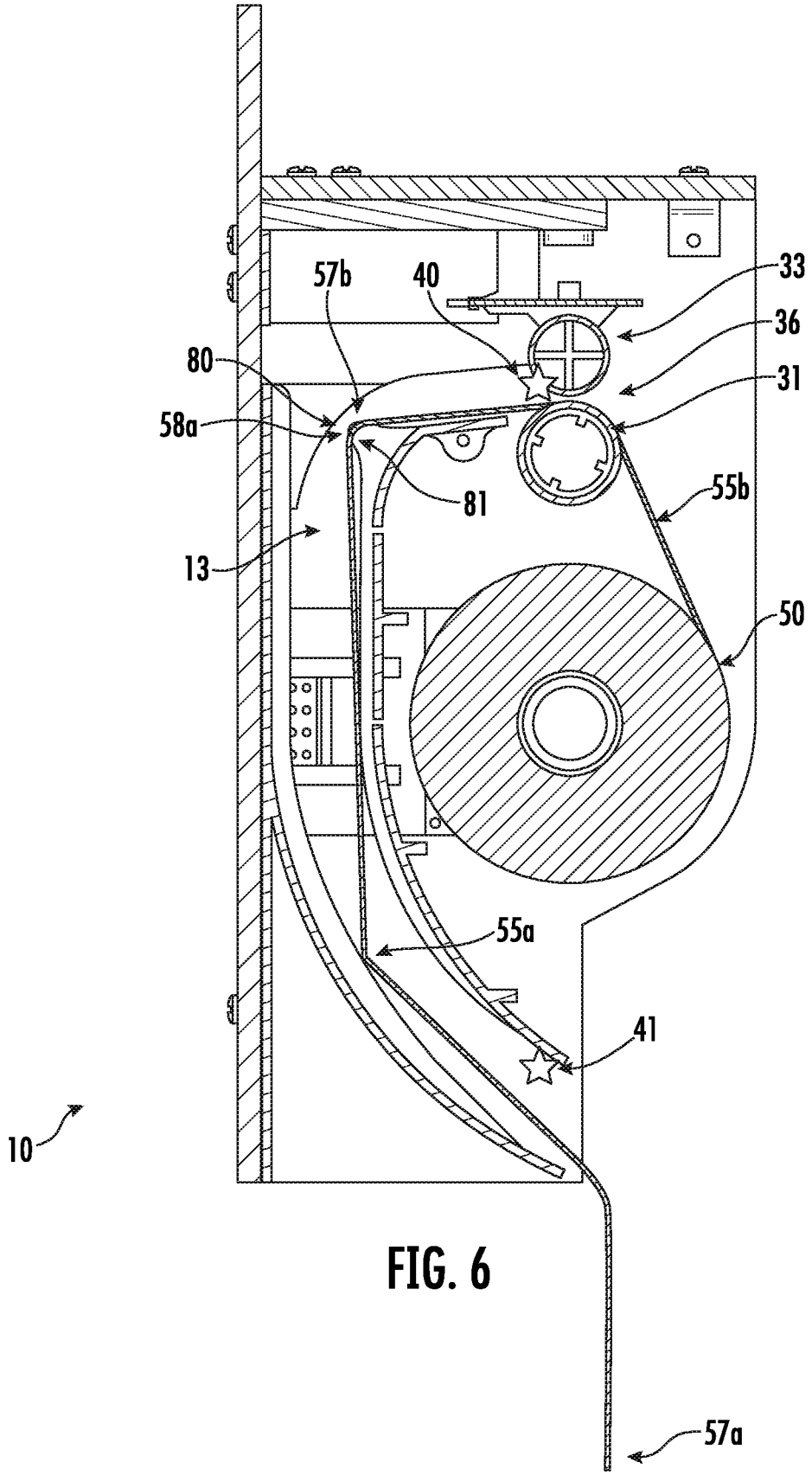
Figure 6A:
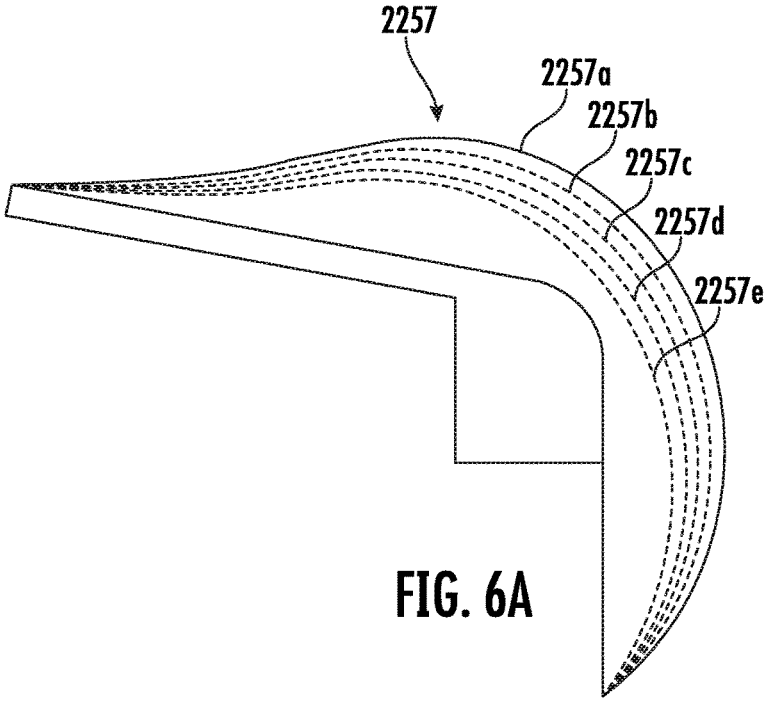
Figure 6B:
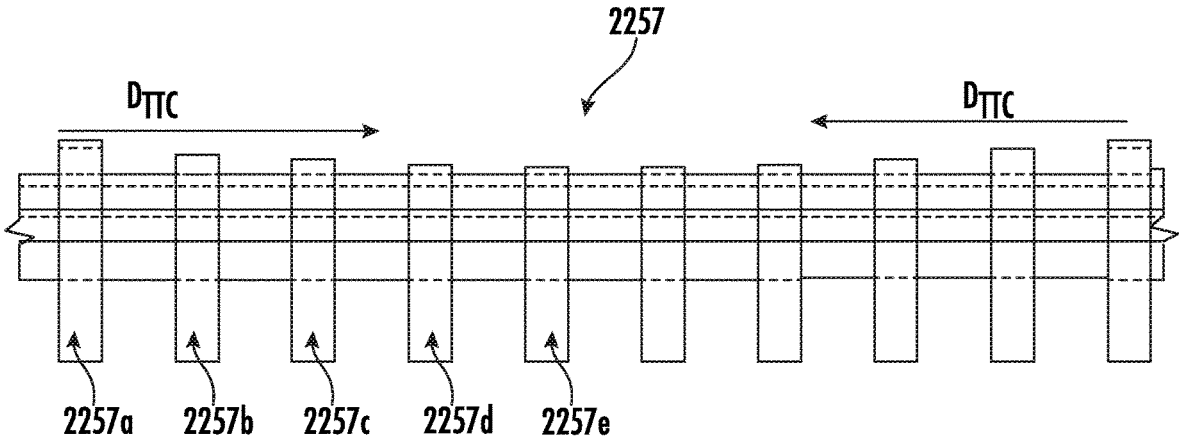
Figure 6C:
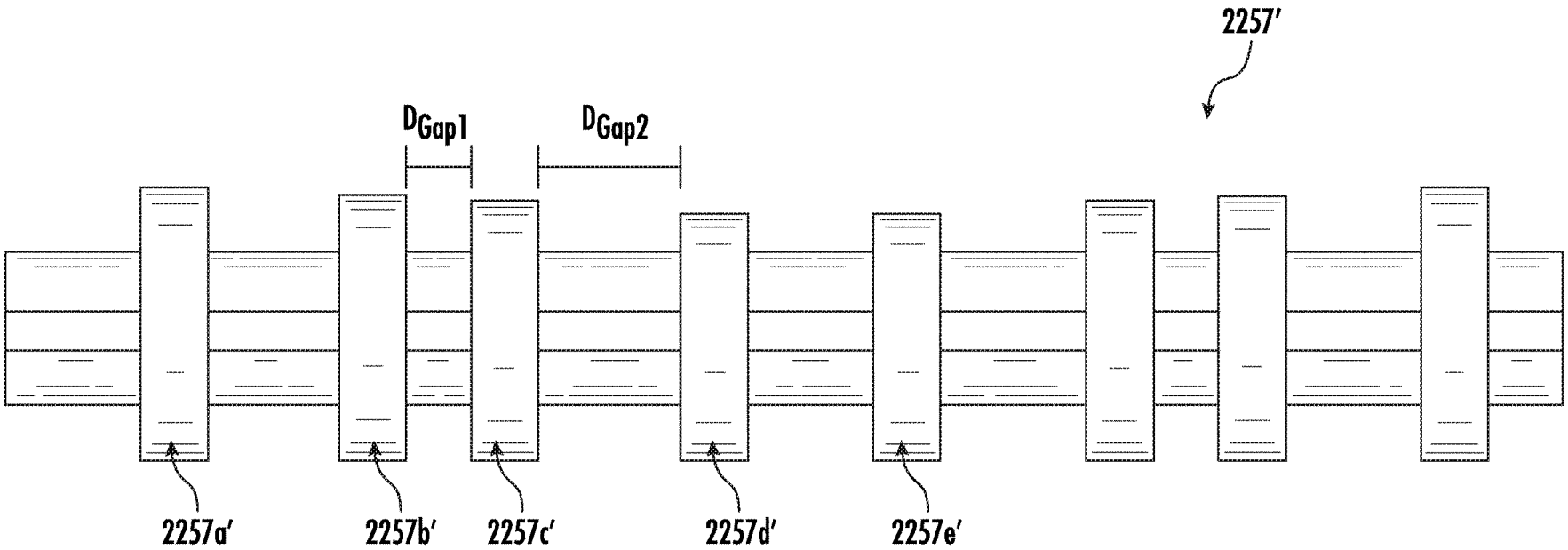
Figure 7:
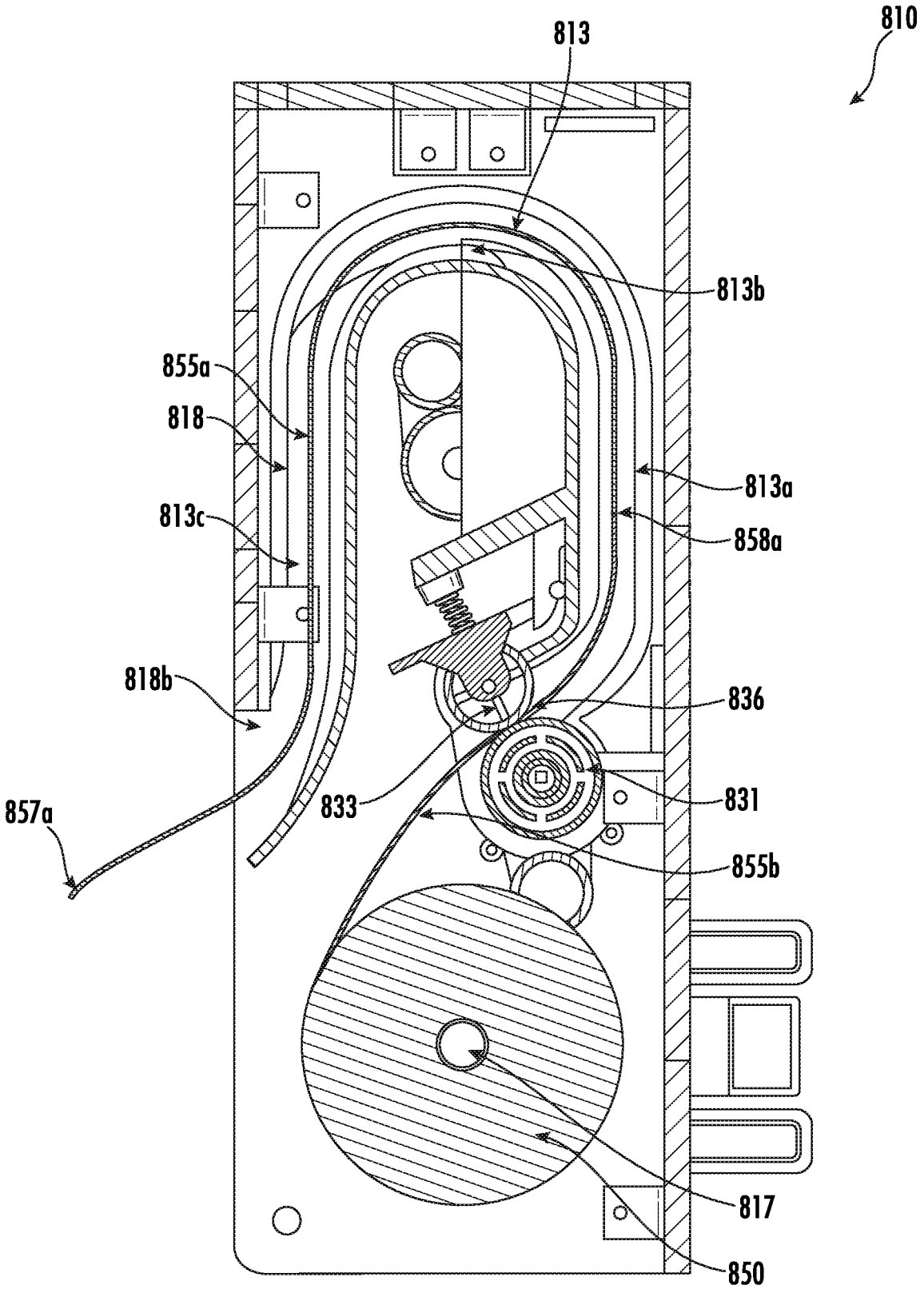
Figure 8:
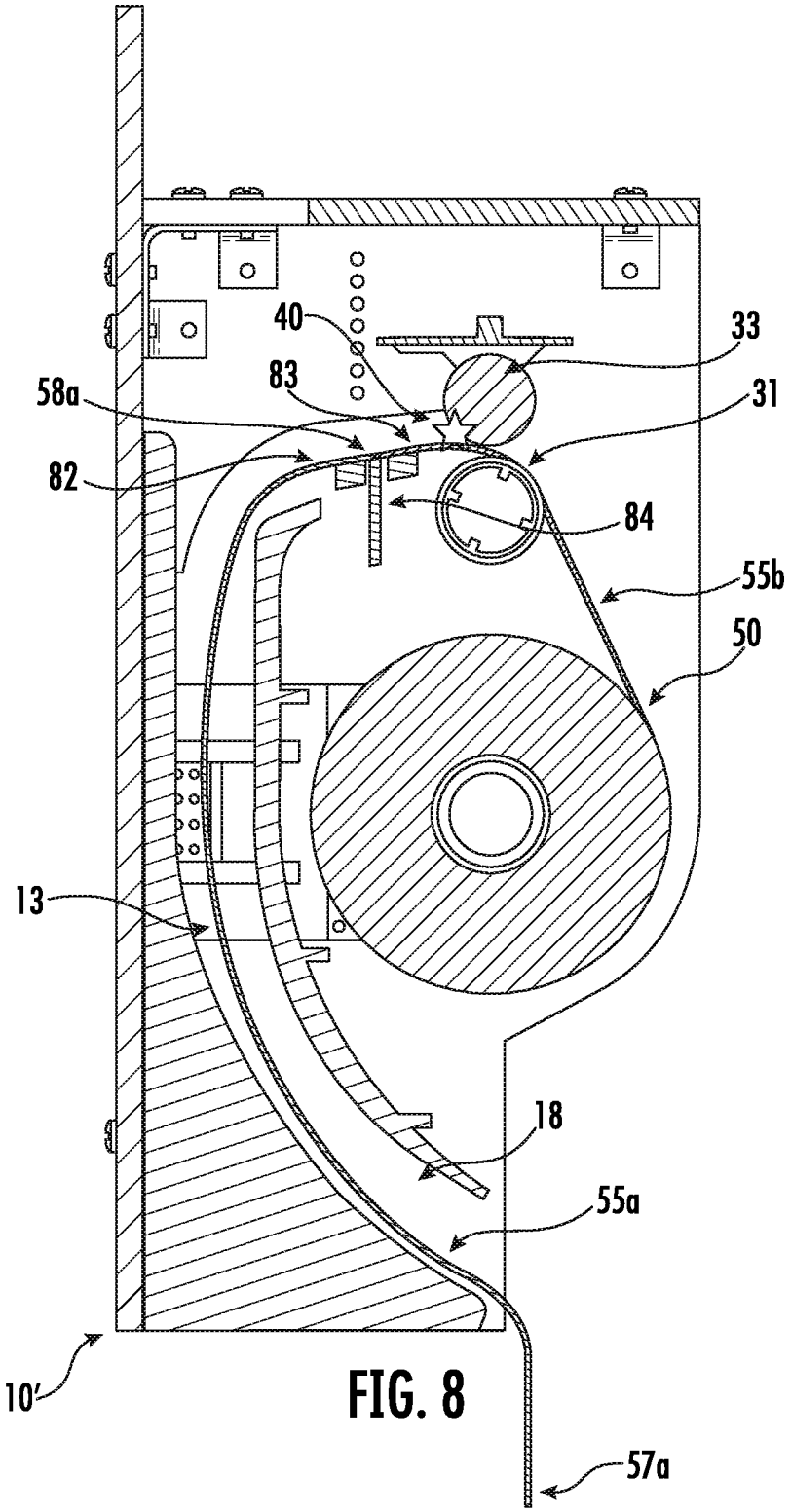
Figure 9:
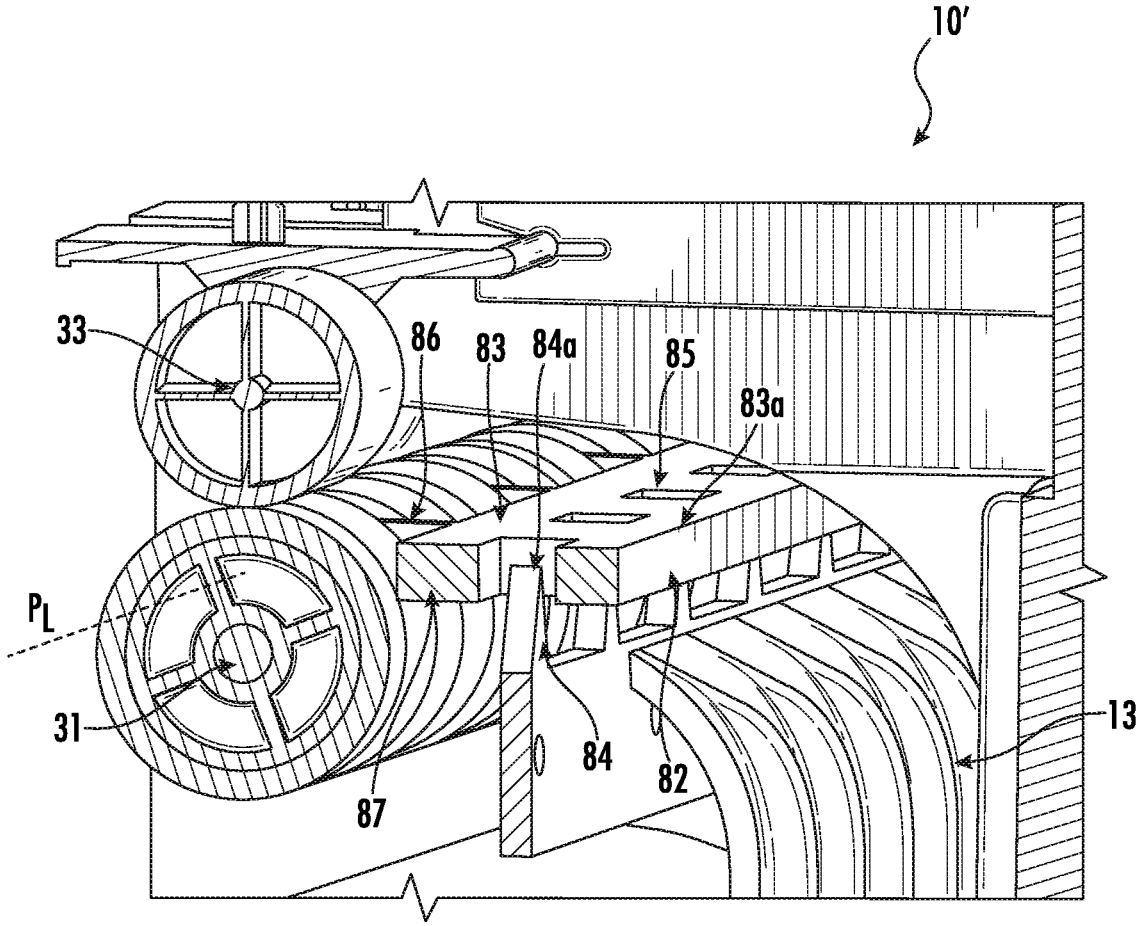
Figure 10:
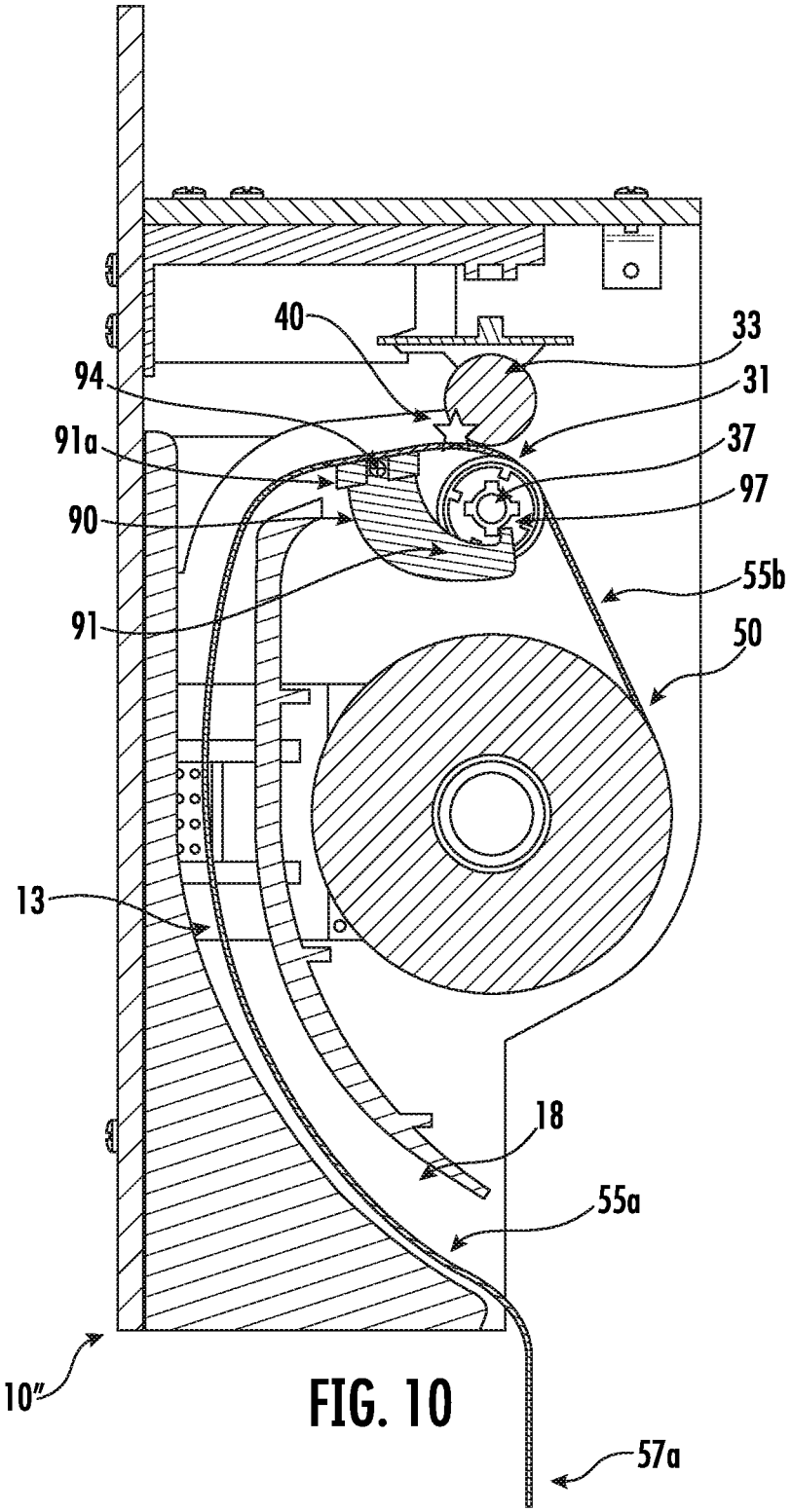
Figure 11A:
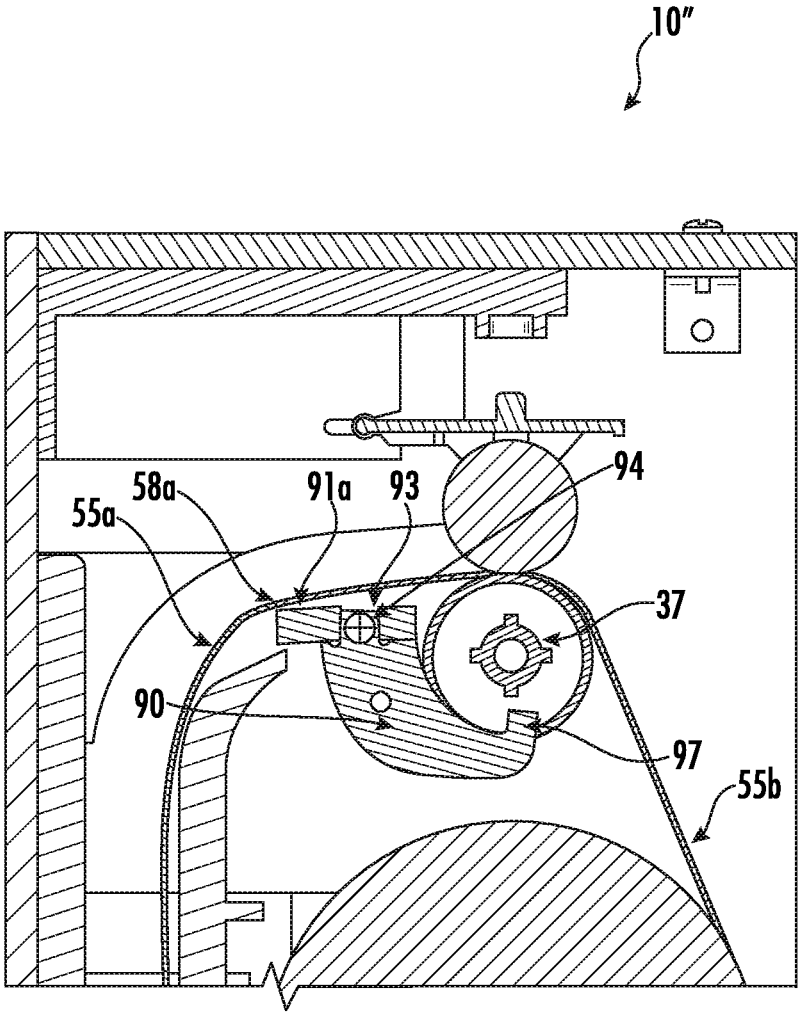
Figure 11B:
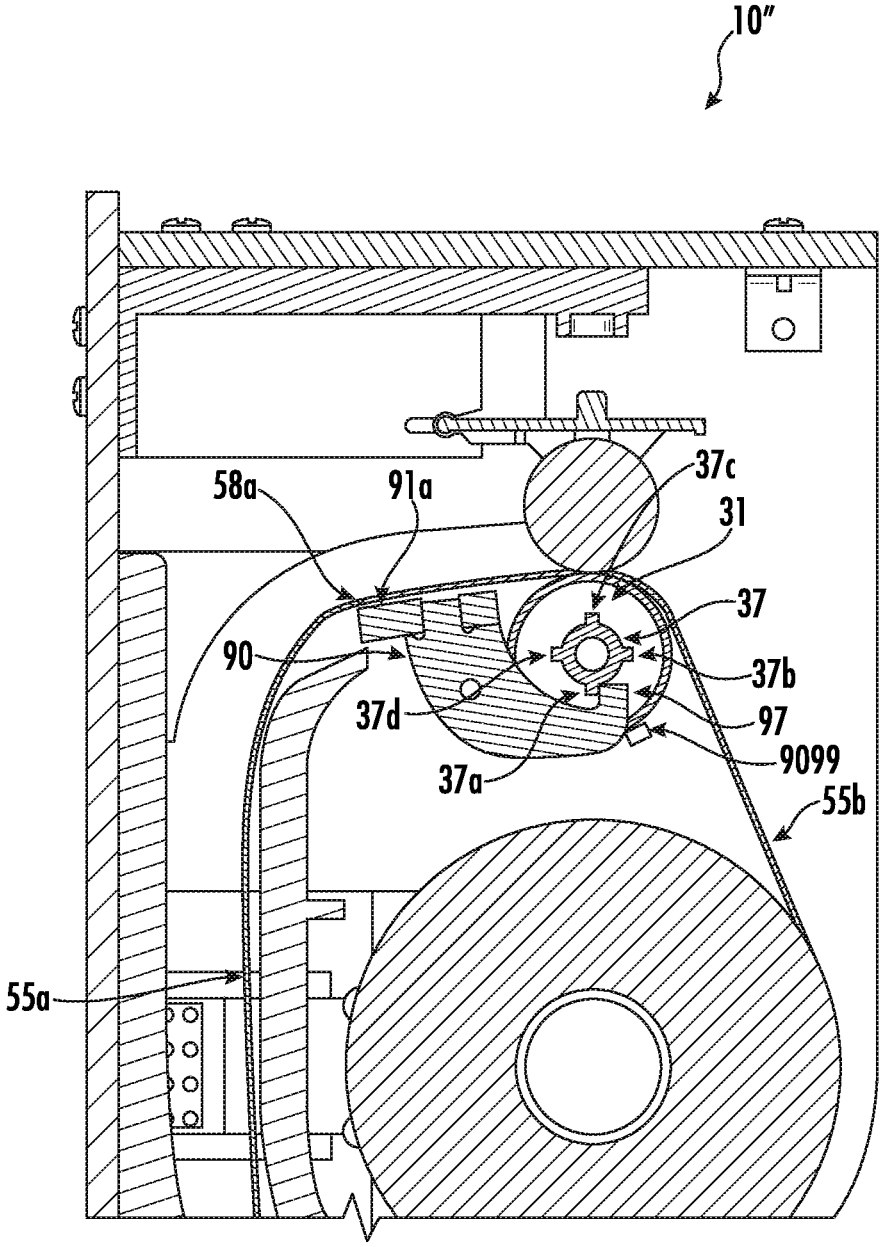
Figure 12:
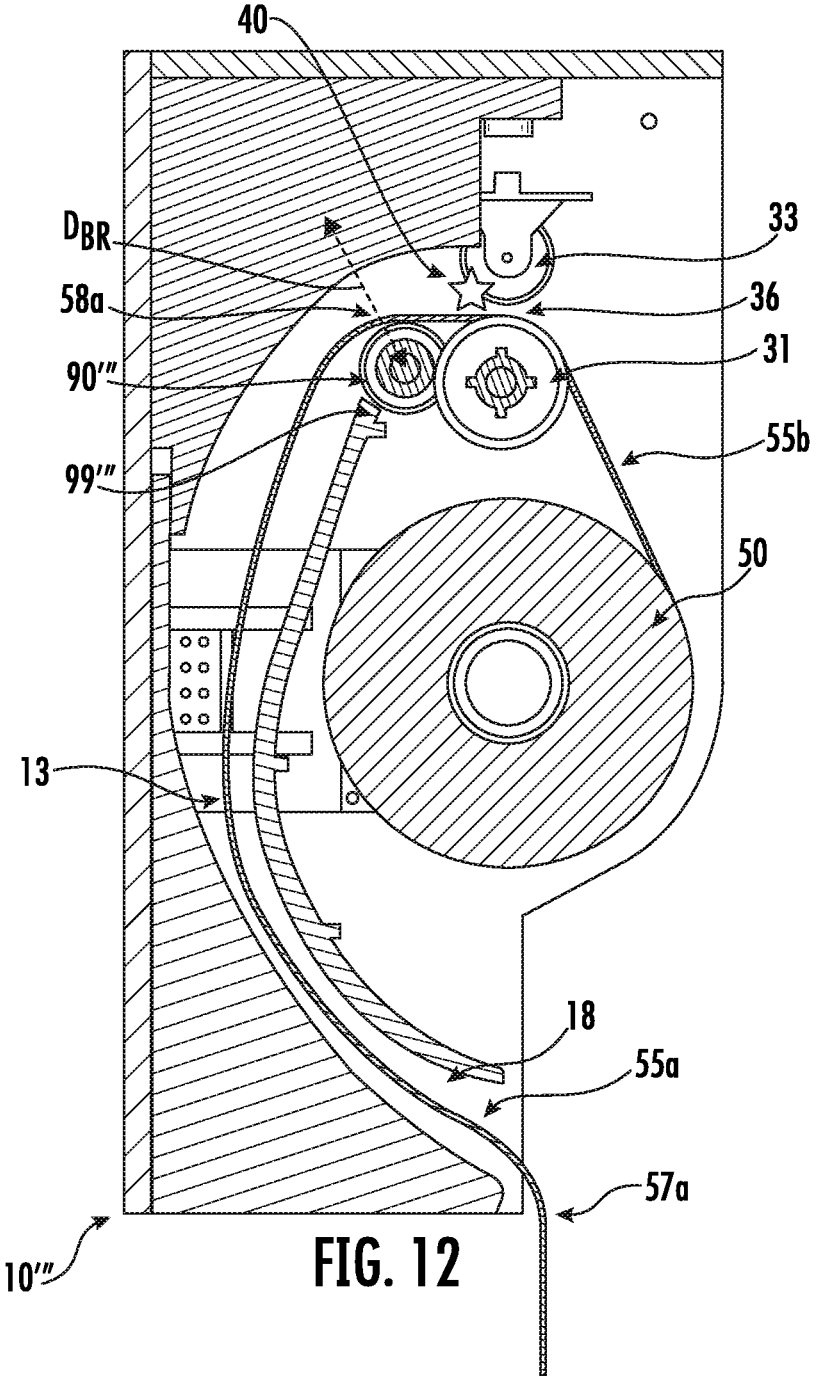
Figure 12A:
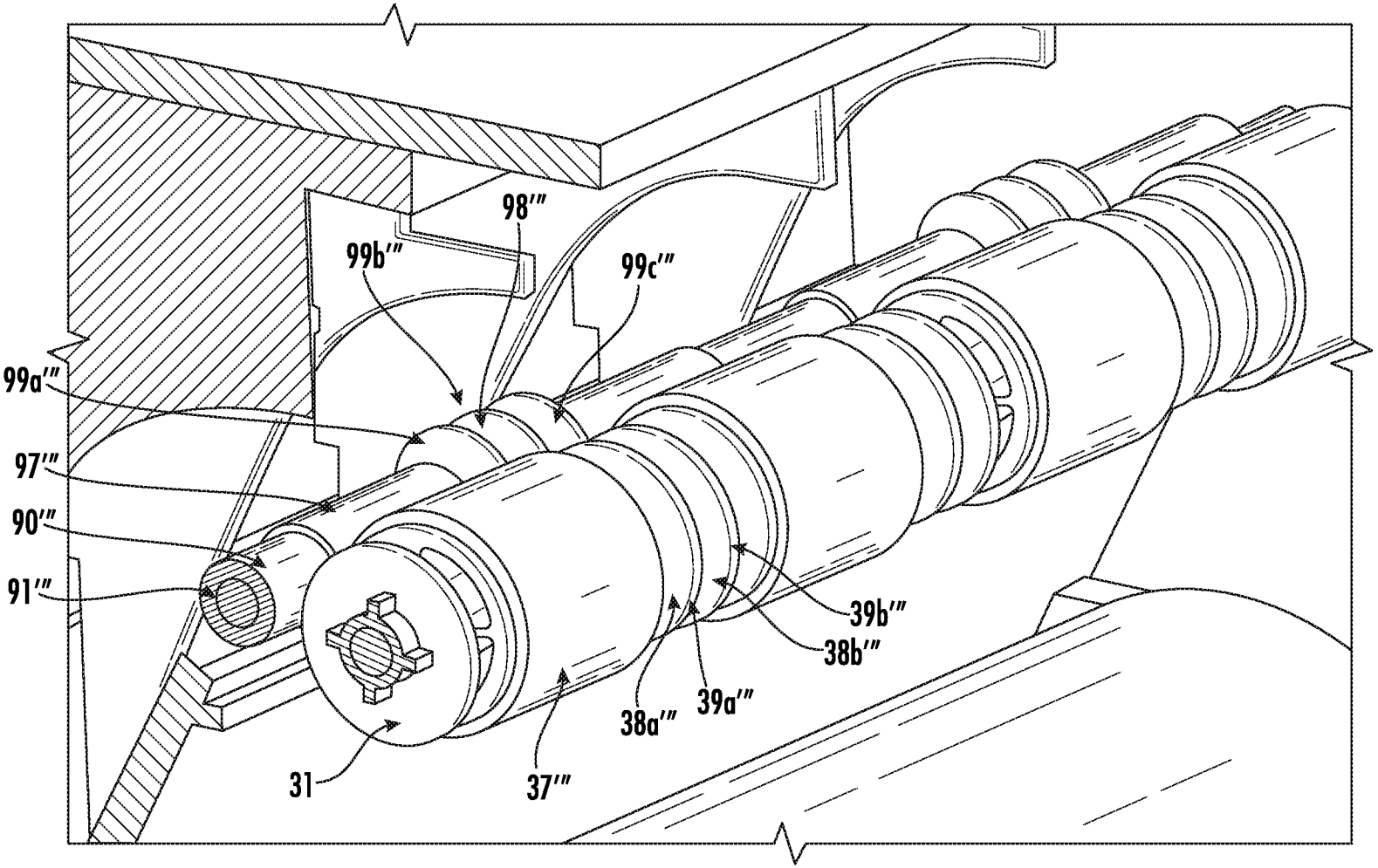
Figure 13:
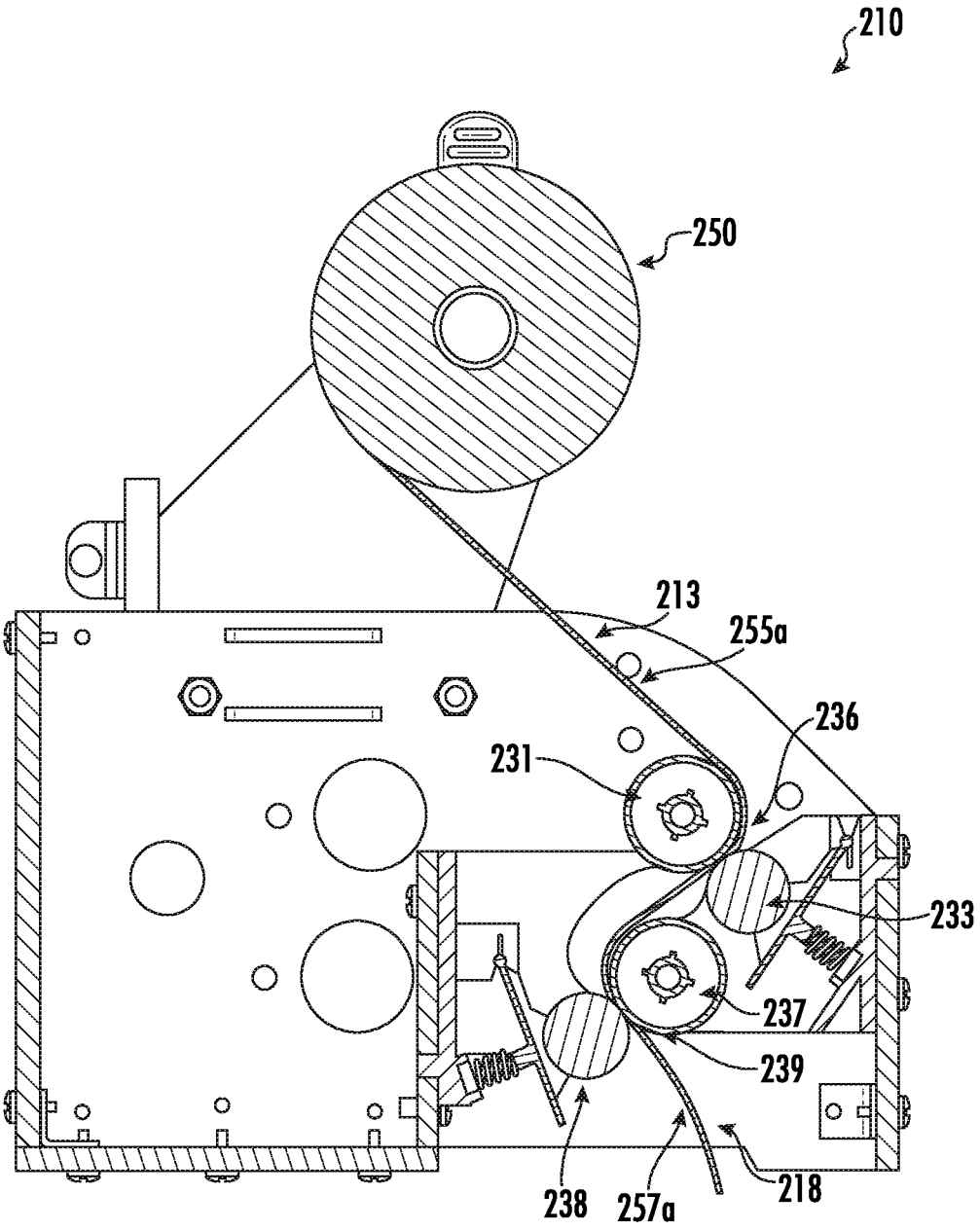
Figure 14:
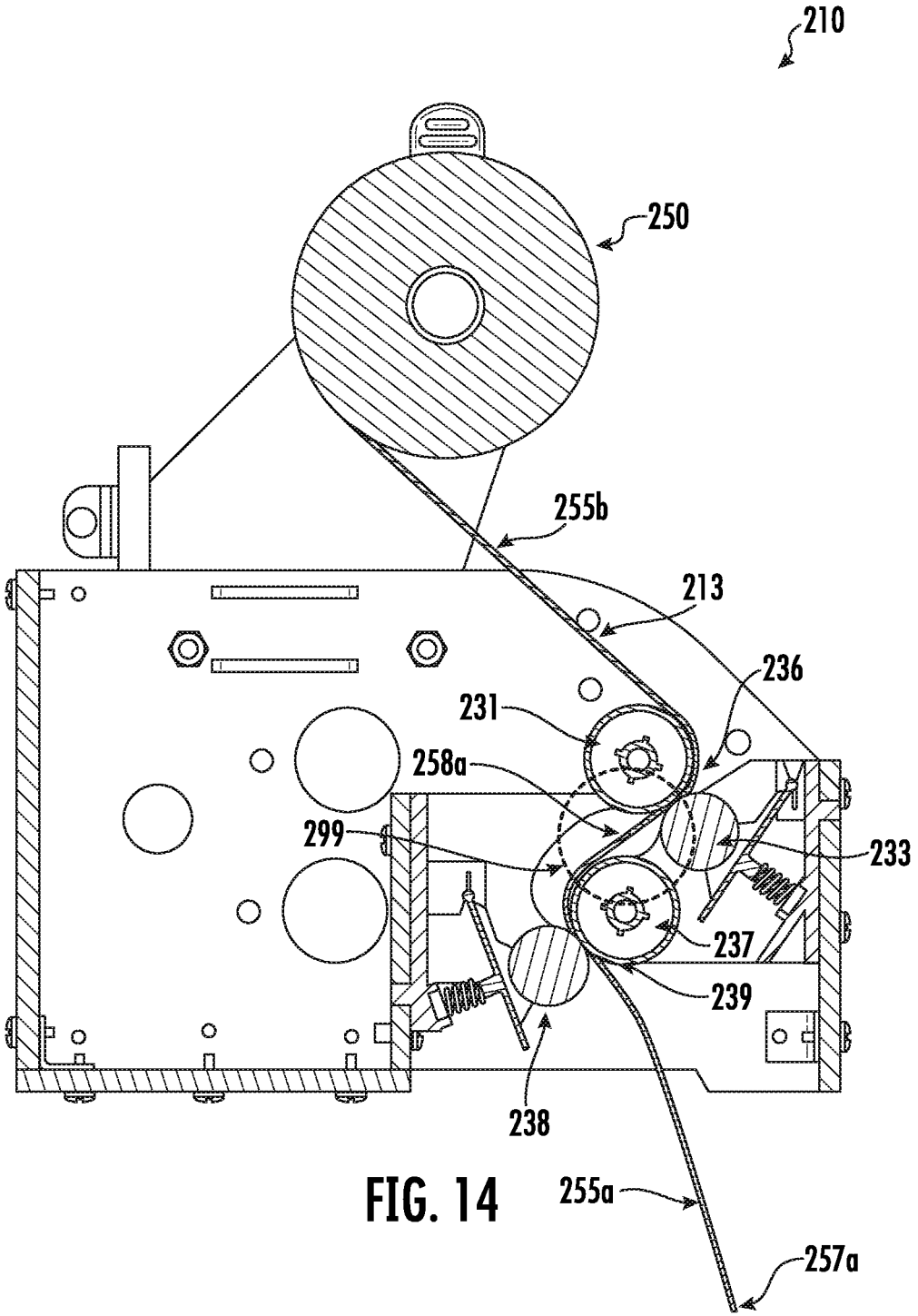
Figure 15:
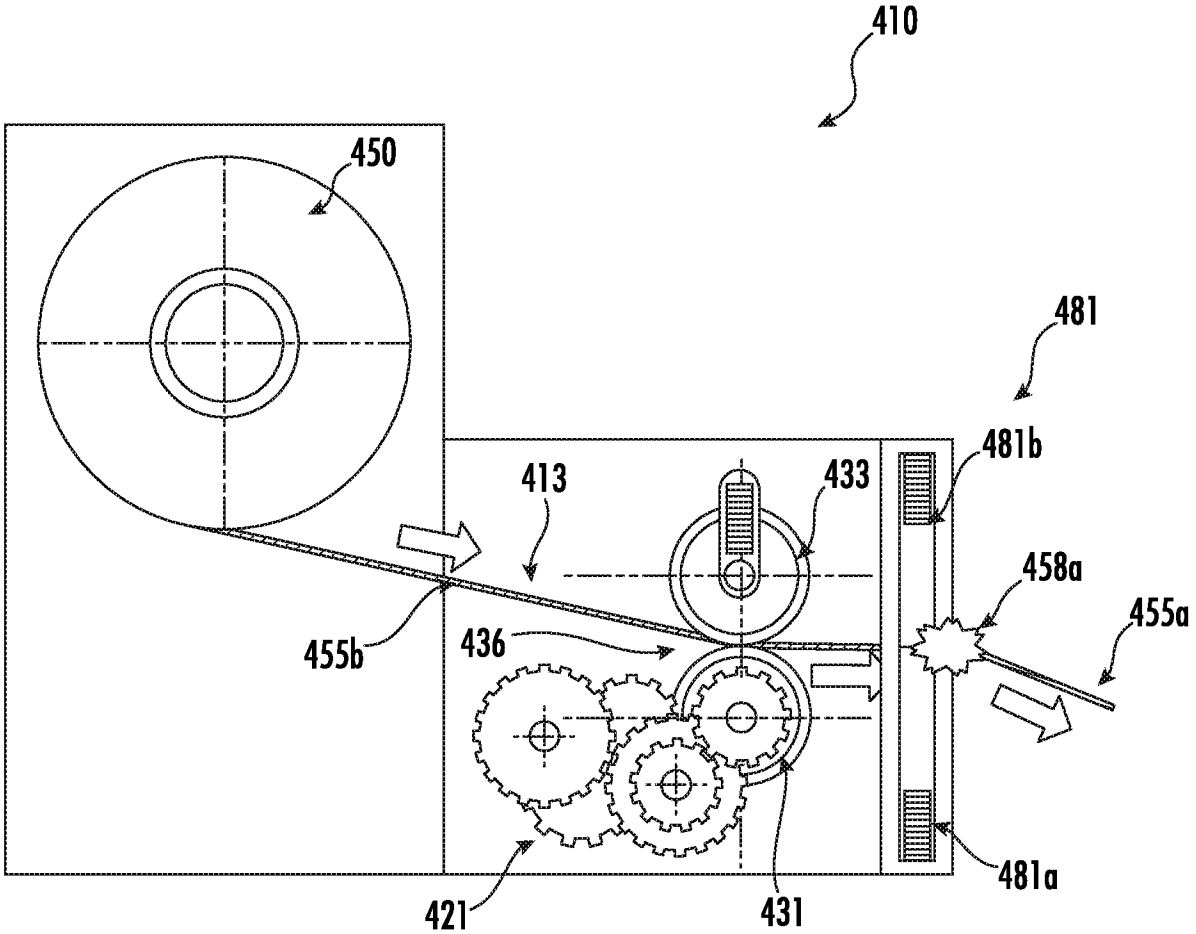
Figure 16:
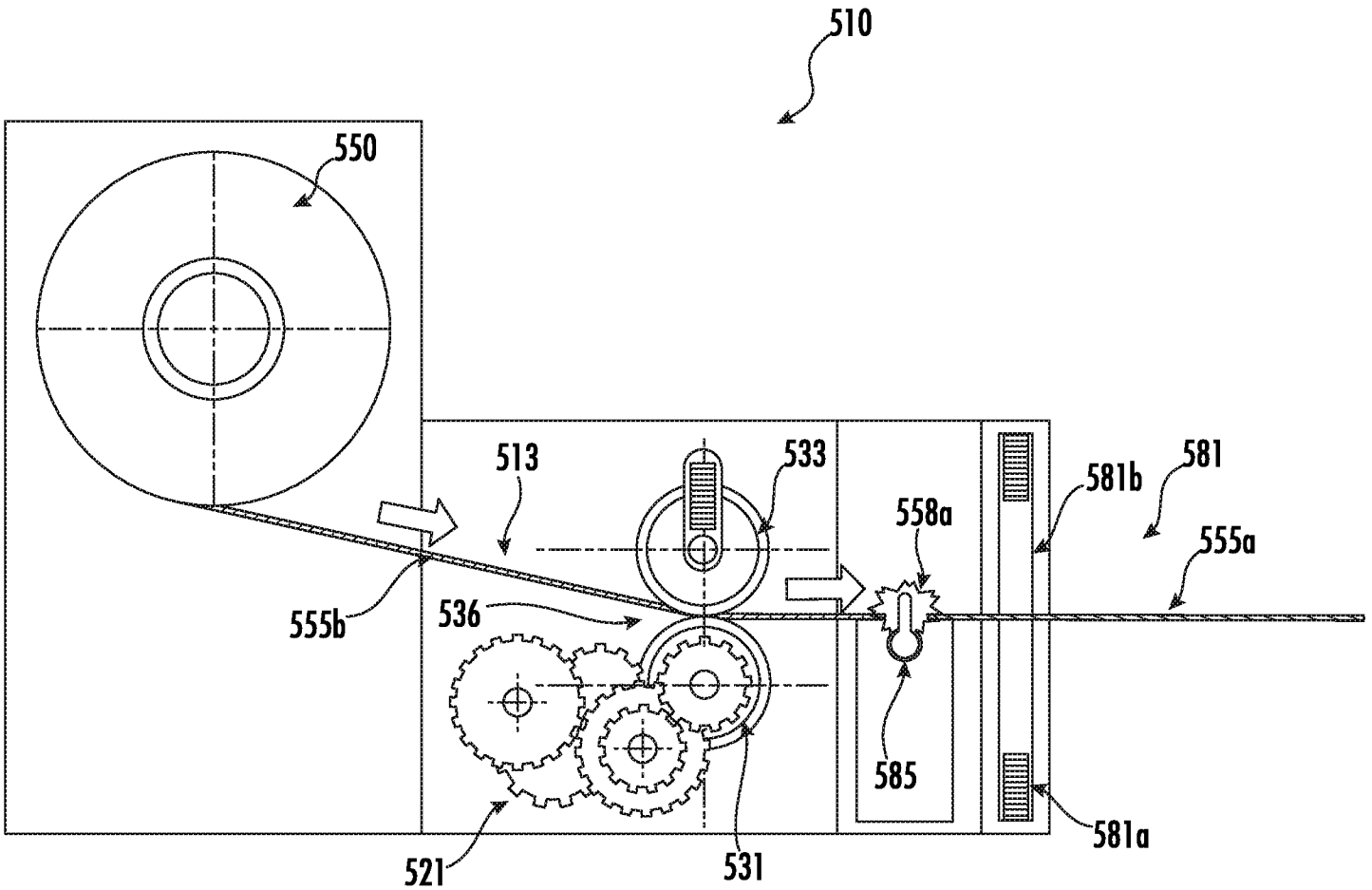
Figure 17:
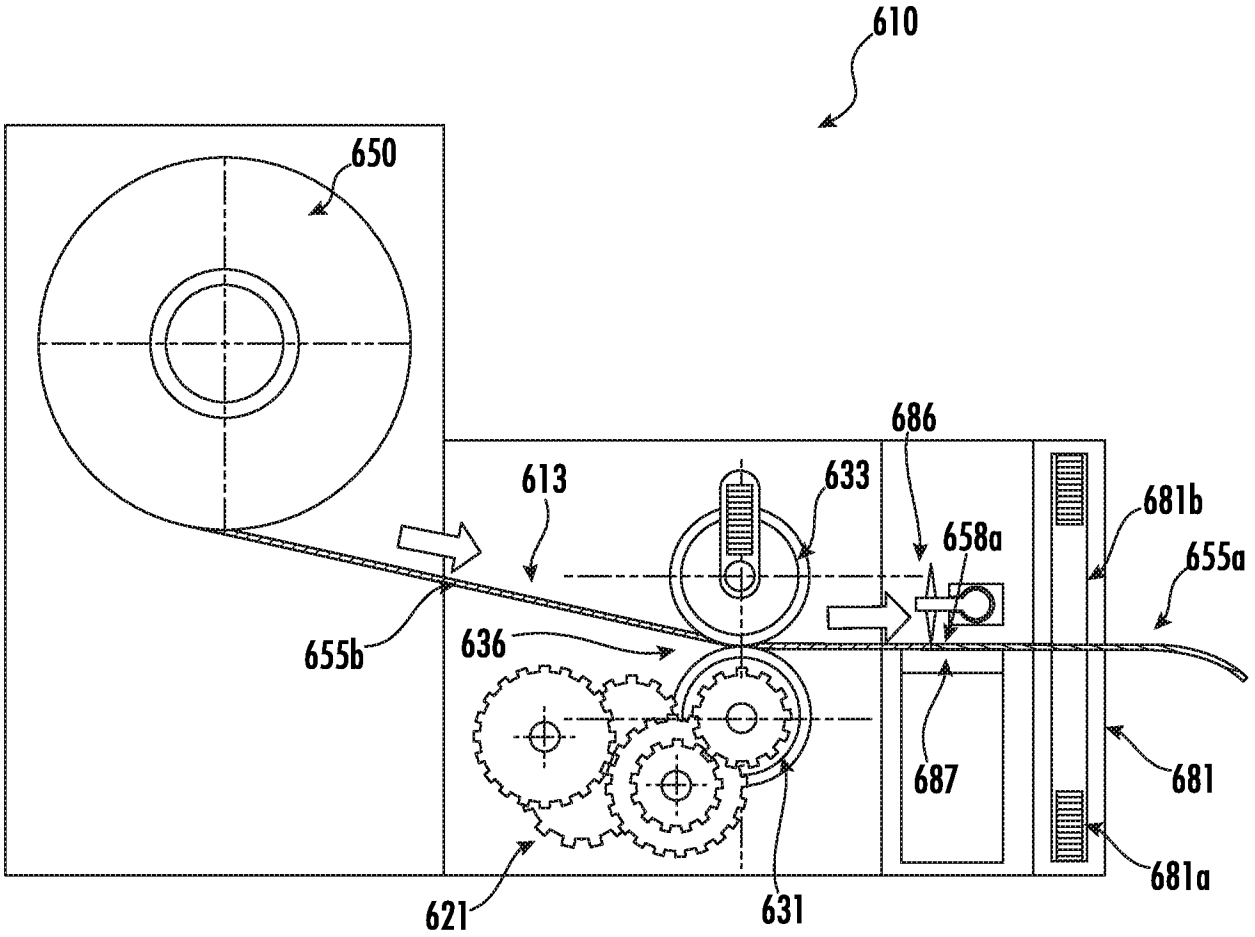
Figure 18:
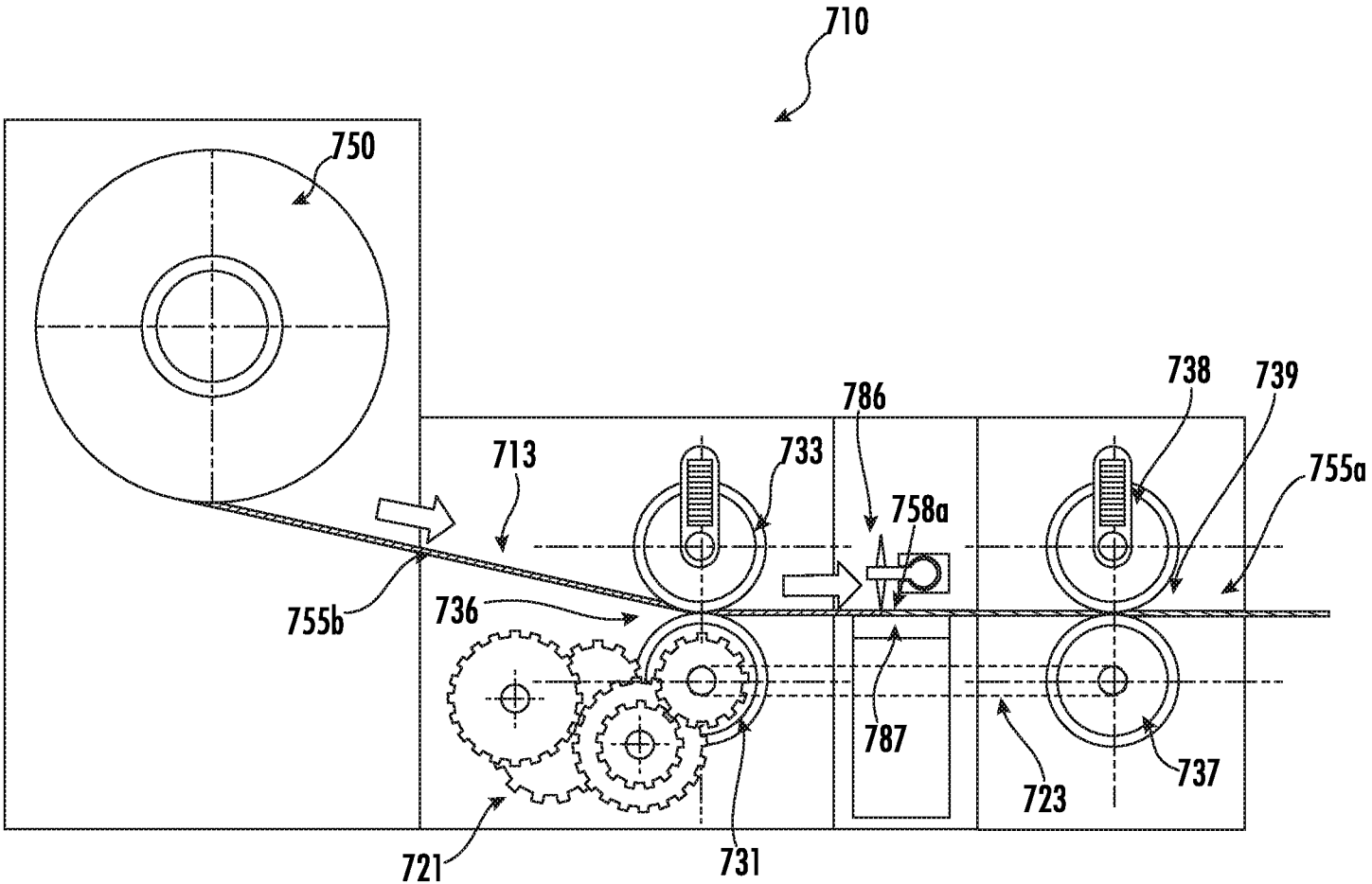
Figure 19:
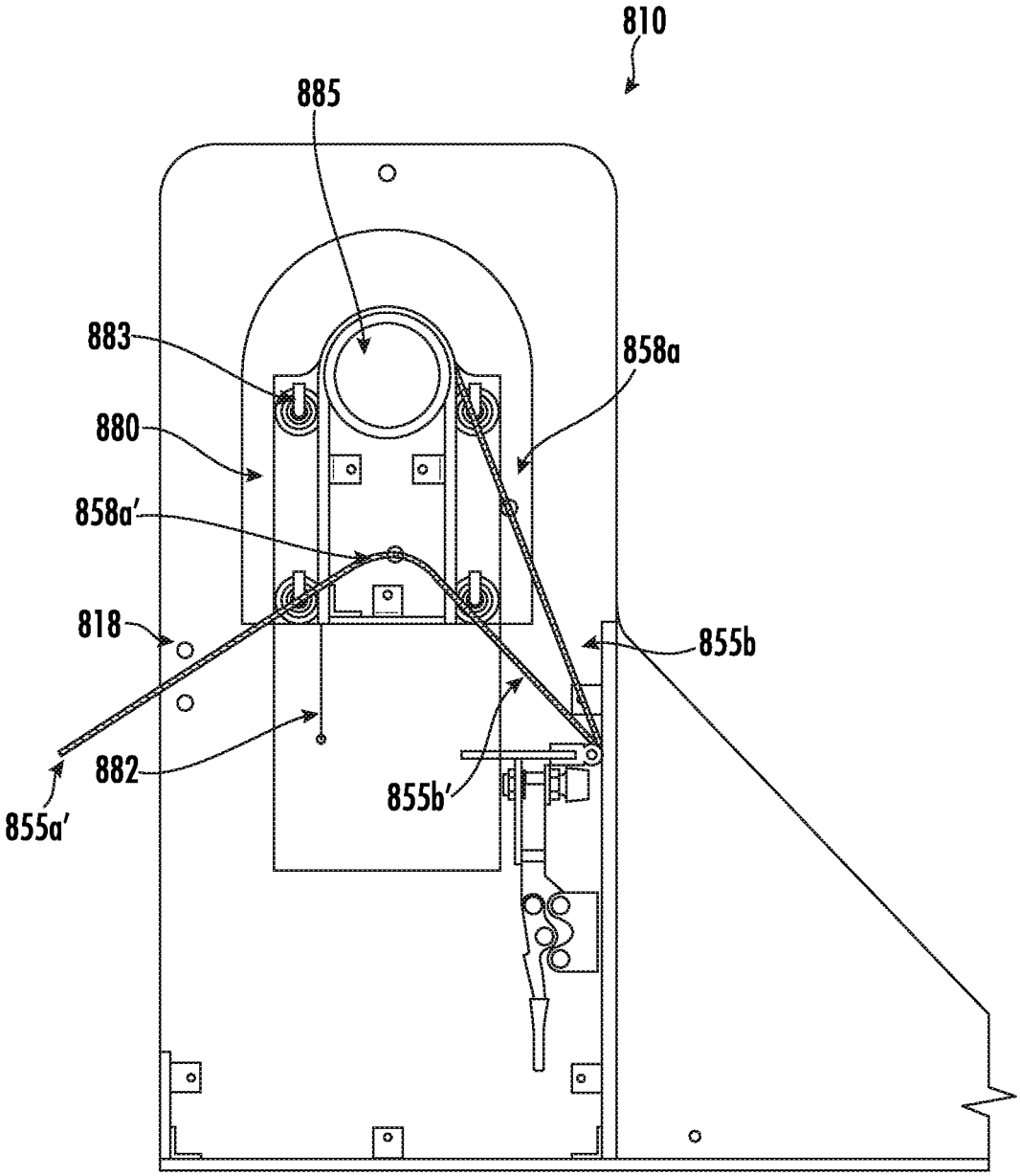
Figure 20A:
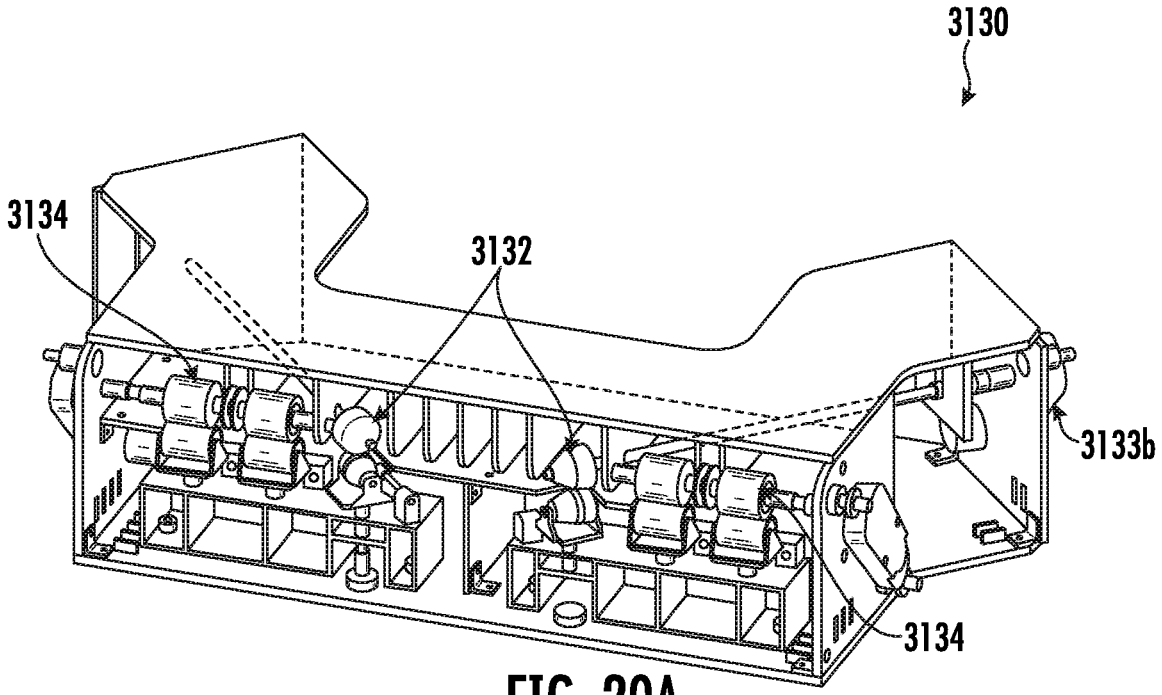
Figure 20B:
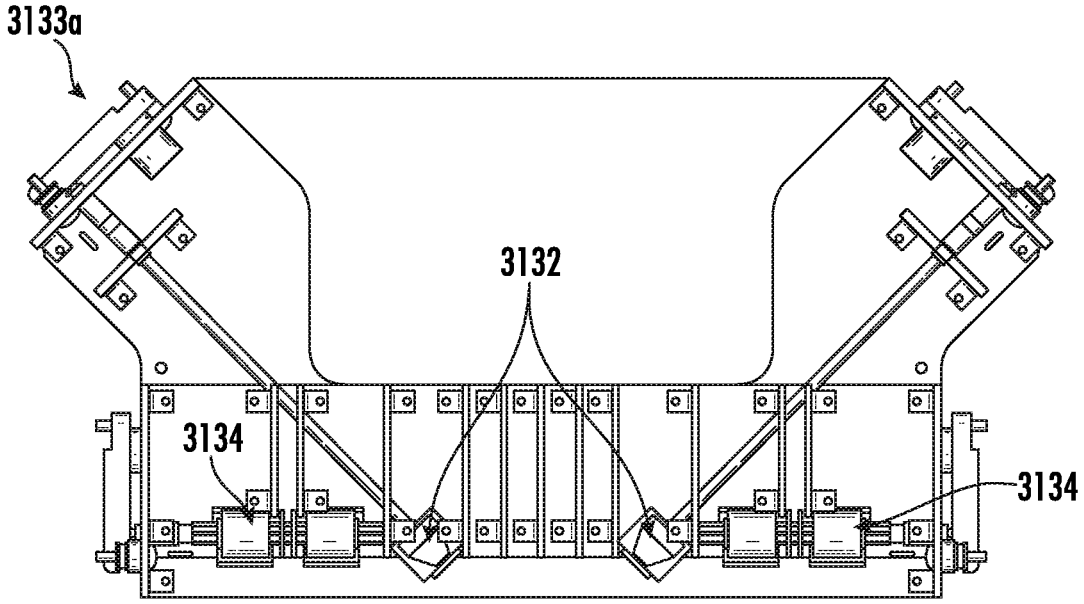
Figure 21A:
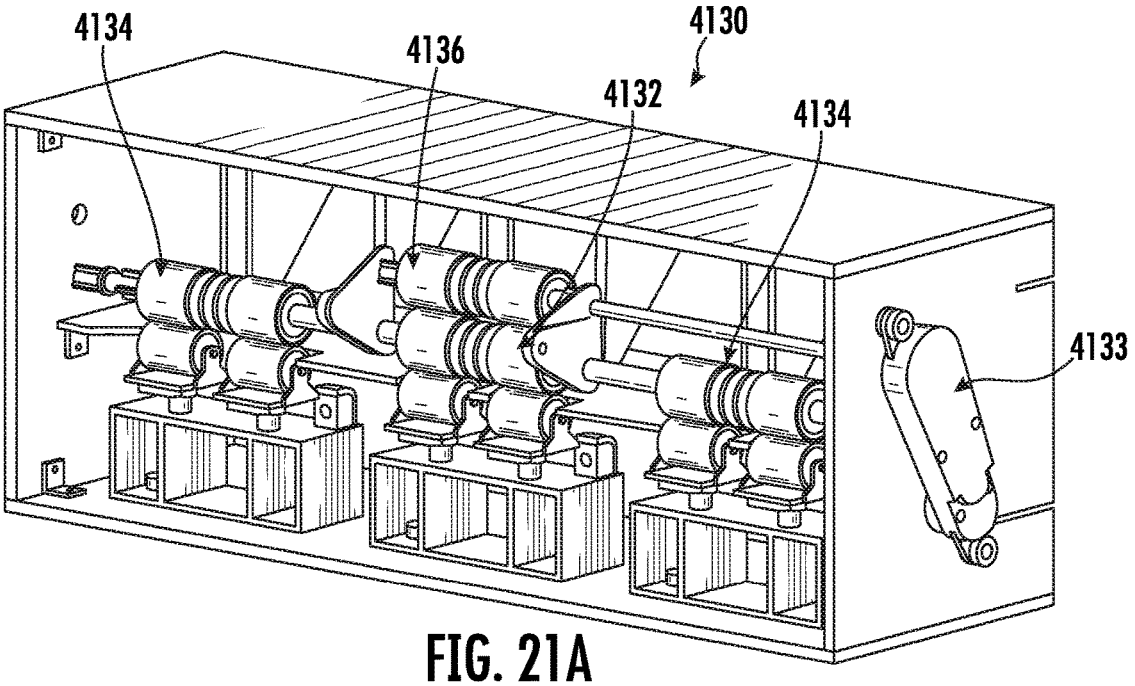
Figure 21B:
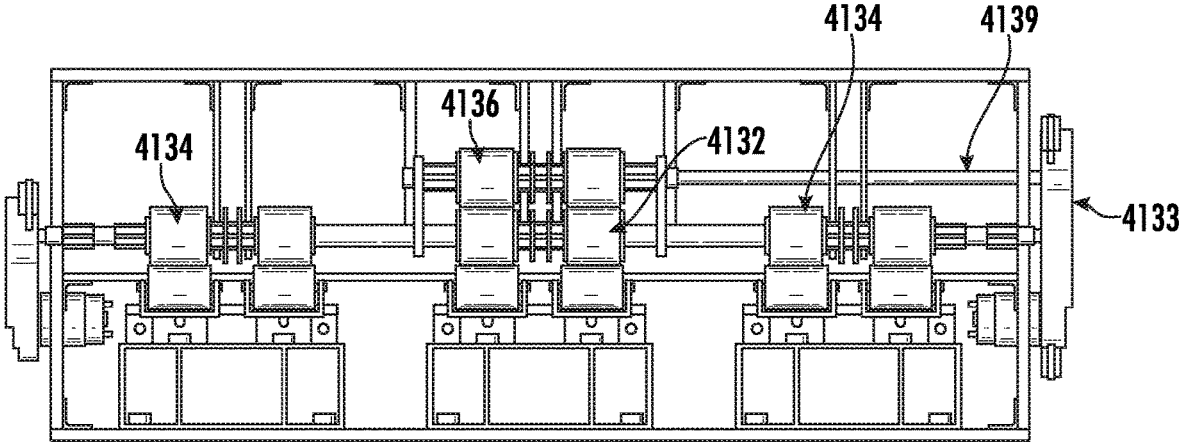
Figure 22:
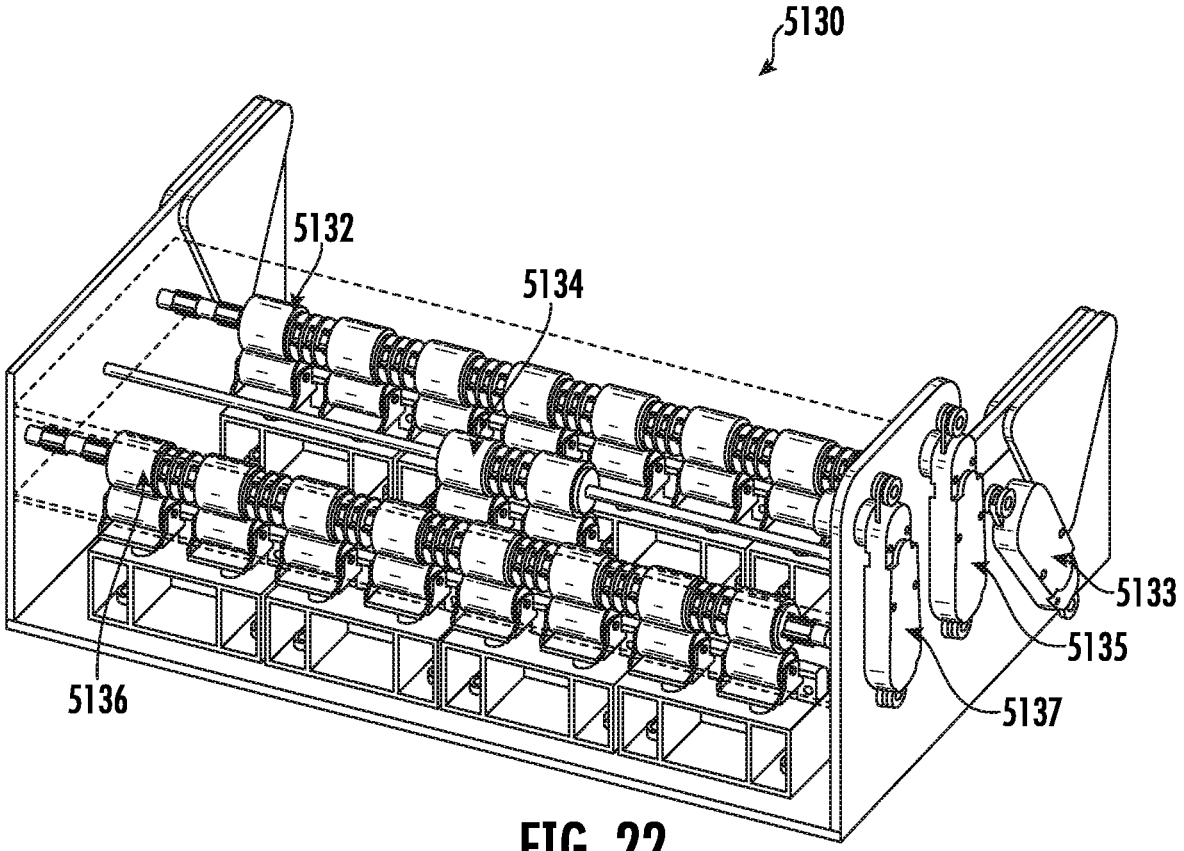
Figure 23:
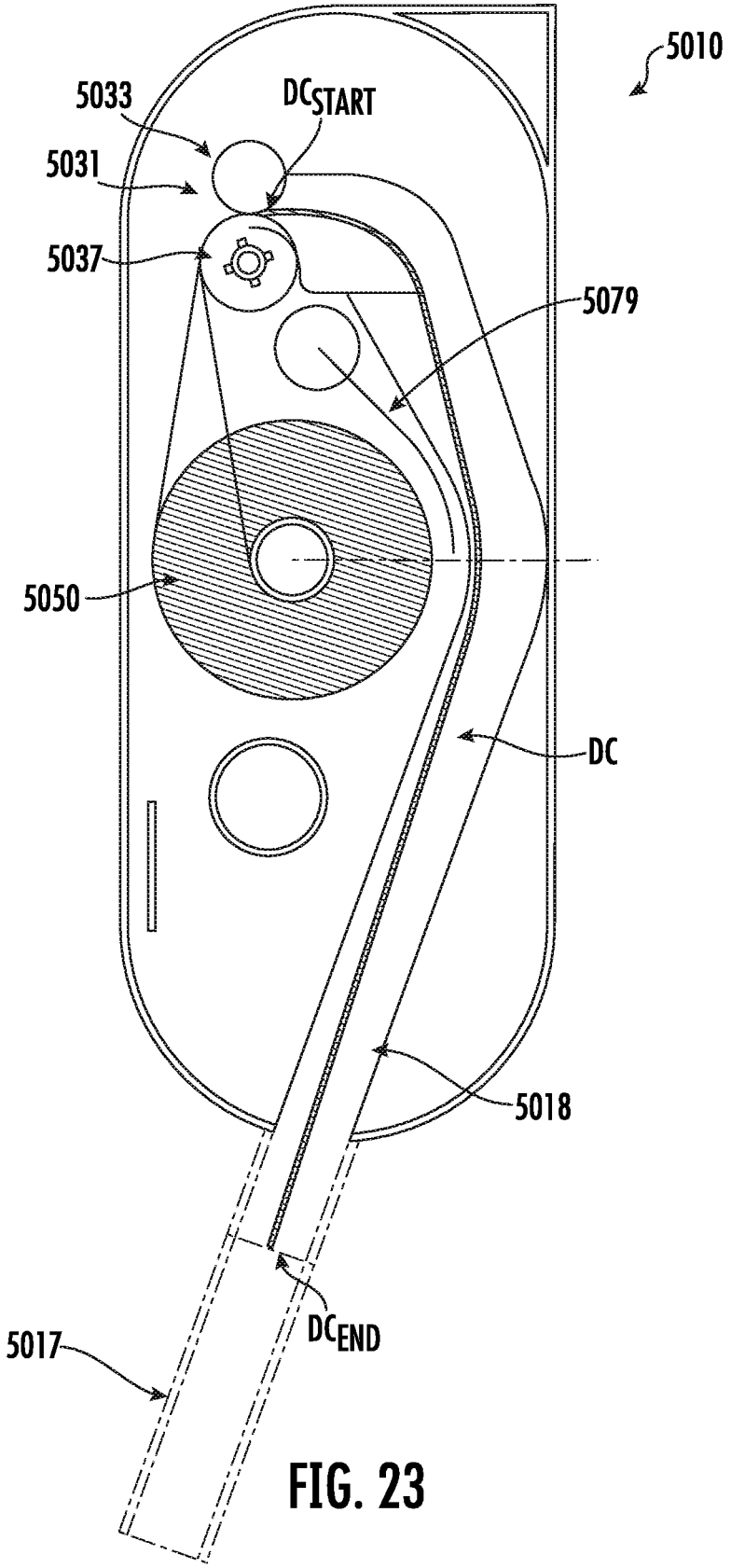
Figure 24A:
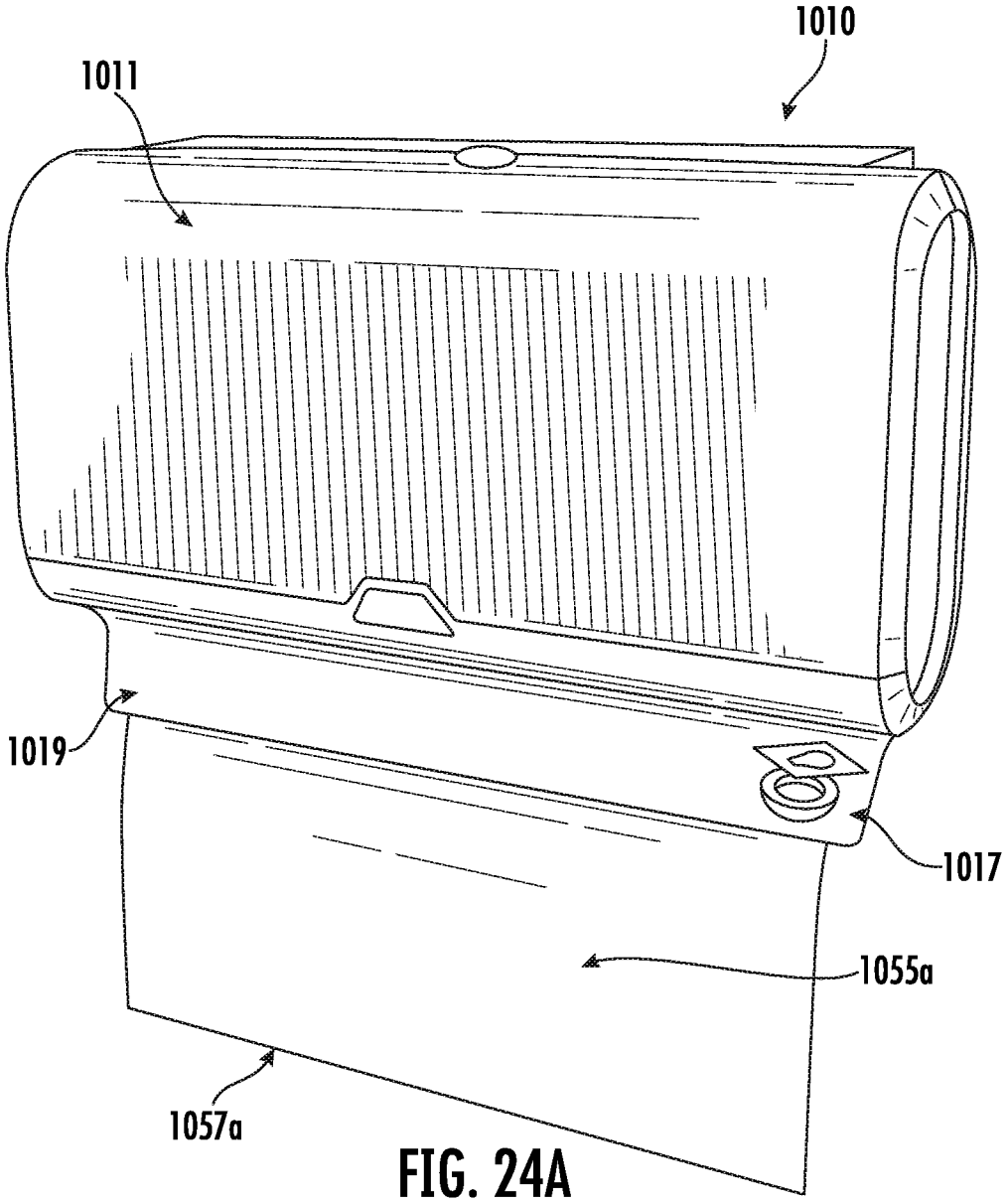
Figure 24B:
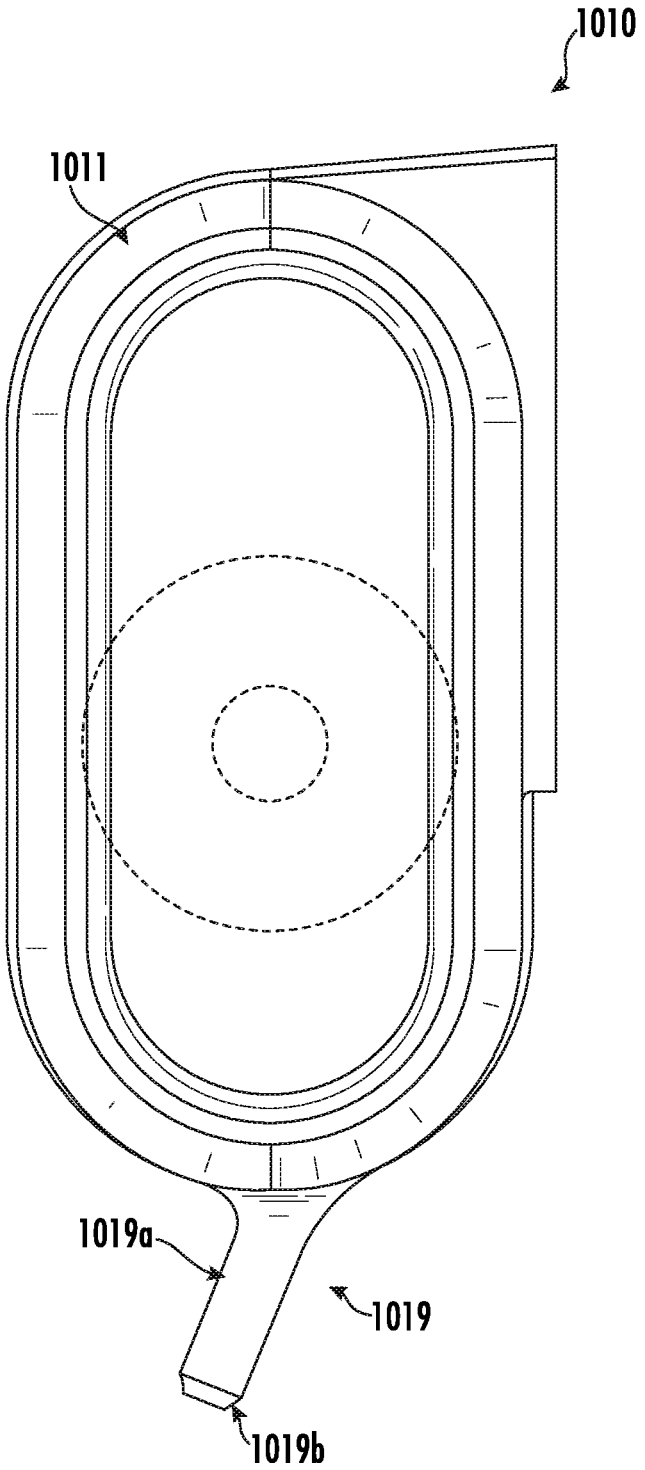
Figure 25A:
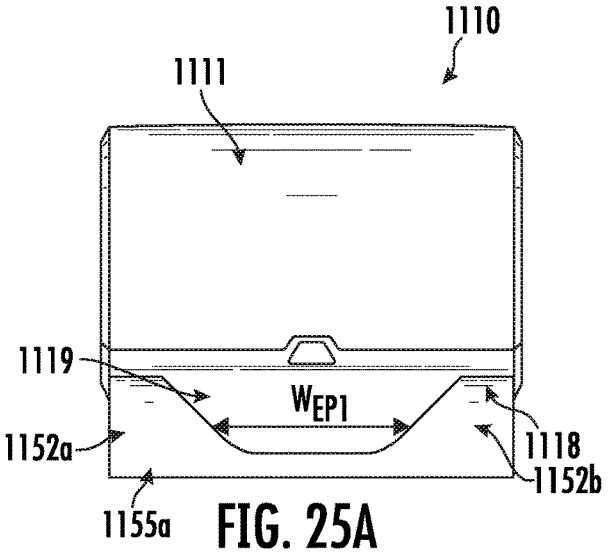
Figure 25B:
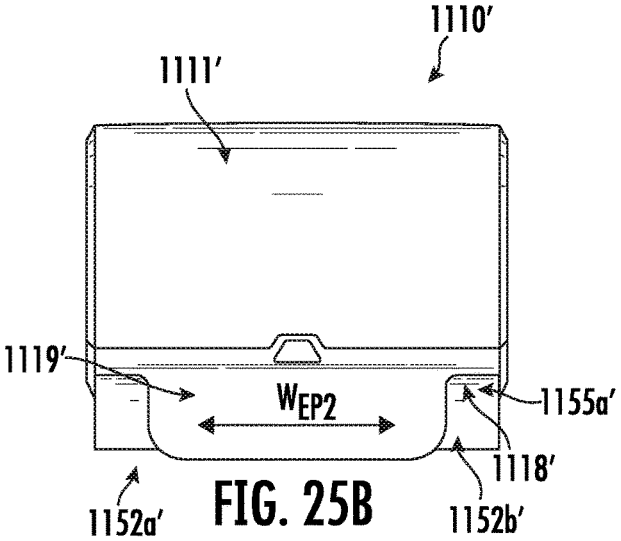
Figure 25C:
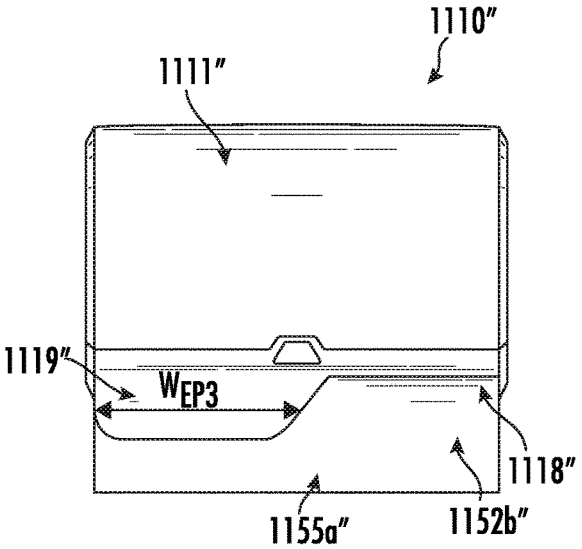
Figure 26A:
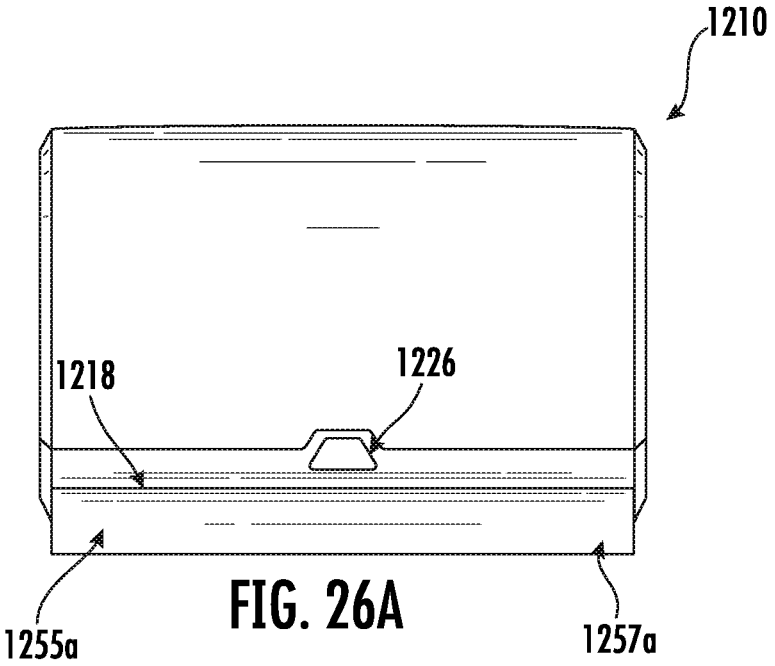
Figure 26B:
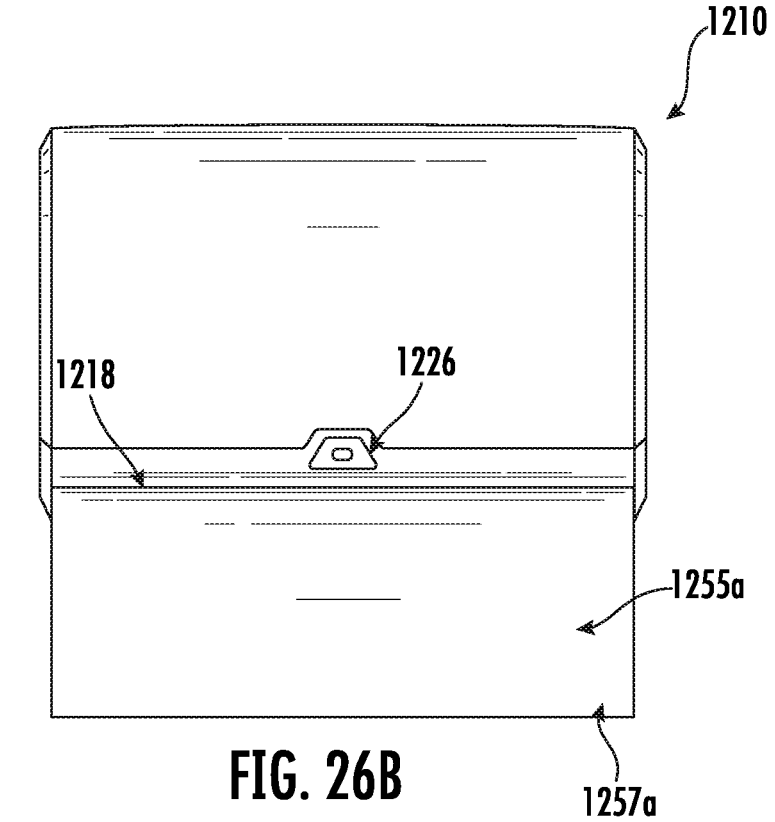
Figure 27A:
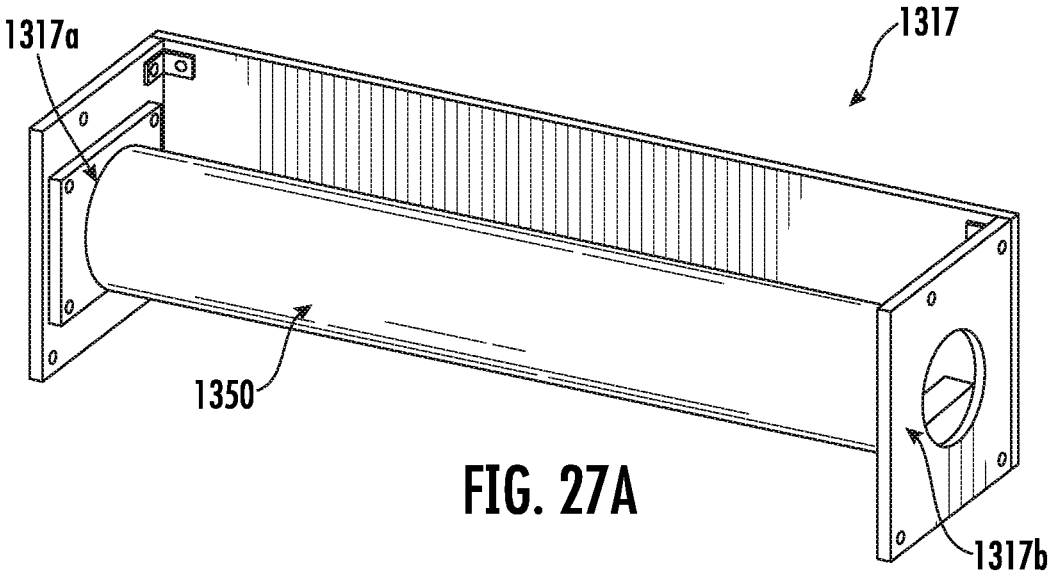
Figure 27B:
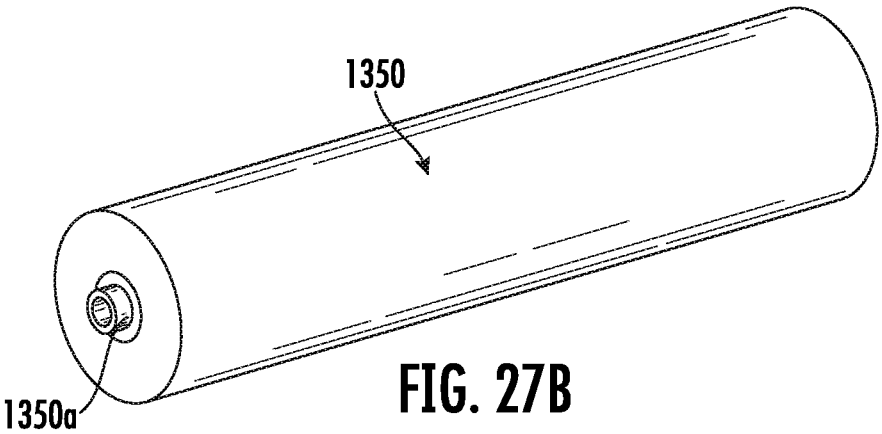
Figure 27C:
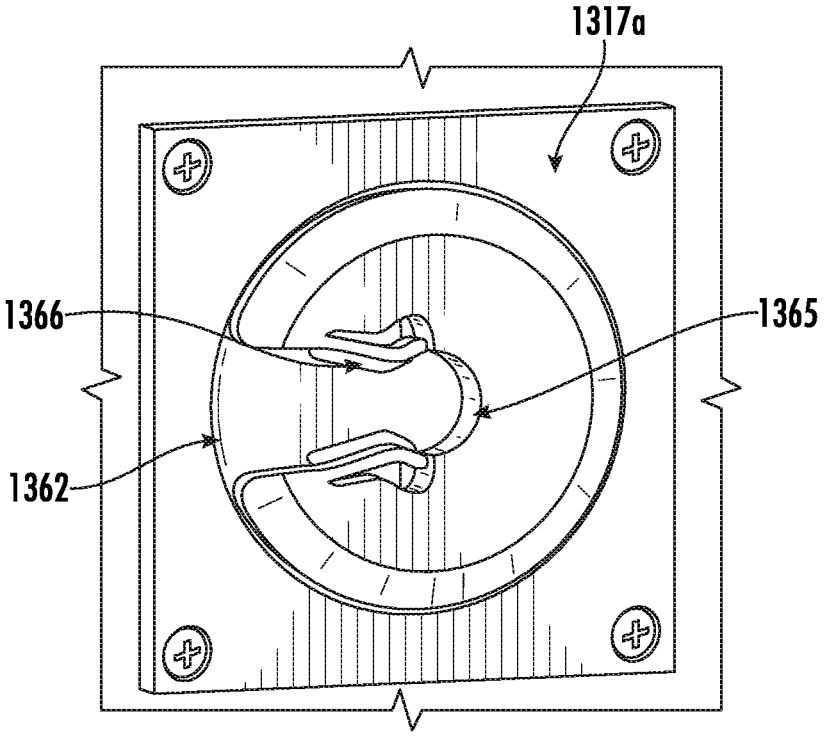
Figure 27D:
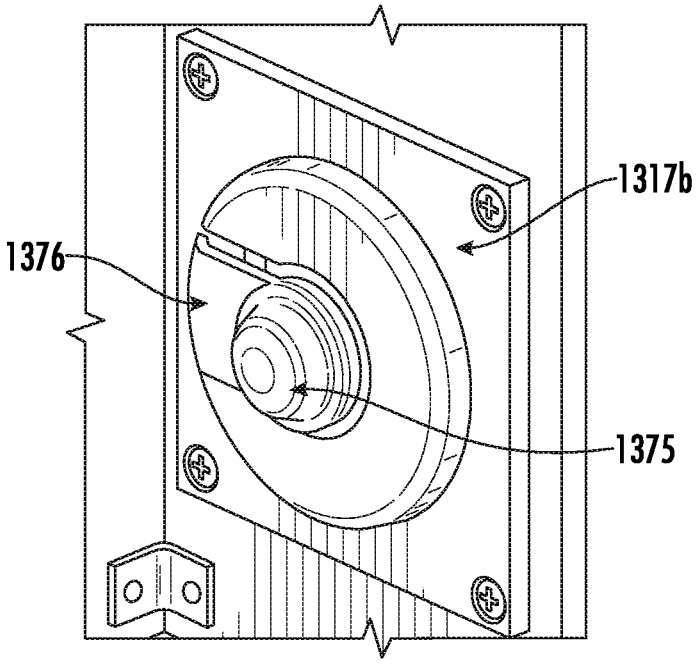
Figure 28A:
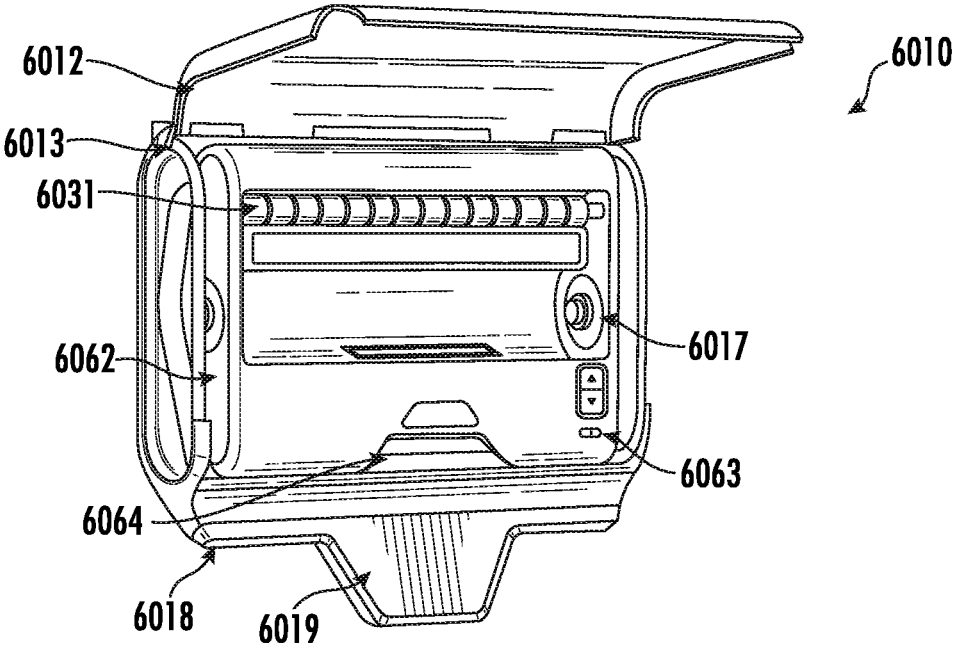
Figure 28B:
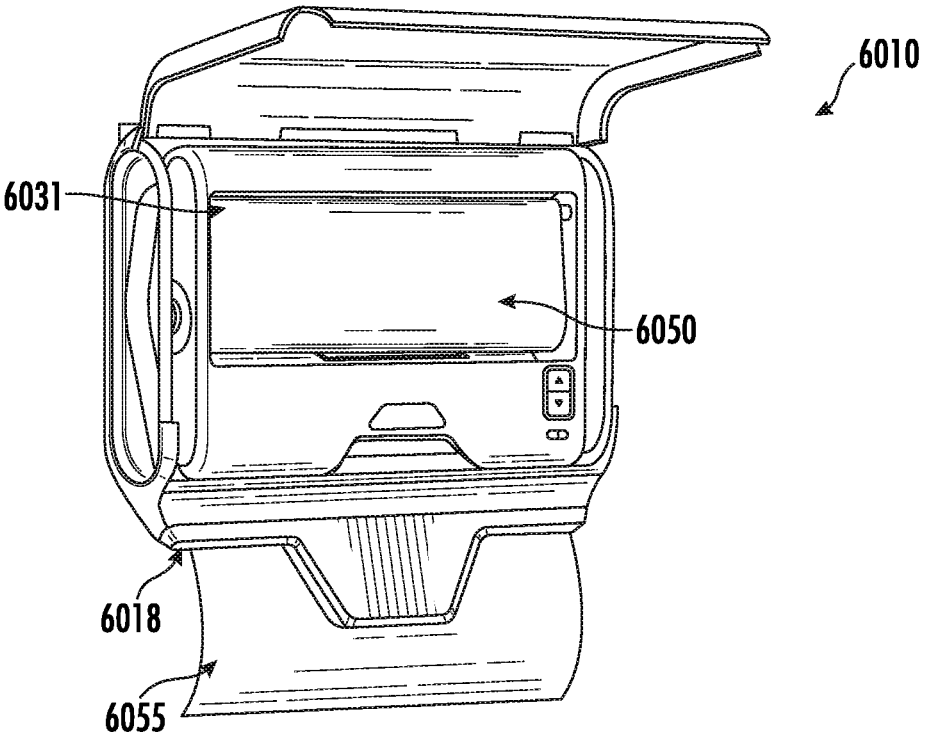
Figure 29:
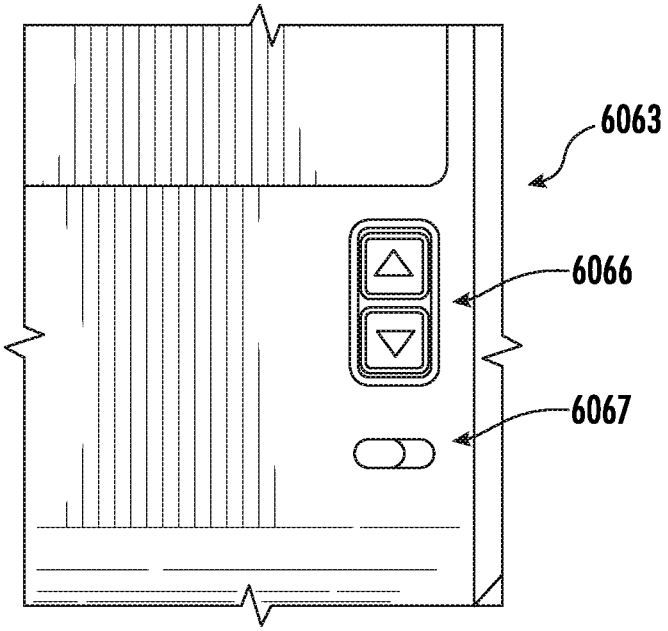
Figure 30:
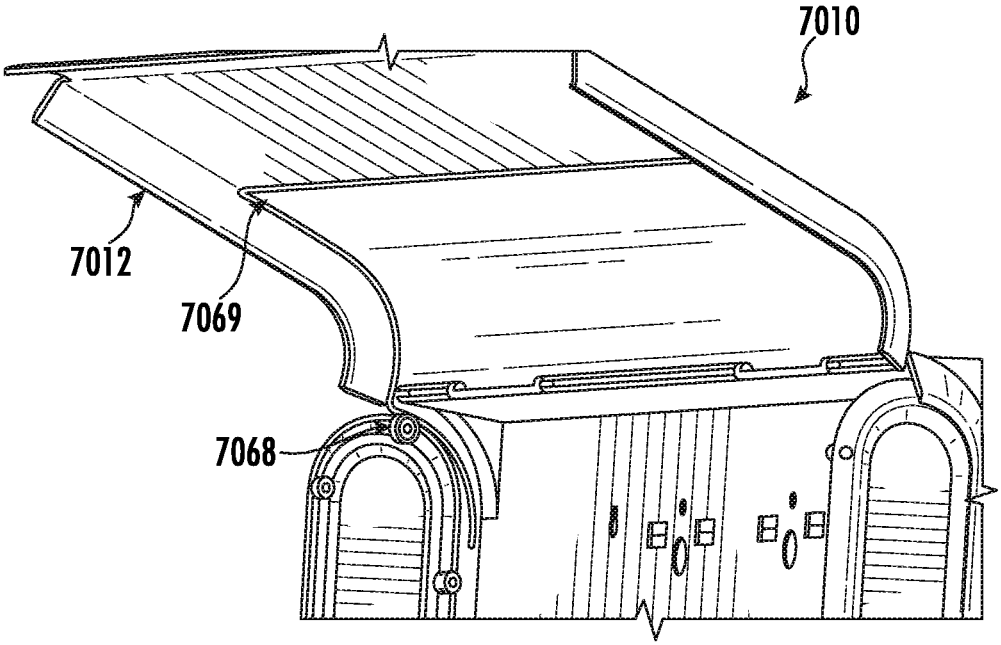
Figure 31:
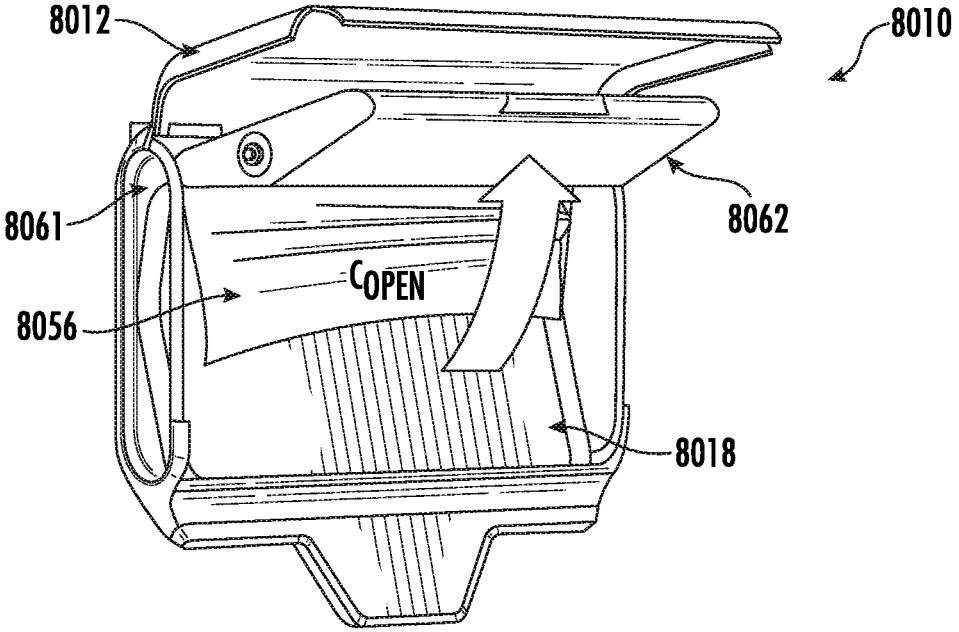
Figure 32:
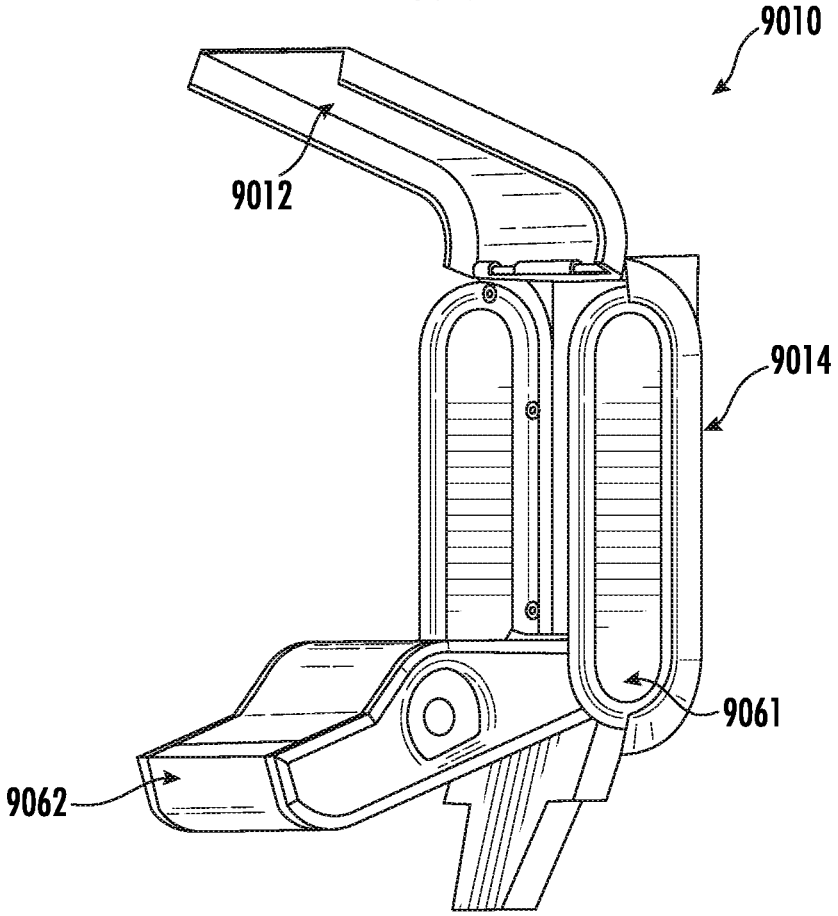
Figure 33:
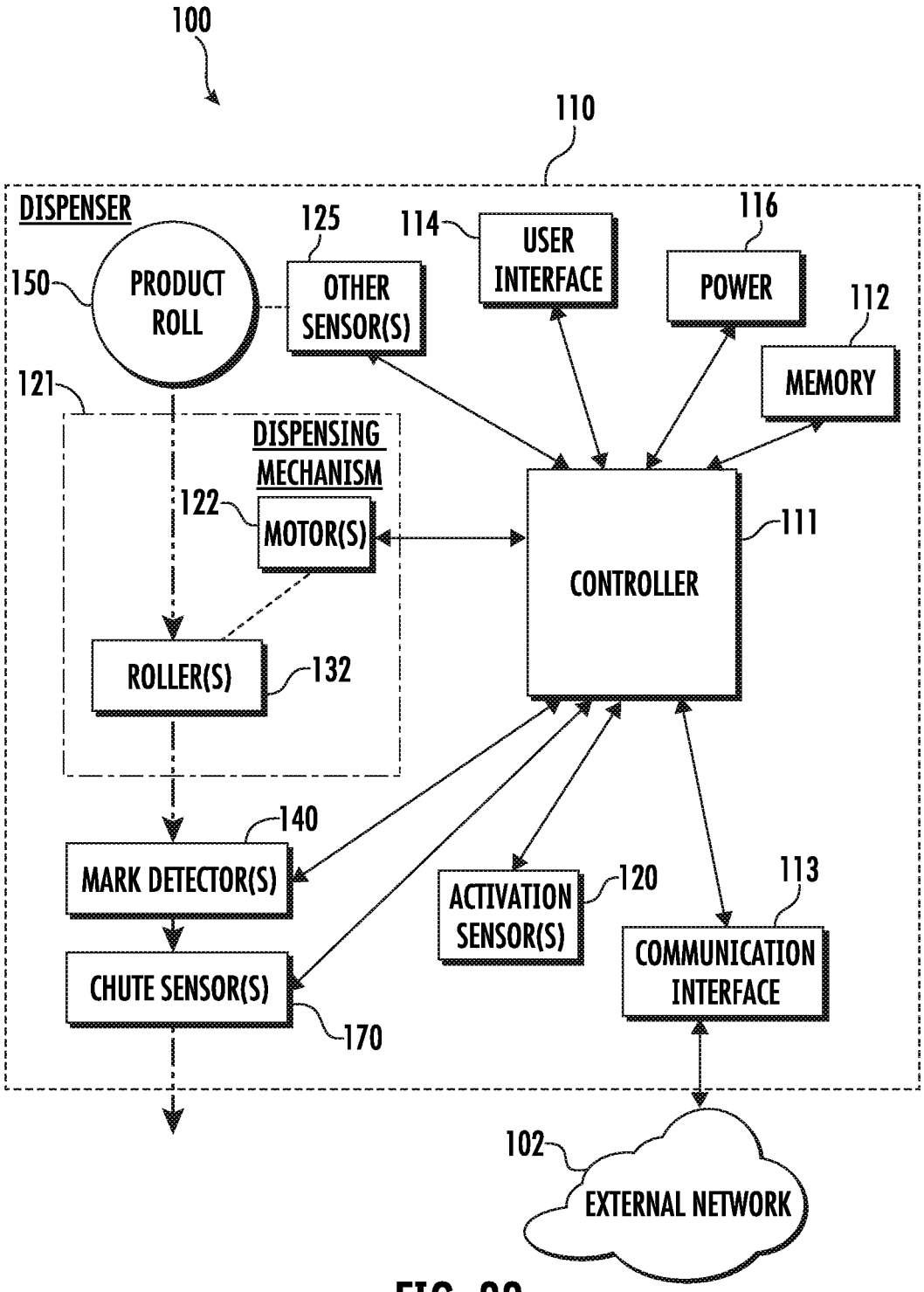
Figure 34:
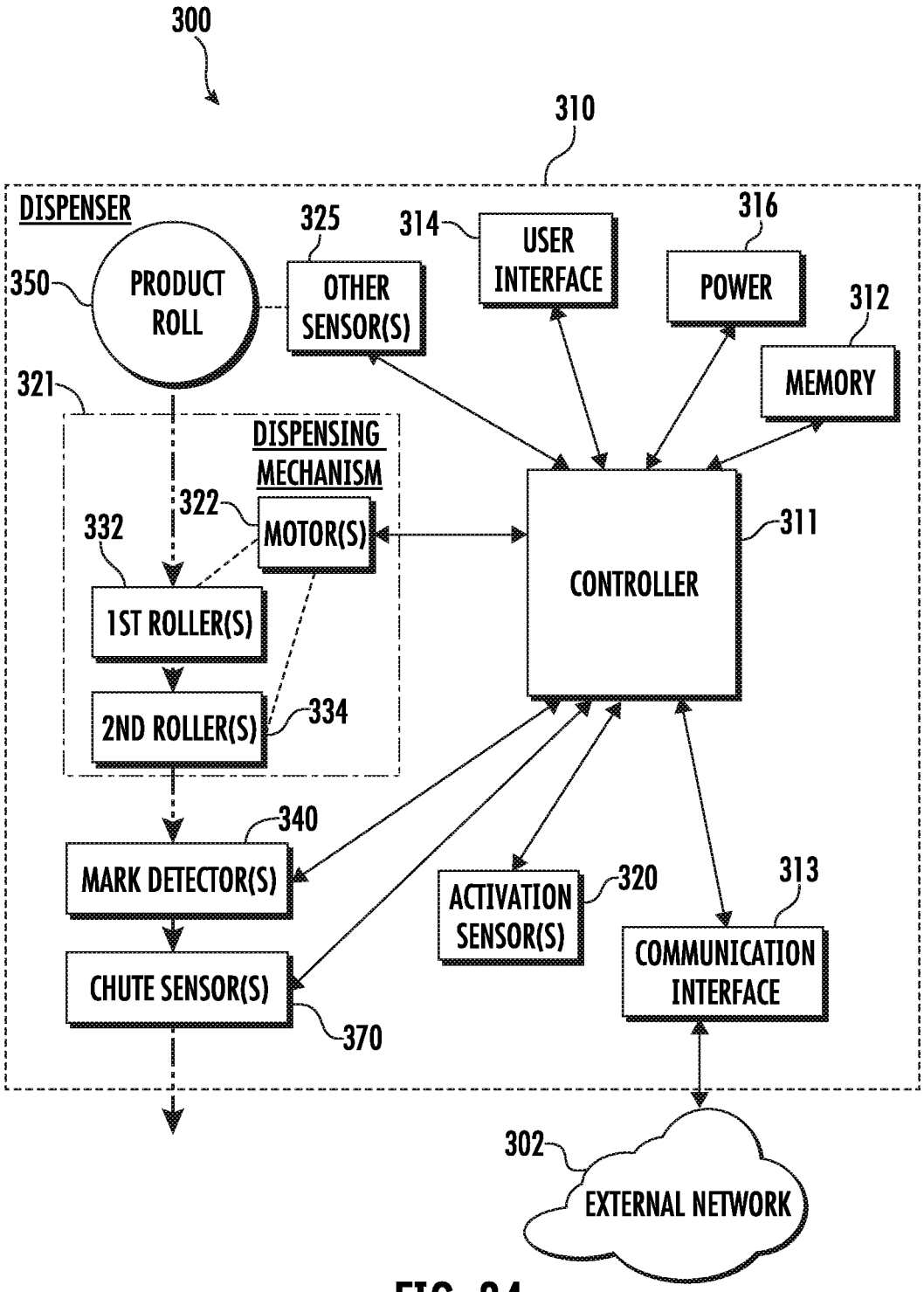
Figure 35:
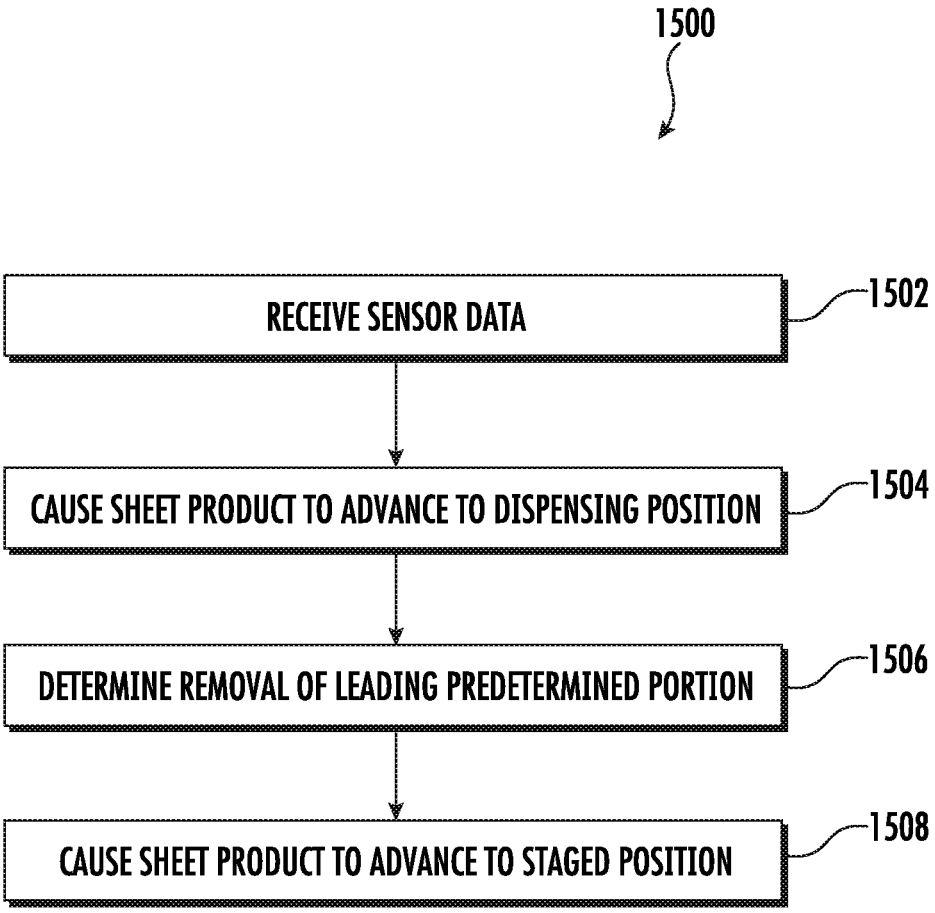
Figure 36:
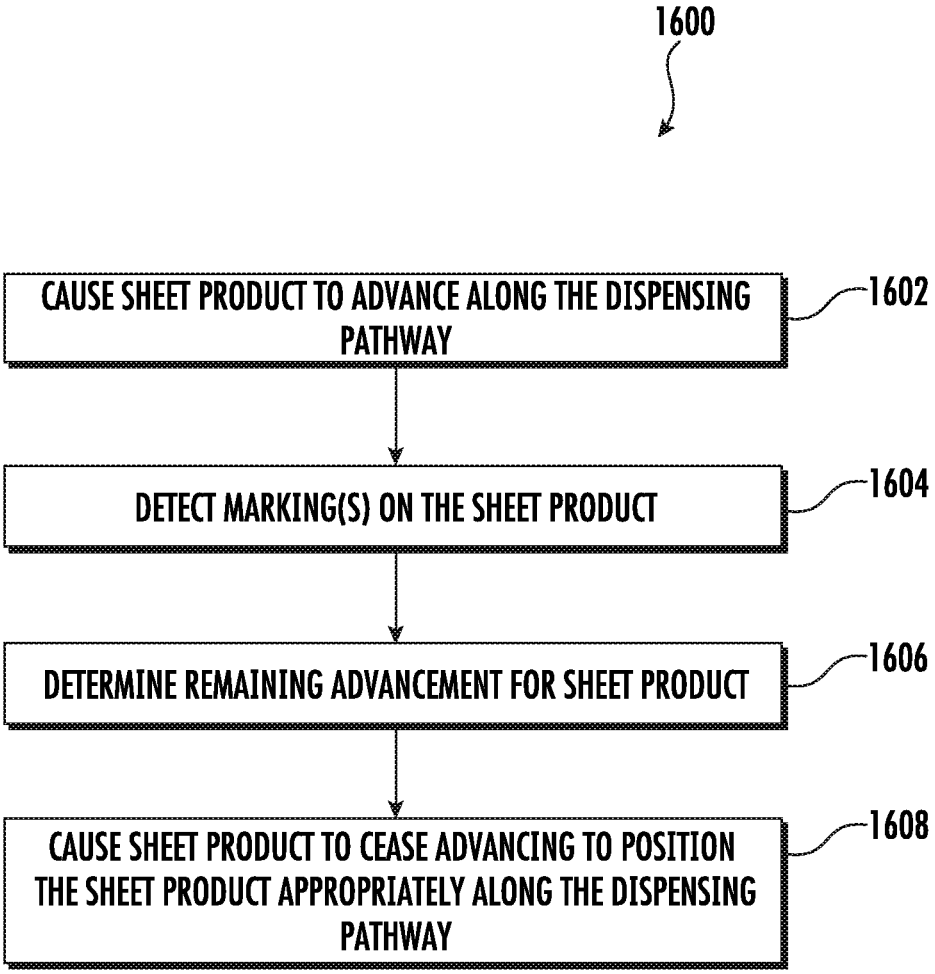
Figure 37:
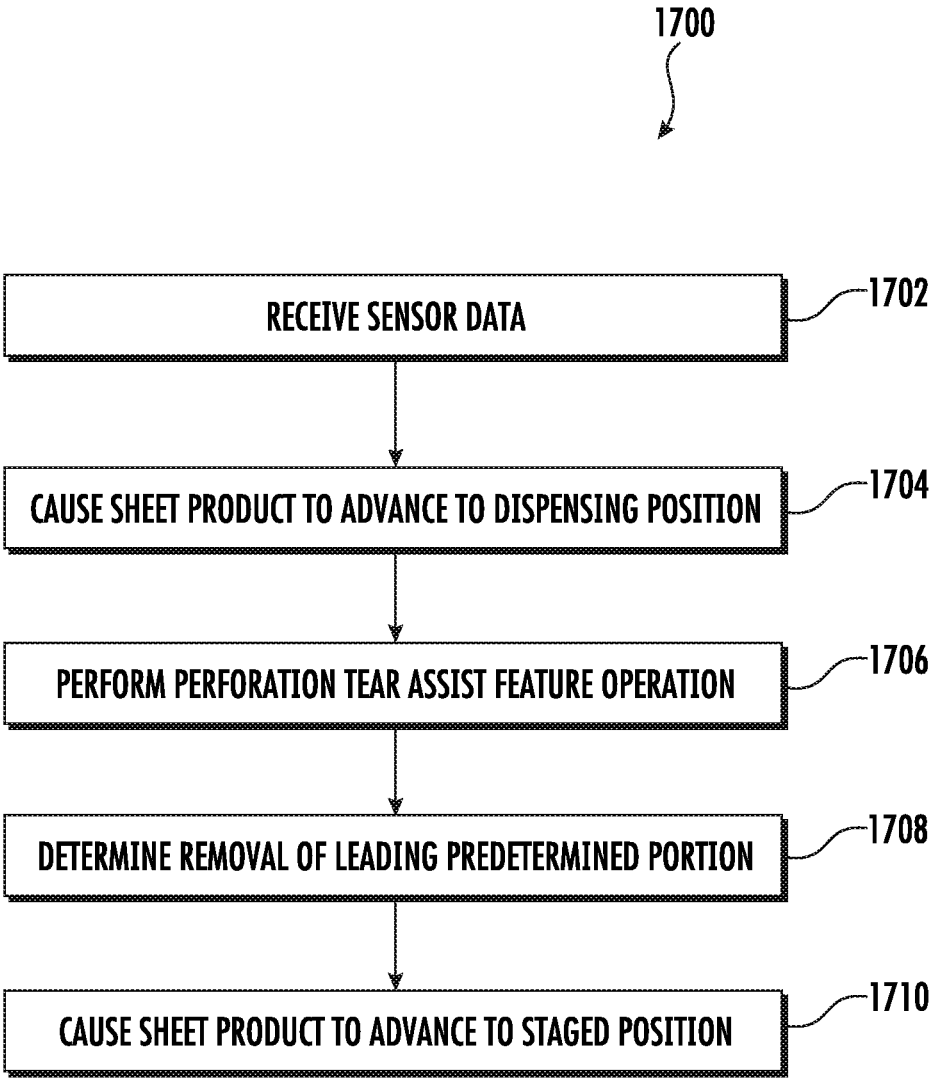

FIGS. 4C-E illustrate example perforation patterns for the line of perforations that separates consecutive predetermined portions of the sheet product, in accordance with some embodiments discussed herein;

FIG. 4F illustrates an example perforation pattern for a series of perforations that defines a shape corresponding to the opening in the toilet for an example predetermined portion of sheet product, in accordance with some embodiments discussed herein;

FIG. 4G is a close up view of a portion of the perforation pattern shown in FIG. 4F, wherein a tear is illustrated progressing through the perforation pattern, in accordance with some embodiments discussed herein;

FIGS. 4H-J illustrate example predetermined portions of the sheet product that include printed indicia, in accordance with some embodiments discussed herein;

FIG. 4K illustrates example printing patterns for sheet product, in accordance with some embodiments discussed herein;

FIG. 5 shows cross-sectional view of an example sheet product dispenser, where a leading predetermined portion of sheet product is shown in the staged position, in accordance with some embodiments discussed herein;

FIG. 6 shows cross-sectional view of the example sheet product dispenser shown in FIG. 5, where the leading predetermined portion of sheet product is shown in the dispensing position, in accordance with some embodiments discussed herein;

FIG. 6A illustrates a schematic cross-sectional view of an example portion of a dispensing chute, where a plurality of ribs with varying heights are shown, in accordance with some embodiments discussed herein;

FIG. 6B illustrates a schematic top view of an example portion of the dispensing chute, where the different heights of the plurality of ribs are illustrated, in accordance with some embodiments discussed herein;

FIG. 6C illustrates a schematic top view of an example portion of the dispensing chute, where different gap distances between consecutive pairs of ribs are illustrated, in accordance with some embodiments discussed herein;

FIG. 7 shows cross-sectional view of another example sheet product dispenser, where a leading predetermined portion of sheet product is shown in the dispensing position, in accordance with some embodiments discussed herein;

FIG. 8 shows a cross-sectional view of another example sheet product dispenser, where the example sheet product dispenser includes a perforation tear assist feature with a lever and a hidden projection, in accordance with some embodiments discussed herein;

FIG. 9 shows a close-up isometric view of the perforation tear assist feature shown in FIG. 8, in accordance with some embodiments discussed herein;

FIG. 10 shows a cross-sectional view of yet another example sheet product dispenser, where the example sheet product dispenser includes a perforation tear assist feature with a brake lever, in accordance with some embodiments discussed herein;

FIG. 11A shows a close-up cross-sectional view of the perforation tear assist feature shown in FIG. 10, wherein the brake lever is in the disengaged position, in accordance with some embodiments discussed herein;

FIG. 11B shows a close-up cross-sectional view of the perforation tear assist feature shown in FIG. 10, wherein the brake lever is in the engaged position, in accordance with some embodiments discussed herein;

FIG. 12 shows a cross-sectional view of yet another example sheet product dispenser, where the example sheet product dispenser includes a perforation tear assist feature with a brake roller, in accordance with some embodiments discussed herein;

FIG. 12A shows a close-up perspective view of interaction between the brake roller and the drive roller for the example sheet product dispenser shown in FIG. 12, in accordance with some example embodiments discussed herein;

FIG. 13 shows a cross-sectional view of yet another example sheet product dispenser, where the example sheet product dispenser includes two nips, where a leading predetermined portion is shown in the staged position, in accordance with some embodiments discussed herein;

FIG. 14 shows a cross-sectional view of the example sheet product dispenser shown in FIG. 13, where the leading predetermined portion is shown in the dispensing position, in accordance with some embodiments discussed herein;

FIG. 15 shows a cross-sectional schematic view of an example sheet product dispenser, where the example sheet product dispenser includes a perforation tear assist feature including a clamping mechanism, in accordance with some embodiments discussed herein;

FIG. 16 shows a cross-sectional schematic view of an example sheet product dispenser, where the example sheet product dispenser includes a perforation tear assist feature including a clamping and cutting mechanism, in accordance with some embodiments discussed herein;

FIG. 17 shows a cross-sectional schematic view of an example sheet product dispenser, where the example sheet product dispenser includes a perforation tear assist feature including a clamping and rotary cutting mechanism, in accordance with some embodiments discussed herein;

FIG. 18 shows a cross-sectional schematic view of an example sheet product dispenser, where the example sheet product dispenser includes a perforation tear assist feature including a rotary cutting mechanism that is located between two nips, in accordance with some embodiments discussed herein;

FIG. 19 shows a cross sectional view of another example sheet product dispenser, where a movable chassis is illustrated, in accordance with some embodiments discussed herein;

FIGS. 20A-20B illustrate an example portion of a sheet product dispenser that includes a perforation tear assist feature for tearing at least some of a series of perforations defining a shape corresponding to the opening in the toilet (e.g., the central opening for the predetermined portion), in accordance with some embodiments discussed herein;

FIGS. 21A-21B illustrate another example portion of a sheet product dispenser that includes a perforation tear assist feature for tearing at least some of a series of perforations defining a shape corresponding to the opening in the toilet (e.g., the central opening for the predetermined portion), in accordance with some embodiments discussed herein;

FIG. 22 illustrates another example portion of a sheet product dispenser that includes a perforation tear assist feature for tearing at least some of a series of perforations defining a shape corresponding to the opening in the toilet (e.g., the central opening for the predetermined portion), in accordance with some embodiments discussed herein;

FIG. 23 illustrates a cross-sectional schematic view of an example sheet product dispenser, in accordance with some embodiments discussed herein;

FIG. 24A shows a top perspective view of an example sheet product dispenser, where the dispenser includes an extension portion that extends from the dispensing chute, in accordance with some embodiments discussed herein;

FIG. 24B shows a right side view of the example sheet product dispenser shown in FIG. 24A, in accordance with some embodiments discussed herein;

FIGS. 25A-C show front views of example sheet product dispensers with differently shaped extension portions, in accordance with some embodiments discussed herein;

FIG. 26A shows a front view of an example sheet product dispenser, where no light is illuminated while the leading predetermined portion is still in the process of moving to the dispensing position, in accordance with some embodiments discussed herein;

FIG. 26B shows a front view of the example sheet product dispenser shown in FIG. 26A, where a green light is illuminated when the leading predetermined portion advances to the dispensing position such that the user is aware that it is available for removal, in accordance with some embodiments discussed herein;

FIG. 27A shows an example roll holder and inserted sheet product roll that may be used with various example sheet product dispensers described herein, in accordance with some embodiments discussed herein;

FIG. 27B shows an example sheet product roll, in accordance with some embodiments discussed herein;

FIGS. 27C-D show example roll holder receiving portions that are each configured to receive and hold a side of a sheet product roll, in accordance with some embodiments discussed herein;

FIG. 28A illustrates an example sheet product dispenser with the cover opened and no roll of sheet product installed, in accordance with some embodiments discussed herein;

FIG. 28B illustrates the example sheet product dispenser shown in FIG. 28A, but with a roll of sheet product installed and a current predetermined portion in the dispensed position, in accordance with some embodiments discussed herein;

FIG. 29 shows a close up view of a portion of a user interface of the example sheet product dispenser shown in FIG. 28A, in accordance with some embodiments discussed herein;

FIG. 30 shows a close up view of an example sheet product dispenser with the cover in the open position, in accordance with some embodiments discussed herein;

FIG. 31 illustrates an example jam scenario in the dispensing chute of an example sheet product dispenser, where the chassis is raised to an unstowed position to reveal the sheet product, in accordance with some embodiments discussed herein;

FIG. 32 illustrates an example sheet product dispenser with the chassis in the unstowed position and the cover in the open position, in accordance with some embodiments discussed herein;

FIG. 33 shows a block diagram illustrating an example sheet product dispenser, in accordance with some embodiments discussed herein;

FIG. 34 shows a block diagram illustrating another example sheet product dispenser, in accordance with some embodiments discussed herein;

FIG. 35 illustrates a flowchart of an example method of controlling and operating an example sheet product dispenser, in accordance with some embodiments discussed herein;

FIG. 36 illustrates a flowchart of an example method of controlling and operating an example sheet product dispenser to advance the sheet product to an appropriate position (e.g., to a staged position or a dispensing position), in accordance with some embodiments discussed herein; and FIG. 37 illustrates a flowchart of another example method of controlling and operating an example sheet product dispenser, in accordance with some embodiments discussed herein.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

As used herein, a "user" of example product dispensers may be a maintainer (e.g., a maintenance person, a janitor, a facility manager, etc.) or a consumer (e.g., end user, a person receiving a dispensed predetermined portion, etc.). In some embodiments, a "user" may act as both a maintainer and a consumer.

As used herein, the term "sheet product" includes a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue, facial tissue, napkin, wipe, wrapping paper, aluminum foil, wax paper, plastic wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation and/or tearing. In some such embodiments, the lines of perforations may extend along the width of the sheet product to define individual sheets that can be torn off by a user.

As used herein, the term "dispersible paper" includes sheet product that is designed to at least partially disintegrate in water such as for use with flushing down a toilet drain (e.g., the sheet product is flushable). In some embodiments, the sheet product may have a low wet strength characteristic to help facilitate dispersibility and/or flushability. In some example embodiments, the dispersible paper may be formed partially of hardwood (e.g., wood that is formed of shorter fibers, such as from gum, maple, and oak trees) and softwood (e.g., wood that is formed of longer fibers, such as from Douglas firs and Southern pines). Such dispersible paper may, in some embodiments, encompass one or more of the above noted examples of sheet product (e.g., wipe, bath tissue, napkin, facial tissue, etc.) and/or one or more qualities/characteristics of such examples. In this regard, the term dispersible paper is not meant to be limited to a specific type of sheet product unless otherwise stated.

Example Sheet Product Dispensers

Figure 1A:
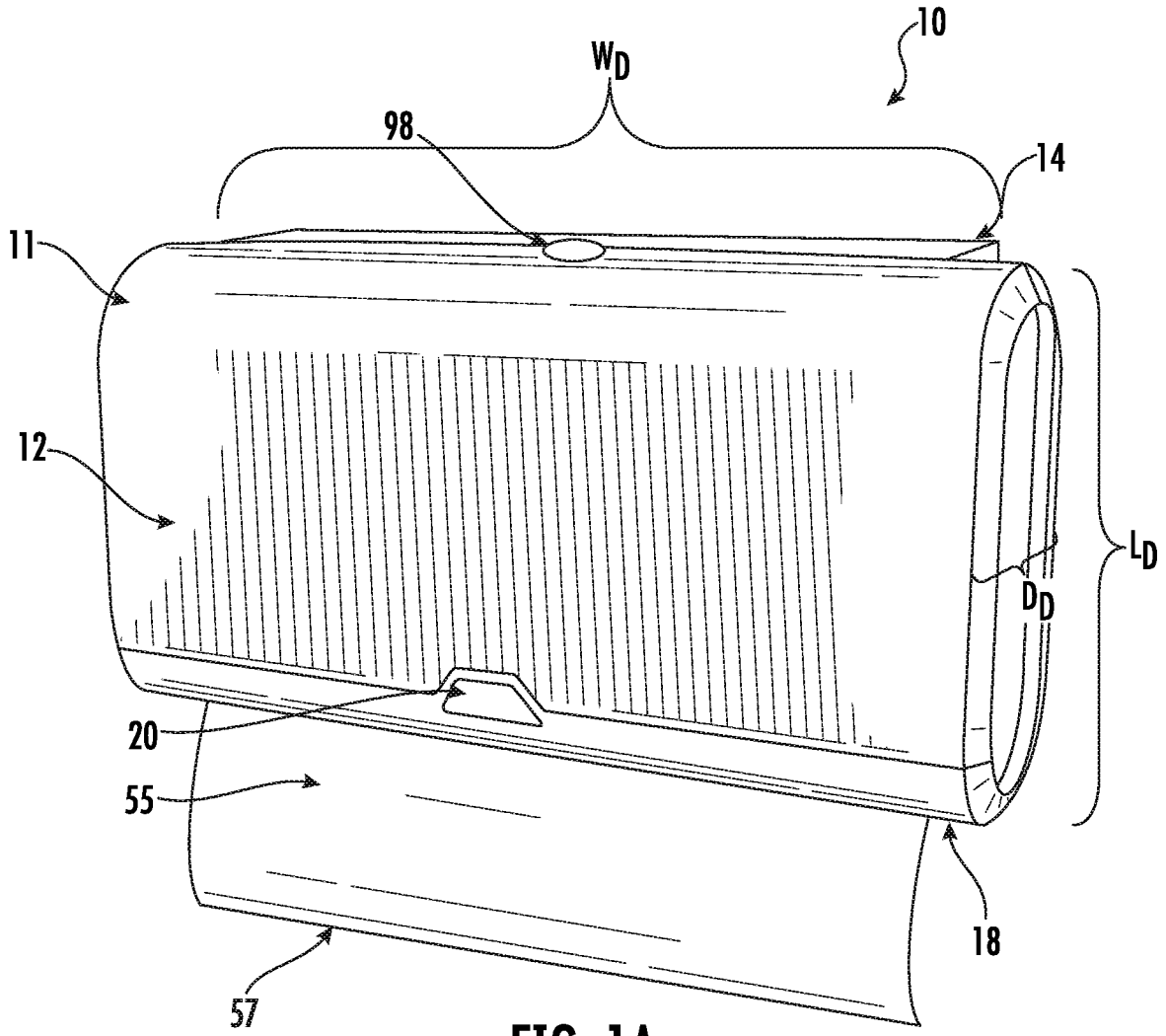
FIG. 1A shows a top perspective view of an example sheet product (e.g., toilet seat cover) dispenser, in accordance with some embodiments discussed herein.

FIG. 1A shows an example sheet product dispenser 10 according to various embodiments of the present invention. The sheet product dispenser 10 may include a housing 11 defined by a base portion 14 and a cover 12. In some embodiments, the sheet product dispenser 10 may be configured to be mounted, such as to a wall or a bathroom stall. In some such embodiments, the sheet product dispenser 10 may include one or more mounting structures (e.g., screw holes, clips, attachment features, etc.) on the rear side of the base portion 14 to facilitate mounting the sheet product dispenser 10.

Figure 2:
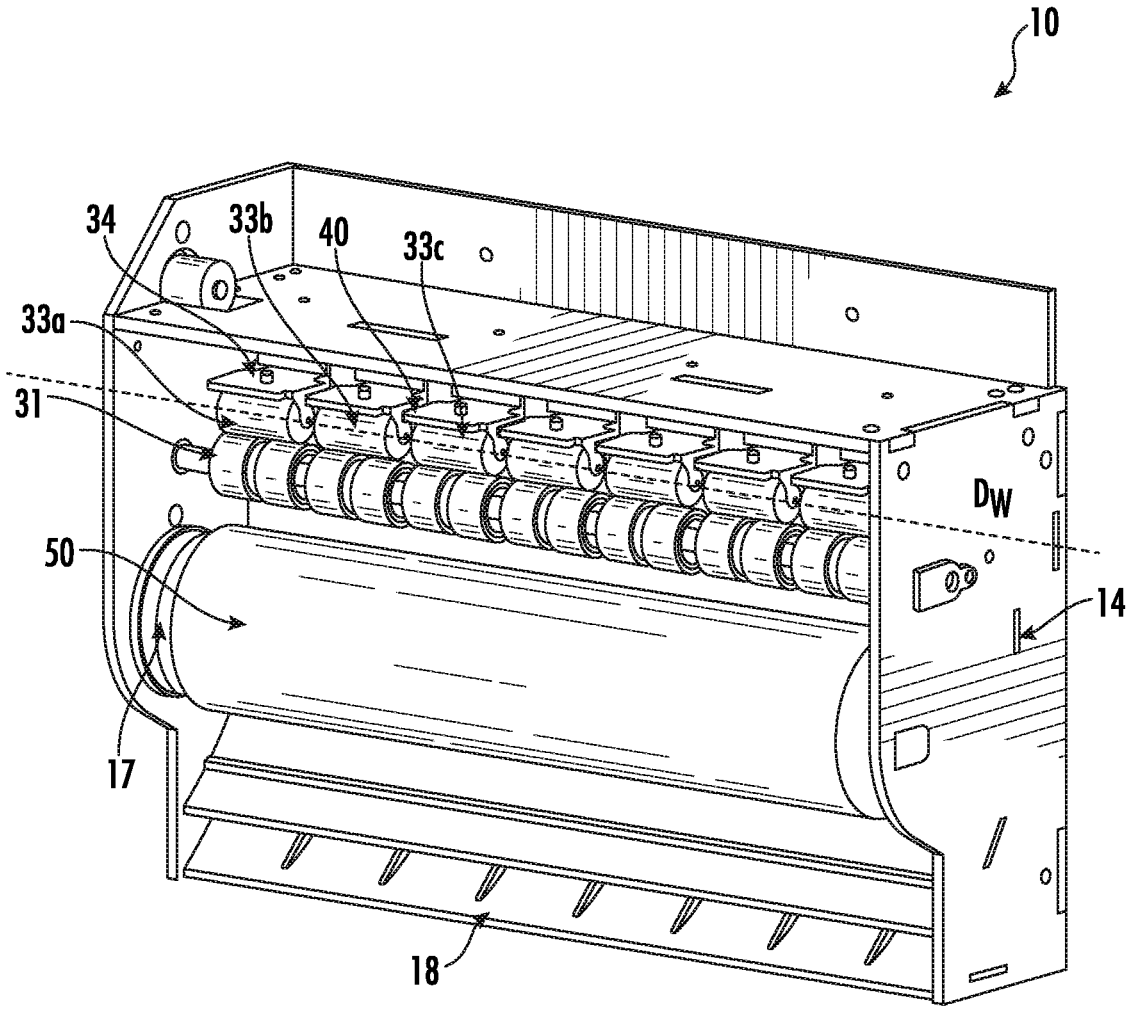
FIG. 2 shows an isometric view of an example sheet product dispenser with a cover removed, in accordance with some embodiments discussed herein.

The cover 12 may be movable between a closed position (shown in FIG. 1A) and an open position (e.g., shown in FIG. 28A). FIG. 2 illustrates an example base portion 14 with the cover 12 removed. In some embodiments, the cover 12 may be movable while remaining attached to the base portion 14. For example, the cover 12 may be configured to rotate about an axis. A lock feature 98 may be provided to permit locking of the cover 12 to the base portion 14. A maintainer may, for example, have a key that can be inserted into the lock feature 98 to enable opening of the cover 12. In some embodiments, the lock feature 98 may be operated via an unlocked button to enable opening of the cover 12. In this regard, with the cover 12 opened, the maintainer can perform maintenance on the sheet product dispenser 10, such as repairing or replacing various components or batteries and/or replacing the sheet product roll 50 that is on the roll holder 17 (shown, for example, in FIG. 2).

Figure 1B:
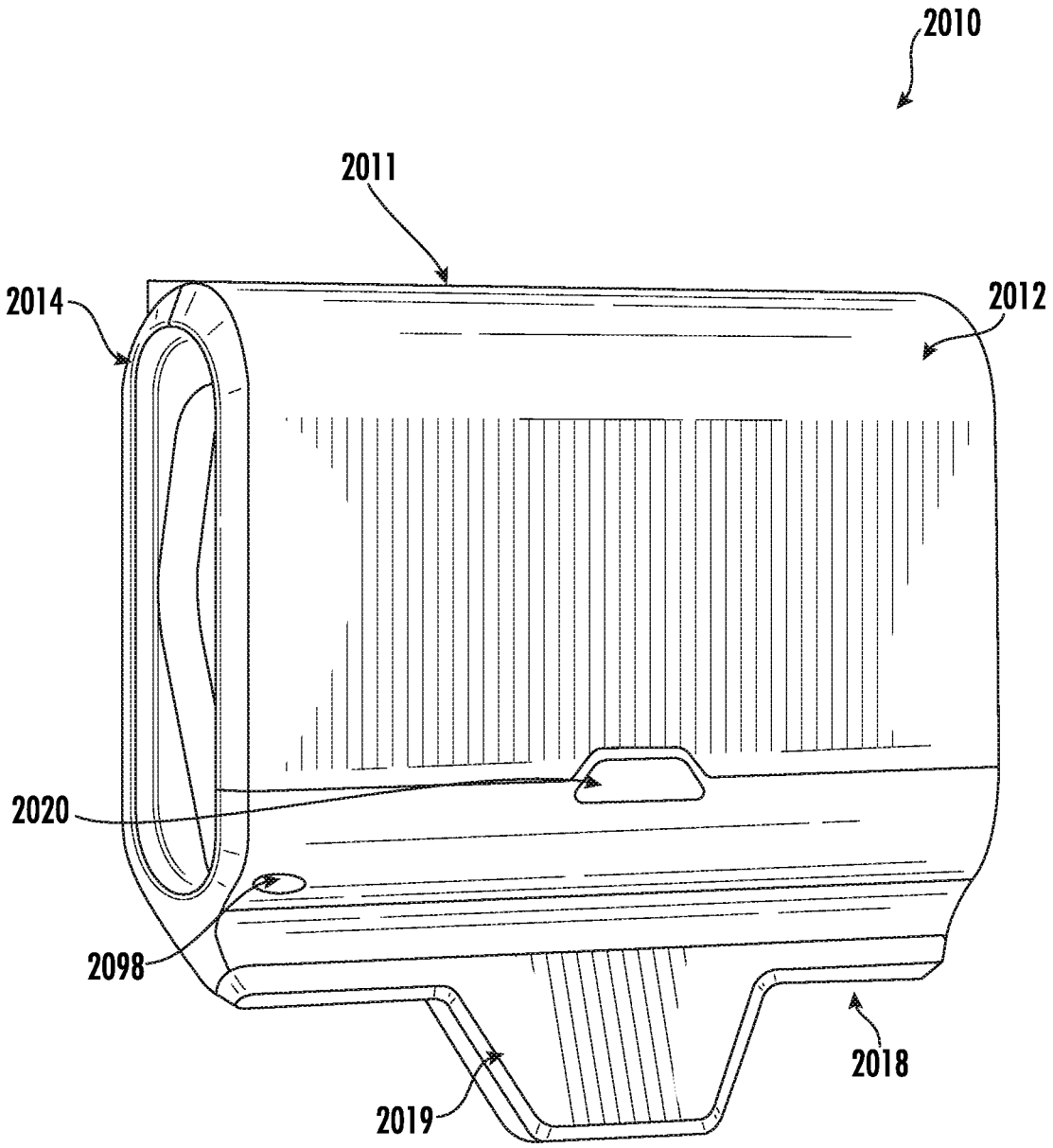
FIG. 1B shows a perspective view of another example sheet product (e.g., toilet seat cover) dispenser, in accordance with some embodiments discussed herein.

FIG. 1B illustrates another example sheet product dispenser 2010 that includes an extension portion 2019 extending from the chute 2018. Additional detail regarding example extension portions is described herein with respect to FIGS. 24A-25C. Similar to the example sheet product dispenser 10, the sheet product dispenser 2010 includes a housing 2011 defined by a base portion 2014 and a cover 2012. An activation sensor 2020 is positioned in the relative lower, center of the dispenser and can be utilized by a user to initiate a dispense (such as described herein). Additionally, the sheet product dispenser 2010 includes a lock feature 2098 that enables a user (e.g., a maintenance professional) to access the inside of the sheet product dispenser 2010, such as by opening the cover 2012.

In some embodiments, the sheet product dispenser 10 may be configured to enable dispensing of a portion of sheet product, such as in response to a user providing corresponding user input to the dispenser 10. For example, the sheet product dispenser 10 may include one or more activation sensors 20 that can be utilized for providing user input indicating a desire to cause a dispense of the sheet product (e.g., a leading predetermined portion 55 of the sheet product is shown in a dispensing position in FIG. 1A). In response to receiving the user input, the sheet product dispenser 10 may operate to cause a portion of the sheet product to dispense therefrom (e.g., hang down from the dispensing chute 18). More detail regarding how the dispense occurs is described herein. The user input indicating the desire to dispense the portion of sheet product may be provided to any type of activation sensor/device, such as a handle, button, sensor, among others. In some embodiments, the user input may be provided via touch-free user input such as may be desirable to avoid the need to touch the dispenser (e.g., the user may have dirty hands). In some embodiments, one or more emergency dispense features (e.g., an emergency dispense handle, lever, or other structure) may be provided so that a user can gain a dispensed portion even if one or more components/features of the dispenser is not operating as intended (e.g., the activation sensor 20 isn't sensing the user input, the batteries are out or depleted, etc.).

Returning to FIG. 2, the sheet product dispenser 10 may include a roll holder 17 for receiving and holding a sheet product roll 50 (such as described in greater detail herein). The roll holder 17 may include one or more attachment features that are configured to rotatably hold the sheet product roll 50, such as during operation of the dispenser. Additionally, the roll holder 17 may be configured to enable detachment and attachment to enable replacement of the sheet product roll 50, such as by a maintainer. In some embodiments, the roll holder 17 may include one or more sensors, such as may be configured to determine one or more characteristics regarding the sheet product roll (e.g., whether one is installed and/or was just installed, the weight of the sheet product roll, rotation of the sheet product roll, etc.).

The sheet product dispenser 10 may include one or more drive rollers 31 and corresponding nip rollers 33 (e.g., nip rollers 33*a*, 33*b*, 33*c* . . . ). As described in greater detail herein, a motor may be configured to operate the one or more drive rollers 31 and/or nip rollers 33 to cause movement of the sheet product along a dispensing pathway such as out of the dispensing chute 18. In some embodiments, such as the illustrated embodiment, the nip roller 33 may be formed of a plurality of nip rollers 33*a*, 33*b*, 33*c*, . . . that are spaced apart along a width direction ($D_W$) of the dispensing pathway of the dispenser 10. In the illustrated embodiment, each nip roller 33*a* includes a corresponding mounting structure 34, such as may be biased toward the drive roller 31.

Notably, in some embodiments, each of the plurality of nip rollers is independently actuatable to move (e.g., upwardly/downwardly, although pivoting and pitching is also contemplated), such as between a first position and a second position. In this regard, the plurality of independently actuatable nip rollers may account for any inconsistencies in the dispense (e.g., the sheet product got moved in the width direction such that one of the nip rollers is not touching the sheet product) to thereby avoid negative effects on the sheet product (e.g., crinkling, folding, etc.) which can result in providing a less desirable dispense and/or lead to clogging of the dispenser. This may be particularly important for the type of sheet product being dispensed, which can be more prone to tearing/ripping than paper towel or some tissue paper. Further, providing an intact dispense can be critical to avoid user frustration and ensure proper usage of the dispensed portion (e.g., toilet seat cover).

Of further note, by spacing apart the nip rollers 33*a*, 33*b*, 33, . . . one or more mark detectors 40 can be positioned between consecutive nip rollers (e.g., between nip roller 33*b* and 33*c*) and aimed toward the sheet product that is moving through the nip 36. Example mark detectors and their various possible functions are described in greater detail herein. Further, some embodiments contemplate different or additional positions for the mark detectors within the dispenser 10.

The dispensing chute 18 may be positioned within the dispenser 10 and along the dispensing pathway to provide the dispensed portion to the user. In some embodiments, one or more sensors may be positioned within the dispensing chute 18, such as for determining whether a dispensed portion is present. Further detail regarding example dispensing chutes and various components/features provided for the dispensing chute 18 are described herein.

Further detail regarding the various components of example sheet product dispensers 10 can be found herein, such as with respect to FIGS. 33 and 34 (e.g., depending on various desired configurations of the sheet product dispenser).

Returning to FIG. 1A, in some embodiments, the sheet product dispenser 10 may be designed to be mounted in a restroom to provide individual toilet seat covers to a user. In this regard, the sheet product dispenser 10 may be shaped and/or sized to fit within the restroom environment, such as within a stall (which may be small/narrow/etc. and which may also have a toilet, along with other fixtures, such as tissue paper rolls/dispensers). Depending on the configuration and available space, the sheet product dispenser 10 may be mounted to a stall wall, a back of stall door, or behind the toilet. Notably, in addition to the constraints of the restroom space where the sheet product dispenser 10 is mounted, other considerations that need to be accounted for include the size of a full supply of the sheet product (e.g., the size of full-sized product roll mounted on the roll holder 17) and the dispensing pathway needed to appropriately dispense a predetermined portion (such as described further herein). In this regard, the various example features described herein account for all such factors to provide a useful sheet product dispenser 10. Thus, the sheet product dispenser 10 may define a width ($W_D$), length ($L_D$), and depth ($D_D$) so as to be mounted within the stall and still provide the corresponding dispensed portion (e.g., a predetermined portion corresponding to an individual toilet seat cover). In some embodiments, the depth of the dispenser 10 may be relatively small (e.g., ~4 in.-6 in.) compared to the length (e.g., ~12 in.-24 in.) and width (e.g., ~16 in.-22 in.). Notably, in some embodiments, the width may be determined according to the width of the sheet product itself.

In some embodiments, the activation sensor 20 may be designed to enable accurate sensing of user input regarding a desire to receive a dispense. For example, due to potential mounting positions of the sheet product dispenser within the restroom environment and the size of the sheet product dispenser itself, there may be a risk of inadvertent activation of the sheet product dispenser. For example, a user sitting down on the toilet may inadvertently activate the activation sensor of a sheet product dispenser mounted behind or next to the toilet. Thus, some embodiments of the present invention contemplate certain positioning and orientation of the activation sensor 20 such that a detection zone for detecting user input for activating a dispense is defined to avoid or limit risk of such inadvertent activation. In this regard, in some example embodiments, the activation sensor is oriented relative to the housing and configured to sense an object positioned within a detection zone relative to the housing.

Figure 3A:
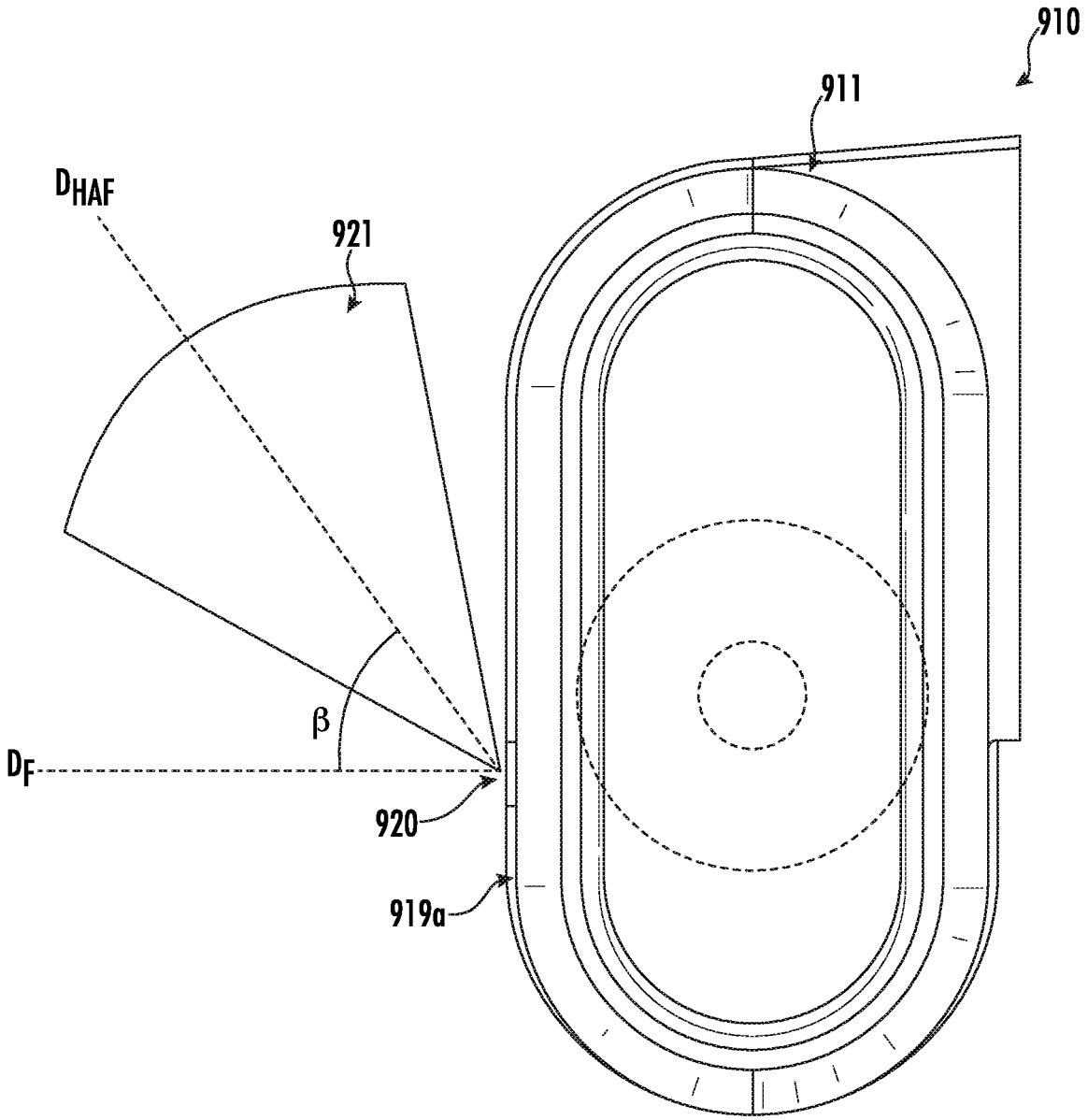
FIG. 3A shows a right side view of an example sheet product dispenser, where a detection zone of an activation sensor is illustrated, in accordance with some embodiments discussed herein.
Figure 3B:
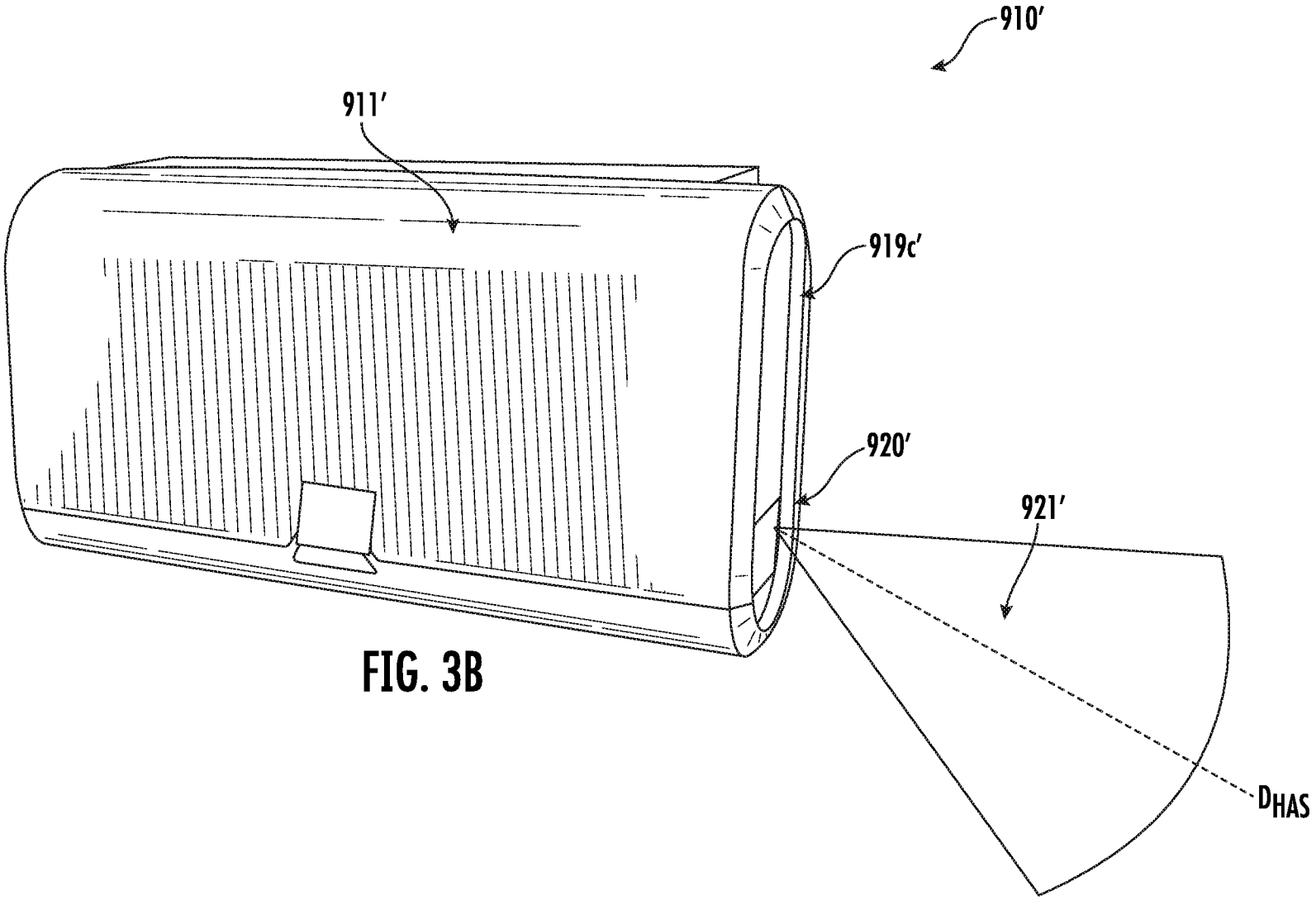
FIG. 3B shows a top perspective view of an example sheet product dispenser, where a detection zone of an activation sensor is illustrated, in accordance with some embodiments discussed herein.
Figure 3C:
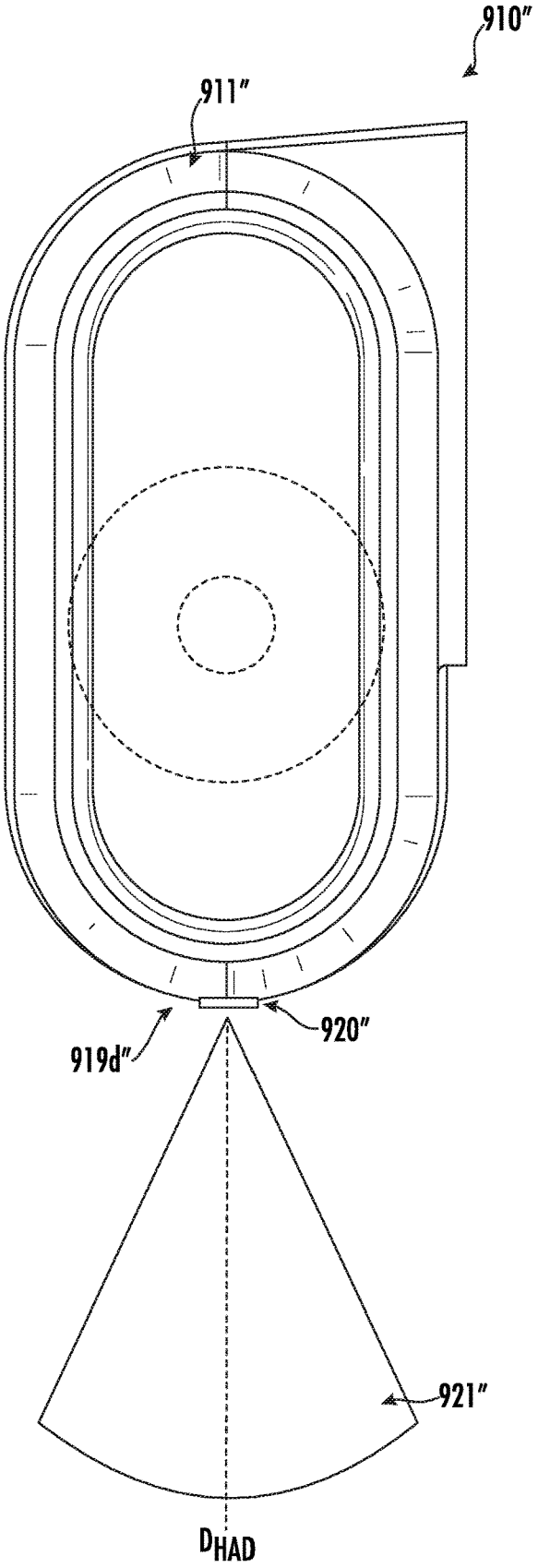
FIG. 3C shows a right side view of an example sheet product dispenser, where a detection zone of an activation sensor is illustrated, in accordance with some embodiments discussed herein.

With reference to FIG. 3A, an example sheet product dispenser 910 includes an activation sensor 920 that is positioned on a front surface 919*a* of the housing 911. The activation sensor 920 is oriented so as to define the detection zone (where the sensor 920 senses user input) such that it is generally forward and upward of the dispenser housing 911. For example, the center line $D_{HAF}$ of the detection zone 921 for the activation sensor 920 extends at an upwardly extending angle β of approximately 45 degrees with respect to a forward direction $D_F$. In some embodiments, the center line may extend at an upwardly extending angle of at least 30 degrees with respect to the forward direction $D_F$. FIG. 3B illustrates another example positioning and orientation of the activation sensor to avoid or limit inadvertent activation. In the illustrated embodiment, an example sheet product dispenser 910' includes an activation sensor 920' that is positioned on a side surface 919*c'* of the housing 911'. The activation sensor 920' is oriented so as to define the detection zone (where the sensor 920' senses user input) such that it is generally outward to the side of the dispenser housing 911'. For example, the center line $D_{HAS}$ of the detection zone 921' for the activation sensor 920' extends to the side of the dispenser housing 911'. FIG. 3C illustrates yet another example positioning and orientation of the activation sensor to avoid or limit inadvertent activation. In the illustrated embodiment, an example sheet product dispenser 910" includes an activation sensor 920" that is positioned on a bottom surface 919*d"* of the housing 911". The activation sensor 920" is oriented so as to define the detection zone (where the sensor 920" senses user input) such that it is generally downward below the dispenser housing 911". For example, the center line $D_{HAD}$ of the detection zone 921" for the activation sensor 920" extends below the dispenser housing 911".

Notably, while the illustrated embodiments provide an example volume 921, 921', 921" of a detection zone, such a volume is meant for explanatory purposes and is not meant to be limiting. In this regard, different types of activation sensors (e.g., infrared, time-of-flight, capacitance, optical, etc.) may provide differently sized and shaped detection zones that are all contemplated with embodiments described herein.

Example Sheet Product

As noted herein, example embodiments of the present invention provide a sheet product dispenser 10 configured to dispense a predetermined portion of flushable and/or dispersible paper that is designed to be converted and used as a toilet seat cover. As further noted herein, some such sheet product dispensers 10 are also designed to dispense such predetermined portions from a sheet product roll 50 (e.g., as opposed to the toilet seat covers being held in stacked form).

FIG. 4A illustrates an example sheet product roll 50 that includes a continuous web of sheet product. The continuous web is defined by a plurality of predetermined portions 55 that each correspond to a toilet seat cover. Consecutive predetermined portions 55 are separated by a line of perforations 51 extending along a width direction of the sheet product, wherein each of the plurality of predetermined portions includes at least one cut-out or a series of perforations 53 that define at least a portion 54 of a shape corresponding to an opening in a toilet seat (see e.g., the portion 54 corresponds to the shape of toilet seat opening). Each of the plurality of predetermined portions 55 define a length extending from a leading edge 57 to a trailing edge 58.

FIG. 4B illustrates a portion of the sheet product roll 50, showing the leading predetermined portion 55*a* followed by a next predetermined portion 55*b*. The leading predetermined portion 55*a* defines a length ($L_S$) extending from a leading edge 57*a* to a trailing edge 58*a*. The leading predetermined portion 55*a* is separated from the next predetermined portion 55*b* by a line of perforations 51 extending along the width ($W_S$) of the sheet product at its trailing edge 58*a*. Notably, the trailing edge 58*a* of the leading predetermined portion 55*a* is adjacent the leading edge 57*b* of the next predetermined portion 55*b*. The leading predetermined portion 55*a* includes a series of perforations 53 that define at least a portion 54*a* of a shape corresponding to an opening in a toilet seat. A remaining edge 52 of the portion 54*a* (e.g., as also defined by the series of perforations 53) may not include perforations such that the portion 54*a* remains connected to the remainder of the leading predetermined portion 55*a* through the edge 52 when a user separates the series of perforations 53 to convert the predetermined portion into a useable toilet seat cover. In such a regard, the portion 54*a* corresponding to the opening in the toilet seat may fall into the toilet and hang via the edge 52.

As noted herein, the predetermined portion may define a size such that it fits over and covers a toilet seat. For example, the predetermined portion may define a width that ranges from ~10 in.-18 in. (with a preferred range of ~13 in.-18 in.) and a length that ranges from ~12 in.-22 in. (with a preferred range of ~15 in.-20 in.).

In some embodiments, the line of perforations may be defined by a perforation pattern that is configured to encourage proper separation of consecutive predetermined portions when a separation tear is initiated. At the same time, however, the perforation pattern may be designed to maintain the connection between the consecutive predetermined portions until the separation is actually desired (e.g., to avoid premature separation, such as during interaction with the dispenser and its components and/or from a false pulling on an exposed leading edge). In this regard, the perforation pattern may be important to achieve both desirable outcomes.

FIGS. 4C-E illustrate example perforation patterns for the line of perforations that separates consecutive predetermined portions of the sheet product. As shown, different variables such as the length of an edge cut, the length of a cut, the length of a bonded (uncut) section of the sheet product, the repeated nature of the cuts and bonded sections, among other things, are just some of the factors that are considered for designing a beneficial perforation pattern. FIG. 4C illustrates a first example perforation pattern 2051 for a sheet product roll 2050. With an example sheet product width of 14.5 inches, the perforation pattern 2051 includes an edge cut (e.g., leading from one edge toward the center of the sheet product) of 0.5 inches, followed by a repeated pattern of a bonded section of 0.028 inches and a cut of 0.112 inches. FIG. 4D illustrates a second example perforation pattern 2051' for a sheet product roll 2050'. With an example sheet product width of 14.5 inches, the perforation pattern 2051' includes an edge cut (e.g., leading from one edge toward the center of the sheet product) of 0.5 inches, followed by a repeated pattern of a bonded section of 0.028 inches and a cut of 0.159 inches. In this regard, example desirable perforation patterns when using a single line of perforations may include a length of repeated cuts ranging from 0.1 in.-0.2 in. (with a preferred range, in some embodiments, of 0.112 in.-0.159 in.). This produces a desirable ratio of repeated cut over (repeated cut plus bonded section) of ~0.78-0.88 (with a preferred ratio, in some embodiments, of 0.8-0.85). In some embodiments, the perforation pattern may be designed to achieve a desired ratio of ~0.9. In some embodiments, different sections of the perforation pattern may have different desired ratios—such as 0.85 towards the edges and 0.9 in the middle.

In some embodiments, a double line of perforations may be used for the line of perforations. For example, FIG. 4E illustrates a third example perforation pattern 2051" for a sheet product roll 2050". Notably, this perforation pattern 2051" includes a first perforation line 2051*a*" and a second perforation line 2051*b*". With an example sheet product width of 14.5 inches, both the first perforation line 2051*a*" and the second perforation line 2051*b*" include an edge cut (e.g., leading from one edge toward the center of the sheet product) of 0.25 inches, followed by a repeated pattern of a bonded section of 0.028 inches and a cut of 0.112 inches. While shown as matching, in some embodiments, the repeated cut and bonded section may be offset, such as by having a different edge cut length between the two perforation lines.

Example embodiments, that provide two perforation lines for a perforation pattern help provide additional redundancy for maintaining the connection until desired, and also provide for recapturing errant tears and maintaining the remainder of the predetermined portion intact during an otherwise errant tear. As an illustrative example, if a tear begins at the edge of the second perforation line 2051*b*", the tear may continue along the same perforation line 2051*b*" across the width of the predetermined portion. However, if the tear becomes errant and moves upwardly off the second perforation line 2051*b*", then the first perforation line 2051*a*" may "catch" the errant tear and redirect it along the first perforation line 2051*a*"—thereby preventing the errant tear from moving into the rest of the predetermined portion for which it is desirable to remain intact (such as for its intended end use for covering the toilet seat). Notably, a further downward errant tear from the first perforation line 2051*a*" may be caught again and redirected by the second perforation line 2051*b*", with the same benefits being applied across the width of the predetermined portion. A further benefit of such a configuration is that the edge cut length can be reduced as there is less need to extend the duration of direction of the initial tear due to having the second perforation line to catch an errant tear. By having a reduced edge cut length, the line of perforations 2050" may be more likely to stay intact until the desired separation tear is initiated.

The example perforation patterns 2051, 2051', 2051" have been shown in testing to provide the desired outcome to maintain the sheet connection until a dispensing event and then achieve a proper separation during the dispensing event (e.g., a user initiating a dispensing tear). In some embodiments, the combination of the example perforation pattern and other beneficial features help ensure that proper separation occurs.

In some embodiments, the predetermined portion may include a series of perforations that can be removed to form an opening (e.g., center hole) that corresponds to the opening in the toilet. While some embodiments envision a user tearing out the series of perforations after a dispense is completed (e.g., to convert the predetermined portion into a toilet seat cover), in some embodiments, the series of perforations may naturally be torn away once a substance (e.g., water, urine, fecal matter, etc.) is dropped thereon (such as if a user simply places the predetermined portion over the toilet seat without first removing the series of perforations). Likewise, in some embodiments, such an opening may be pre-removed before dispensing (and may not have had a series of perforations) and/or such a series of perforations may be torn away via one or more features of the dispenser).

FIG. 4F illustrates an example perforation pattern for a series of perforations 2153 that defines a shape 2154 corresponding to the opening in the toilet. In this illustrated embodiment, the sheet product 2150 includes a finger assist perforation 2153*a* and a plurality of main perforations 2153*b*.

The finger assist perforation 2153*a* is shaped to correspond to a user's hand and/or finger such as to enable a user to reach their hand and/or finger through the finger assist perforation 2153*a* grab the sheet product and pull down to initiate the tear (e.g., along arrow $D_{Tear}$). In this regard, the finger assist perforation 2153*a* defines a curved portion corresponding to a shape of a finger or a hand.

As the tear begins traveling down, the end points of the finger assist perforation 2153*b* may encourage the tear to travel toward a first main perforation on each side of the shape (e.g., consider the end point 2158 to the first main perforation 2153*b*' on the left side of the shape). This will encourage proper tearing of the series of perforations 2153 to form the desired shape 2154.

With reference to FIG. 4G (which is a close up view of a portion of the perforation pattern shown in FIG. 4F), the main perforation 2153 may include a catch portion 2159 and a main portion 2157. The main portion 2157 defines a length extending from a start 2157*a* to an end 2157*b* along at least a portion of the periphery of the shape corresponding to the opening in the toilet seat. The catch portion 2159 extends from the start 2157*a* of the main portion 2157 and defines at least one branch portion 2159*a*, 2159*b* extending at a non-zero angle with respect to the main portion 2157 that is designed to redirect a tear in the sheet product toward the main portion 2157.

To explain, FIG. 4G illustrates progression of a tear through the left side of the series of perforations. After the tear 2189 travels down the first main perforation 2153*b*', the tear may continue along the sheet product 2150 through the bonded section (e.g., illustrated as 2189*a*). In some cases, the tear 2189*a* may not travel directly to the start 2157*a* of the main portion 2157 and, instead, may deviate (e.g., to the left or the right) through the sheet product 2150. In this regard, the branch portions 2159*a*, 2159*b* of the catch portion 2159 are designed to extend outwardly in one or more directions to "catch" and redirect the tear to the start 2157*a* of the main portion 2157 so that the tear then moves along the main portion 2157 and the proper shape 2154 is removed during removal of the series of perforations 2153. FIG. 4G illustrates that the tear 2189*a* is caught by the branch portion 2159*b* and redirected to the main portion 2157. Later after passing past the end 2157*b* of the main perforation 2153", the tear 2189*b* deviates left a bit, but is caught by the catch portion 2159" of the next main perforation 2153*b*'". This process continues until the desired shape 2154 is formed. Notably, by catching and redirecting the tear, undesirable errant tears into the remainder of the toilet seat cover are avoided and the desired and usable toilet seat cover is formed. This maintains a pleasant user experience and reduces waste that may occur if a tear rips a portion of the toilet seat cover and a user thus discards the toilet seat cover without use.

As illustrated in both FIGS. 4A and 4B, the predetermined portions may each include one or more markings 65. The markings 65 may be any form of mark that is detectable, such as by the mark detector(s) described herein. For example, the marking may define a 0.5 in. by 1 in. black rectangle, such as markings 65*a*, 65*b* shown in FIG. 4B, although other shapes/sizes are contemplated. In some embodiments, the markings may be positioned at predetermined locations on the predetermined portions. In such a manner, the predetermined locations may ensure alignment with the mark detector(s) during operation of the dispenser (e.g., so the mark detector can sense the marking). Additionally, however, knowing the predetermined location on the predetermined portion enables the dispenser (such as via a controller) to position the predetermined portions appropriately along the dispensing pathway (e.g., in the staged position or the dispensing position—such as described in greater detail herein).

In some embodiments, the markings may carry additional coding information. For example, the markings may be QR codes, or carry other coded features (e.g., colors, lengths, widths, spacing, etc.) that enable information to be determined based on sensor data from the mark detector(s) "reading" the markings. For example, in some embodiments, the markings may define a shape, size, color, or other features that enable verification of an installed authorized sheet product roll by the dispenser. In such a manner, the dispenser 10 may be configured to (such as through data received from the mark detector(s)) prevent or limit operation if an unauthorized sheet product roll is detected as being installed. In some embodiments, other information may be gathered from the data of the mark detector(s), such as may be useful for reporting and monitoring operation of the sheet product dispenser (e.g., for maintenance, for determining a remaining number of predetermined portions on the installed sheet product roll, among other things).

In some embodiments, the markings may be repeated one or more times on each individual predetermined portion. Such an example embodiment may help prevent missed markings by the mark detector (such as due to an off center predetermined portion, an errant fold, etc.). In some such embodiments, the mark detector may be configured to ignore counting multiple occurrences of a marking within a certain time threshold of each other.

In some embodiments, the predetermined portions may include printed indicia such as to help provide instructions or a user for converting the predetermined portion into a useable toilet seat cover (e.g., into a use configuration). For example, FIG. 4H illustrates an example predetermined portion 55' that includes a printed outline of a portion of the toilet seat 77' along with printings of an indication of the edge 72' surrounding a part of the portion 54' that is designed to be separated (e.g., the printed edge 72' may indicate where to "fold" the portion 54' so that it hangs into the toilet). Further, a printed arrow and water droplet 73' further illustrates how to manipulate the portion 54' when converting the predetermined portion 55'. Such printed indicia can provide visual clues for a user to determine how to separate the perforations to convert the predetermined portion into the use configuration, as well as how to properly position the converted predetermined portion on the toilet seat. FIG. 4I illustrates another example predetermined portion 55" with a printed full toilet seat outline 77" and corresponding other printed indicia 72" and 73" for helping a user convert the predetermined portion 55" using the portion 54". FIG. 4J illustrates another example predetermined portion 55''' with a printed flush mechanism 79''' and corresponding other printed indicia 73" for helping a user convert the predetermined portion 55''' using the portion 54''' and, thereafter, properly orienting the predetermined portion 55''' on the toilet seat (e.g., the printed flush mechanism 79''' can be positioned relative to the flush mechanism of the toilet).

In some embodiments, the sheet product may be pre-printed, such as with a pattern. In some such embodiments, the sheet product may be pre-printed with a pattern that makes an aesthetically pleasing appearance. For example, FIG. 4K shows example sheet product where three of the sheet products have been pre-printed, thereby illustrating the aesthetic effect. With reference to FIG. 4K, sheet product 2250*a* has been pre-printed with offset columns of grey dots; sheet product 2250*b* has been pre-printed with offset rows of blue dots (with less frequency of the dots); and sheet product 2250*c* has been pre-printed with offset rows of grey lines. In comparison, sheet product 2250*d* has not been pre-printed and is generally white. Testing has shown a preference by users for some level of patterned printing. Notably, various embodiments contemplate different features, such as differently sized dots or lines, different positions, or patterns, etc.

Example Dispensing Operations, Components, and Features

Notably, various embodiments of the present invention provide advantageous components/features that improve the dispensing quality and experience for users of sheet product dispensers (e.g., toilet seat cover dispensers). For example, due to the dispensed substrate being flushable and/or dispersible paper and the relatively long width of each predetermined portion, it can be important to ensure tearing the line of perforations appropriately to receive an intact dispense.

As such, some embodiments of the present invention provide an elongated chute (e.g., from the nip of the dispensing mechanism (e.g., dispensing mechanisms 121, 321 shown in and described with respect to FIGS. 33 and 34, respectively) to the end (e.g., exit) of the dispensing chute), which can help in ensuring a proper tear occurs when a user pulls on the leading predetermined portion that is in the dispensing position. The elongated chute may enable the line of perforations to be positioned along the dispensing pathway in the dispensing chute. In this regard, with the line of perforations past the nip, the user has the opportunity to separate the perforations by pulling on the leading predetermined portion that extends from the dispensing chute. Notably, however, the elongated portion of the chute still encloses and constrains lateral movement of a significant portion of the leading predetermined portion. This directs a user's pulling force by limiting side pulling of the predetermined portion (which is restricted due to being contained within the dispensing chute).

FIG. 5 illustrates a cross-sectional view of an example sheet product dispenser 10, showing an installed sheet product roll 50 on a roll holder 17. A leading predetermined portion 55*a* extends along a dispensing pathway 13 from the sheet product roll 50 into a dispensing nip 36 (defined between a drive roller 31 and a nip roller 33) and into the dispensing chute 18. In the illustrated embodiment, the elongated portion extends within the dispensing chute 18 from the nip 36 to an outlet 18*b*. Notably, in some embodiments, the elongated portion defines a length that is equivalent to or greater than the length of each of the plurality of predetermined portions. In some embodiments, the elongated portion defines a length that is between ~14 in. and 24 in. By having an elongated portion, once the leading predetermined portion is in the dispensing position (e.g., shown in FIG. 6), a significant portion of the length of the leading predetermined portion 55*a* is still within and constrained by the dispensing chute 18 so as to limit at least some degree of improper pulling—which may otherwise result in improper tearing of the predetermined portion 55*a* (and, thus, lead to potential wasting of the dispensed portion because it is considered unusable by the user).

In order to help define an elongated portion within the dispensing chute and still maintain the desirable footprint (e.g., shape and size) of the sheet product dispenser, some embodiments of the present invention provide certain relative positions of various components of the dispenser. For example, with reference to FIG. 5, the roll holder 17 of the dispenser 10 is positioned vertically below the nip 36 and an outlet 18*b* of the dispensing chute 18 is positioned vertically below the roll holder 17, wherein the dispensing pathway 13 leads upwardly from the roll holder 17 through the nip 36 and back down through the dispensing chute 18. Although shown in somewhat vertical alignment, in some embodiments, the components need not be vertically aligned and, instead, may just be vertically above and not in vertical alignment. By positioning such components in such relative positions, the sheet product dispenser 10 may maintain a relatively small depth and length, while still providing the desired length of the elongated portion of the dispensing chute.

FIG. 7 illustrates another example sheet product dispenser 810 the provides an elongated portion of the dispensing chute 818. The sheet product dispenser 810 includes a nip 836 defined by a drive roller 831 and nip roller 833. A sheet product roll 850 can be installed on the roll holder 817. The dispensing chute 818 defines an elongated shape that defines a first vertical portion 813*a*, a curved portion 813*b*, and a second vertical portion 813*c*, wherein the roll holder 817 is positioned vertically below the nip 836, wherein the dispensing pathway 813 leads upwardly from the roll holder 817 through the first vertical portion 813*a* and downwardly through the second vertical portion 813*c* toward an end 818*b* of the dispending chute 818. Like the sheet product dispenser 10, by positioning such components in such relative positions (and including a curved elongated portion), the sheet product dispenser 10 may maintain a relatively small depth and length, while still providing the desired length of the elongated portion of the dispensing chute.

In some embodiments, the sheet product dispenser may be configured to operate to cause staged dispensing of the sheet product. In this regard, staged dispensing may provide for a beneficial user experience despite there being a relatively long length of each predetermined portion and an elongated dispensing pathway (which may, otherwise, require a long waiting time for a user to receive a dispense as the user would have to wait for the entire length of the predetermined portion to dispense each time they activated the dispenser). For example, staged dispensing may help maintain hygiene by keeping the "next" leading predetermined portion inside the housing in a staged position until the user is actually present and ready to receive the dispense, while still providing a relatively short time period required for advancing the leading predetermined portion to a dispensing position at least partially outside of the housing.

FIGS. 5-6 illustrate an example staged dispensing approach. FIG. 5 illustrates a leading predetermined portion

55*a* in a staged position, where the leading edge 57*a* of the leading predetermined portion 55*a* is still within the dispensing chute 18 (and, thus, hygienically protected by the dispensing housing). In some embodiments, the trailing edge 58*a* is between the dispensing mechanism (e.g., the nip 36 of the dispensing mechanism) and the roll holder 17 when the leading predetermined portion 55*a* is in the staged position. In some embodiments, when in the staged position, the leading edge 57*a* of the leading predetermined portion 55*a* may be less than 6 in. from the outlet of the dispensing chute—thereby ensuring a relatively short amount of time required to move the leading edge 57*a* out of the dispensing outlet 18*b* upon operation of the motor and drive roller (although other distances are contemplated). In some embodiments, when in the staged position, the leading edge 57*a* of the leading predetermined portion 55*a* is hidden within the dispensing chute 18 so as to not be visible to a user (which may prevent a user from reaching into the dispensing chute 18). FIG. 6 illustrates the leading predetermined portion 55*a* in an example dispensing position, where the leading edge 57*a* of the leading predetermined portion 55*a* is positioned outside of the housing past the dispensing outlet 18*b*. Notably, however, when the dispensing position, the trailing edge 58*a* of the leading predetermined portion 55*a* is still within the dispensing chute 18. In some embodiments, when in the dispensing position, the trailing edge 58*a* may be positioned within the dispensing chute 18 so as to ensure that a significant portion of the leading predetermined portion 55*a* is still contained within the dispensing chute 18 (such as may help in ensuring a proper dispense occurs when a user pulls on the leading edge 57*a* of the leading predetermined portion 55*a*). In some embodiments, such as described in greater detail herein, the dispensing position may be designed such that the trailing edge 58*a* of the leading predetermined portion 55*a* aligns with one or more perforation tear assist features.

In some embodiments, when the leading predetermined portion 55*a* is in the dispensing position (FIG. 6), the trailing edge 58*a* (which is also where the leading edge 57*b* of the next leading predetermined portion 55*b* is) may be at a position within the dispensing chute that is further from an end of the dispensing chute than the position the leading edge 57*a* was in when the leading predetermined portion 55*a* was in the staged position (FIG. 5). In this regard, in some embodiments, after removal of the leading predetermined portion 55*a* from the dispensing position, the controller may operate (sometimes after a delay) to cause the motor to advance the next leading predetermined portion into the staged position (e.g., consider FIG. 5 again).

FIG. 7 illustrates another example dispensing position, this time for the leading predetermined portion 855*a* within the example sheet product dispenser 810. Similar to the dispensing position shown in FIG. 6, the leading edge 857*a* of the leading predetermined portion 855*a* is positioned outside of the outlet 818*b* of the dispensing chute 818 and the trailing edge 858*a* is positioned within the dispensing chute 818 with a significant portion of the leading predetermined portion 855*a* still within the dispensing chute 818.

Returning to the example of FIG. 6, with the leading predetermined portion 55*a* in the dispensing position, the "next" predetermined portion 55*b* is behind it in the dispensing pathway 13. Thus, upon removal of the leading predetermined portion 55*a*, the dispenser 10 may operate (e.g., automatically) to move the next predetermined portion 55*b* into the staged position (e.g., the position of the leading predetermined portion 55*a* shown in FIG. 5). In some embodiments, the controller may be configured to apply a delay time between removal of the leading predetermined portion 55*a* and initiation of the motor to position the next leading predetermined portion in the staged position. By instituting a delay, there may be reduced confusion for a user that has otherwise just removed the leading predetermined portion if there was audible noise associated with operation of the motor to move the next predetermined portion into the staged position.

In some embodiments, the dispenser 10 may include a chute sensor 41 associated with the dispensing chute 18 and configured to detect removal of the leading predetermined portion 55*a*. The controller (e.g., controller 111, 311 as shown in and described with respect to FIGS. 33 and 34, respectively) may be configured to determine, based on chute sensor data received from the chute sensor 41, that the leading predetermined portion 55*a* has been removed, and, in response, cause the motor (e.g., motor 122, 322 as shown in and described with respect to FIGS. 33 and 34, respectively) to operate to cause the sheet product to advance along the dispensing pathway to position the new leading predetermined portion 55*b* in the staged position.

In some embodiments, such as described above, the predetermined portions may have pre-printed markings thereon that can be "read" by one or more mark detectors along the dispensing pathway within the dispenser. Knowing the pre-set location of the markings on the predetermined portions and the location of the mark detector along the dispensing pathway, the controller may be configured to operate the motor for the amount of time needed to cause movement of the predetermined portion along the dispensing pathway such that the leading predetermined portion moves to the staged position or the dispensing position as desired. As an example, in some embodiments, the rotation of the drive roller may cause movement of the sheet product along the dispensing pathway. In this regard, using the known circumference of the drive roller, the amount of rotation of the drive roller (which can be controlled by the motor) provides the distance that the sheet product has traveled along the dispensing pathway. Further, the position of the mark detector and the known location of the marking on the predetermined portion can be used to determine how far the predetermined portion needs to travel along the dispensing pathway once the marking is detected. Thus, the controller may be configured to determine that detection of the marking has occurred and, then, operate the motor to cause the predetermined portion to travel the needed distance along the dispensing pathway to thereby position the predetermined portion in the desired position.

In some embodiments, perforation tear assist features are provided to help ensure that a user's pulling on the leading edge of the leading predetermined portion results in proper separation of the line of perforations between the predetermined portions to create a desired dispense with an intact toilet seat cover. Described herein are many different perforation tear assist features. Depending on the configuration of the dispenser and the perforation tear assist features, some of the perforation tear assist features may be used in conjunction with each other. Such example embodiments may provide an even greater chance of ensuring proper separation of the line of perforations between the leading predetermined portion and the next predetermined portion.

Notably, in some embodiments, the perforation tear assist feature may be configured to aid in removal of the leading predetermined portion along the line of perforations at the trailing edge of the leading predetermined portion. In some such example embodiments, the controller may be configured to cause the motor to operate to cause the leading predetermined portion to move into the dispensing position such that the trailing edge of the leading predetermined portion aligns with the perforation tear assist feature. In some embodiments, the markings on the predetermined portions and the corresponding mark detector within the dispenser may aid in such proper positioning.

With reference to FIG. 6, an example perforation tear assist feature includes one or more protrusions 80 (e.g., ribs) that are positioned within the dispensing chute 18, such as at one or more positions along the dispensing pathway 13. Each protrusion 80 may define a body portion 81 that extends into the dispensing pathway 13 and provides increased tension on the predetermined portion 55*a* when a user pulls on the leading predetermined portion 55*a* for a dispense. That increased tension may be directed toward the line of perforations at the trailing edge 58*a* to cause the perforations to spread apart as the user pulls on the predetermined portion—which is designed to aid in ensuring proper tearing of the perforations and, thus, providing the desired dispense. In some embodiments, a plurality of protrusions 80 extend along a width direction of the dispensing pathway. In other embodiments, one protrusion 80 may define a width that extends along at least a significant portion of the width of the dispensing pathway. Such example embodiments may help ensure that the desired tension is applied across at least a majority of the line of perforations.

In some embodiments, the controller may be configured to position the leading predetermined portion so as to align the line of perforations (e.g., at the trailing edge 58*a* of the leading predetermined portion 55*a*) with the one or more protrusions 80 when the leading predetermined portion is in the dispensing position (shown in FIG. 6). As detailed above, such accurate positioning may, for example, be accomplished using markings on the sheet product and a corresponding mark detector in the dispenser. In other embodiments, the one or more protrusions may be positioned anywhere in the dispensing chute 18 to provide the increased tension to aid in proper separation of the perforations and need not align with the line of perforations. Notably, in some embodiments, the one or more protrusions may be utilized in conjunction with other perforation tear assist features, such as the brake lever embodiment described herein and the electronic brake embodiment described herein, among others.

In some embodiments, the protrusions may be formed of a plurality of ribs that extend into the dispensing pathway. In some embodiments, one or more of the plurality of ribs may be positioned along the width direction of the dispensing chute so as to align with corresponding perforation openings in the line of perforations. In this regard, in some embodiments, increased tension may be applied directly to the perforation opening (such as due to the rib pushing thereon as the user pulls downwardly) to thereby assist in proper tearing of the line of perforations.

In some embodiments, the plurality of ribs may have varying heights that may, for example, help direct tearing during removal of the predetermined portion along the line of perforations. For example, FIG. 6A illustrates a schematic cross-sectional view of a portion of a dispensing chute, where a plurality of ribs with varying heights are shown. FIG. 6B illustrates the different heights of the plurality of ribs.

With reference to FIG. 6B, a width of the predetermined portion may extend in the dispensing chute over the plurality of ribs 2257. With varying heights, the outside most rib 2257*a* may extend furthest into the dispensing chute and be designed to apply the most tension at that corresponding position along the width of the predetermined portion (e.g., at the line of perforations) when the user pulls down on the leading edge of the leading predetermined portion to initiate a tearing along the line of perforations. Since the tension is highest at the edge, the tear is encouraged to begin at the edge. Then after the edge tears, the next rib from the outside 2257*b* is the next highest and now applies the most tension—thereby encouraging tearing to occur at that position. This continues, moving to rib 2257*c*, rib 2257*d*, and rib 2257*e*—encouraging tearing toward the center (e.g., along arrows $D_{TTC}$), as the same height regression occurs from the other side toward the center as well. This designed tear direction encouragement aids in proper tearing along the line of perforations. Although the illustrated plurality of ribs vary in reducing height toward the center, other formations are contemplated, such as only having a few ribs of different height, varying the heights from the left to right, varying the heights from the right to left, etc. In some embodiments, the perforation pattern along the line of perforations may be designed to align with the plurality of ribs, such as by having cuts of certain length designed to align with the plurality of ribs or certain ones of the plurality of ribs (e.g., at certain heights)—which may, thus, work together to encourage proper tearing along the line of perforations.

In some embodiments, the ribs may define varying gap distances between consecutive ribs along the width of the dispensing chute. Depending on the design of the positioning of the ribs, enabling different gap distances may provide for different focus points of tension along the width direction of the line of perforations—which may assist in proper tearing thereof. For example, with reference to FIG. 6C, the plurality of ribs 2257' may include a number of ribs extending across the width direction of the dispensing chute. Notably, a first gap distance $D_{Gap1}$ between two consecutive ribs 2257*b*' and 2257*c*' may be less than a second gap distance $D_{Gap2}$ between two consecutive ribs 2257*c*' and 2257*d*'. In this regard, increased tension may be focused on, such as on certain portions of the line of perforations—thereby assisting in proper tearing of the line of perforations.

Another example contemplated perforation tear assist feature includes providing a lever within the dispensing pathway that pivots downwardly when a user pulls on the leading predetermined portion to reveal one or more protrusions that align with the line of perforations to spread them apart to help ensure proper separation of the perforations. Such an example perforation tear assist feature is shown in FIGS. 8-9. With reference to FIG. 8, the dispenser 10' is shown with the leading predetermined portion 55*a* in the dispensing position with its leading edge 57*a* hanging outside of the dispensing chute 18. The perforation tear assist feature comprises a lever 82 (shown in close-up in FIG. 9) that is movable between a first position (shown in FIGS. 8 and 9) and a second position (not shown). The lever 82 comprises a body 87 with a top surface 83 and at least one hole 85 extending through the body 87 and the top surface 83.

The perforation tear assist feature further includes at least one projection 84 that extends toward the dispensing pathway 13 and into the hole 85 of the lever 82. This is best shown in FIG. 9. In some embodiments, the projection 84 may also be referred to as a "blade" or pointed structure—although it may not have a blade that results in cutting of the sheet product.

The top surface 83 is positioned above the projection(s) 84 with respect to the dispensing pathway 13 when the lever 82 is in the first position—thereby blocking the protrusion(s)

84 from contacting the sheet product in the dispensing pathway 13 and allowing advancement of the sheet product along the dispensing pathway 13. However, when the lever 82 is in the second position, the top surface 83 is positioned below a top 84*a* of the projection 84 with respect to the dispensing pathway 13 (e.g., the top surface 83 has moved downwardly such that the protrusion(s) 84 extend up through their corresponding hole(s) 85). In such a scenario, the top(s) 84*a* of the projection(s) 84 extend into the dispensing pathway 13.

In some embodiments, the lever 82 is configured to move to the second position when the user pulls on the leading predetermined portion 55*a* for removal thereof so as to enable the projection(s) 84 to contact the sheet product. For example, the lever 82 may be pivotably attached to the dispenser 10, such as between portions of the drive roller 31 (e.g., a pivot arm 86 connected to the body 87 extends from a rotational axis $P_L$—such as shown in FIG. 9). In this regard, when a user pulls downwardly on the leading predetermined portion 55*a*, the force on the front edge 83*a* of the lever 82 causes the lever 82 to rotate about the axis $P_L$—thereby moving the lever 82 to the second position and allowing the protrusion(s) 84 (which do not move) to contact the sheet product. When the protrusion(s) 84 contact the sheet product, they focus pressure onto the sheet product to aid in removal of the leading predetermined portion 55*a* via separation of the line of perforations at the trailing edge 58*a* of the leading predetermined portion 55*a*.

In some embodiments, the lever 82 is biased to the first position. In this regard, after removal of the leading predetermined portion, the lever is configured to return to the first position. In some embodiments, the lever 82 may be configured such that returning to the first position causes it to wipe any residue of the sheet product from the projection(s) 84.

In some embodiments, the body 87 comprises a plurality of holes 85 that align with a corresponding plurality of projections 84 extending along a width direction of the dispensing pathway 13. Further, in some embodiments, when the leading predetermined portion 55*a* is in the dispensing position, the plurality of projections 84 may be designed to align with a corresponding one of the lines of perforations of the leading predetermined portion 55*a*. As such, when the user pulls on the leading predetermined portion 55*a* for removal thereof, each of the plurality of projections 84 is designed to insert into the corresponding perforation to cause the perforation to spread (e.g., as the perforation is pulled down the tapered protrusion 84) so as to aid in removal of the leading predetermined portion 55*a* via separation of the line of perforations 51. Thus, in some embodiments, the controller may be configured to position the leading predetermined portion so as to align the line of perforations (e.g., at the trailing edge 58*a* of the leading predetermined portion 55*a*) with the protrusion(s) 84 when the leading predetermined portion is in the dispensing position (shown in FIG. 8).

A further example perforation tear assist feature includes a brake lever that is configured to interact with the sheet product such that when a user pulls on the leading predetermined portion, the brake lever pivots to engage and "brake" at least one of the drive roller or the nip roller to prevent further sheet product from being pulled through the nip. This also creates tension that can help ensure proper tearing of the line of perforations to ensure a proper dispense. Such an example perforation tear assist feature is shown in FIGS. 10-11B. With reference to FIG. 10, the dispenser 10" is shown with the leading predetermined portion 55*a* in the dispensing position with its leading edge 57*a* hanging outside of the dispensing chute 18. The perforation tear assist feature comprises a brake lever 90 movable between a first position (shown in FIG. 11A) and a second position (shown in FIGS. 10 and 11B). The brake lever 90 comprises a body 91 with a top surface 93 extending along the dispensing pathway 13 and a brake engagement feature 97.

In some embodiments, the brake lever 90 is pivotable between the first position and the second position, such as about the pivot axis 94. When the brake lever 90 is in the first position, the top surface 93 is adjacent to the dispensing pathway 13 and enables advancement of the sheet product along the dispensing pathway 13. When the brake lever 90 is in the second position, the brake engagement feature 97 engages with at least one of the drive roller or the nip roller to prevent further rotation thereof. For example, the brake engagement feature 97 may be configured to fit within at least one brake receive feature 37. The brake receive feature 37 is configured to receive and engage with the brake engagement feature 97 to prevent rotation of the drive roller 31 or nip roller 33. For example, with reference to FIG. 11B, with the brake lever 90 in the second position, the brake engagement feature 97 is seated against a ledge 37*a* of the brake receive feature 37 such that counterclockwise rotation of the drive roller 31 is prevented (e.g., counterclockwise rotation of the drive roller 31 may correspond to advancement of the sheet product along the dispensing pathway). In the illustrated embodiment, the brake receive feature 37 includes four ledges 37*a*, 37*b*, 37*c*, 37*d* that each radially extend from the center axis of the drive roller in different directions—thereby providing four different opportunities (during a full rotation) for the brake receive feature 37 to receive (e.g., catch) the brake engagement feature 97 when the brake lever 90 is moved to the second position. Although the illustrated embodiment provides the brake receive feature 37 on the drive roller, some embodiments of the present invention contemplate positioning the brake receive feature 37 on the nip roller 33 (which may, for example, cause some minor rearranging of various components).

In some embodiments, the brake lever 90 is configured to move to the second position when a user pulls on the leading predetermined portion 55*a* for removal thereof. This causes the nip 36 to hold the sheet product therein (e.g., between the drive roller and nip roller) without enabling further translation therethrough—thereby creating tension in the sheet product to aid in removal of the leading predetermined portion 55*a* via separation of the line of perforations at the trailing edge 58*a*. To explain, when a user pulls down on the leading predetermined portion 55*a*, the sheet product may contact a first edge 91*a* of the body 91 of the brake lever 90. This may cause the brake lever 90 to rotate about the pivot axis 94 to cause the brake engagement feature 97 to engage with the brake receive feature 37 to cause the "braking" of the drive roller 31 and prevent further advancement of the sheet product through the nip 36. This causes tension to be applied to the leading predetermined portion 55*a* (as the user is pulling and the brake is preventing further advancement), which may result in spreading of the perforations to encourage proper separation.

In some embodiments, in addition, when the user pulls on the leading predetermined portion 55*a* for removal thereof, tension is also focused at a position on the sheet product due to the contact between the first edge 91*a* of the brake lever 90 contacting the sheet product—which also may correspond to the trailing edge 58*a* of the leading predetermined portion 55*a* so as to further aid in removal via separation of the line of perforations at the trailing edge 58*a*. Thus, in some embodiments, the controller may be configured to position the leading predetermined portion so as to align the line of perforations (e.g., at the trailing edge 58*a* of the leading predetermined portion 55*a*) with the front edge 91*a* of the brake lever 90 when the leading predetermined portion is in the dispensing position (shown in FIG. 11B).

Notably, in some embodiments, the brake lever 90 is biased to the first position such that after removal of the leading predetermined portion 55*a*, the brake lever 90 is configured to return to the first position and enable rotation of the drive roller 31. In some embodiments, the brake lever 90 comprises a center of gravity that causes the brake lever 90 to bias to the first position via gravity. In some embodiments, the brake lever 90 is biased to the first position via a spring or other biasing mechanism. In some embodiments, the controller may be further configured to cause, after removal of the leading predetermined portion, the motor to operate in reverse to cause the brake engagement feature 97 of the brake lever 90 to disengage from the brake receive feature 37.

As noted herein, in some embodiments, the perforation tear assist feature of the brake lever 90 may be combined with other perforation tear assist features. For example, the use of the brake lever may be combined with positioning one or more protrusions (e.g., ribs) within the dispensing chute to provide, when the user pulls on the leading predetermined portion, further tension that is focused at a position on the leading predetermined portion so as to further aid in removal of the leading predetermined portion via separation of the line of perforations at the trailing edge.

In some embodiments, the motor may be designed to operate to hold its position to provide an electronic "brake" that may achieve a similar result as the "braking" achieved by the example brake lever feature. For example, in some embodiments, the controller may be configured to determine when the user pulls on the leading predetermined portion for removal thereof and cause, in response thereto, the motor to brake to prevent rotation of the drive roller. Such a braking action may hold the sheet product within the nip to prevent further translation through the nip and to create tension in the sheet product to aid in removal of the leading predetermined portion via separation of the line of perforations at the trailing edge. Such example embodiments may, in some cases, be combined with other perforation tear assist features, such as in conjunction with positioning one or more protrusions (e.g., ribs) within the dispensing chute to provide, when the user pulls on the leading predetermined portion, further tension that is focused at a position on the leading predetermined portion so as to further aid in removal of the leading predetermined portion via separation of the line of perforations at the trailing edge.

In some embodiments, a tear bar switch may be used to determine when a tear has occurred. An example tear bar switch 9099 is shown in FIG. 11B. As the user pulls on the leading predetermined portion, the brake lever rotates and interacts with the tear bar switch 9099 to indicate occurrence of a tear (e.g., occurrence of a dispense). Such data can be used in various features, such as counting the amount of product that has been dispensed, determining when a tear occurs, determining the amount of product remaining on an installed roll, confirming that the dispenser is operating properly, etc. Other example locations and interactions with tear bar switches are contemplated by various example embodiments.

In some embodiments, another example perforation tear assist feature of a brake roller may be used. The brake roller may be similar in operation to the brake lever. In this regard, the brake roller may be configured to interact with the sheet product such that when a user pulls on the leading predetermined portion, the brake roller moves to engage and "brake" at least one of the drive roller or the nip roller to prevent further sheet product from being pulled through the nip. This also creates tension that can help ensure proper tearing of the line of perforations to ensure a proper dispense. Such an example perforation tear assist feature is shown in FIGS. 12-12A.

With reference to FIG. 12, the dispenser 10''' is shown with the leading predetermined portion 55*a* in the dispensing position with its leading edge 57*a* hanging outside of the dispensing chute 18. The perforation tear assist feature comprises a brake roller 90''' movable between a first position and a second position (e.g., along line DBR). In this regard, in the first position, the brake roller 90''' extends further into the dispensing pathway 13 and is spaced apart from the one of the nip roller or the drive roller. Also, the brake roller 90''' may be free to rotate about its axis 91''' so as to allow free advancement of the sheet product. In the second position, the brake roller 90''' is engaged with the one of the nip roller or the drive roller so as to prevent or limit further rotation of the engaged nip roller or drive roller. In this regard, with reference to FIG. 12A, the brake roller 90'' may comprise a brake engagement feature 97', such as in the form of a rubber portion that is designed to interact with a corresponding brake receive feature 37''' of the nip or drive roller (in the illustrated embodiment, the drive roller 31 includes a rubber portion that acts as the brake receive feature 37''').

In some embodiments, the brake roller 90''' is configured to move to the second position when a user pulls on the leading predetermined portion 55*a* for removal thereof. This causes the nip 36 to hold the sheet product therein (e.g., between the drive roller and nip roller) without enabling further translation therethrough—thereby creating tension in the sheet product to aid in removal of the leading predetermined portion 55*a* via separation of the line of perforations at the trailing edge 58*a*. To explain, when a user pulls down on the leading predetermined portion 55*a*, the sheet product may contact a portion of the brake roller 90'''. This may cause the brake roller 90''' to move to the second position to cause the brake engagement feature 97''' to engage with the brake receive feature 37' to cause the "braking" of the drive roller 31 and prevent further advancement of the sheet product through the nip 36. This causes tension to be applied to the leading predetermined portion 55*a* (as the user is pulling and the brake is preventing further advancement), which may result in spreading of the perforations to encourage proper separation.

In some embodiments, in addition, when the user pulls on the leading predetermined portion 55*a* for removal thereof, tension is also focused at one or more positions on the sheet product due to the contact between one or more ribs 99''' of the brake roller 90''' contacting the sheet product—which also may correspond to the trailing edge 58*a* of the leading predetermined portion 55*a* so as to further aid in removal via separation of the line of perforations at the trailing edge 58*a*. Thus, in some embodiments, the controller may be configured to position the leading predetermined portion so as to align the line of perforations (e.g., at the trailing edge 58*a* of the leading predetermined portion 55*a*) with the one or more ribs 99''' of the brake roller 90' when the leading predetermined portion is in the dispensing position (shown in FIG. 12). In some embodiments, the one or more ribs 99''' may vary in height so as to create increased tension at certain positions along the line of perforations. Likewise, as shown in FIG. 12A, the one or more ribs 99''' may be positioned at different positions along the brake roller 90' and, in some cases, may be grouped together (e.g., rib 99*a*''', rib 99*b*''', and rib 99*c*''' form a group).

With continued reference to FIG. 12A, in some embodiments, consecutive ribs may be separated by a gap that corresponds to a reduced diameter for the brake roller 90'''. For example, such a gap 98''' is shown between ribs 99*a*''' and 99*b*'''. The gap may be beneficial in allowing a corresponding rib or other feature on the drive roller 31 to be inserted therein to enable the brake roller 90''' to move to the second position (and "brake" the drive roller 31 as described herein). Likewise, the drive roller 31 may include corresponding ribs 39*a*''', 39*b*''' and/or gaps 38*a*''', 38*b*''' to also enable such engagement.

Notably, in some embodiments, the brake roller 90''' is biased to the first position such that after removal of the leading predetermined portion 55*a*, the brake roller 90''' is configured to return to the first position and enable rotation of the drive roller 31. For example, in some embodiments, the brake roller 90''' is biased to the first position via a spring or other biasing mechanism.

As noted herein, in some embodiments, the perforation tear assist feature of the brake roller 90''' may be combined with other perforation tear assist features. For example, the use of the brake roller may be combined with positioning one or more protrusions (e.g., ribs) within the dispensing chute to provide, when the user pulls on the leading predetermined portion, further tension that is focused at a position on the leading predetermined portion so as to further aid in removal of the leading predetermined portion via separation of the line of perforations at the trailing edge.

In other embodiments, other perforation tear assist features may be employed. For example, with reference to FIGS. 13-14, the sheet product dispenser 210 may include two nips (a first nip 236 and a second nip 239) that can be used to "pop" or automatically separate the line of perforations at a trailing edge of a leading predetermined portion to ensure proper removal of the leading predetermined portion. The sheet product dispenser 210 may include many similar components and features as described with respect to sheet product dispenser 10. However, as noted above, the sheet product dispenser 210 may include two nips and two corresponding drive roller/nip roller combinations.

FIG. 13 illustrates the sheet product dispenser 210 with the leading predetermined portion 255*a* in the staged position, where the leading edge 257*a* is still within the dispensing chute 218. The dispensing pathway 213 may be defined, for example, from a sheet product roll 250 (e.g., installed on a roll holder) through a first nip 236 and subsequently through a second nip 239 and then out of the dispensing chute 218. In this regard, the second nip 239 is positioned downstream of the first nip 236 along the dispensing pathway 213. The first nip 236 is defined by contact between at least one drive roller 231 and at least one nip roller 233. The second nip 239 is defined by contact between at least one drive roller 237 and at least one nip roller 238. One or more motors (e.g., motor(s) 322 shown and described with respect to FIG. 34) may be configured to operate to drive one or more of the drive roller 231 or drive roller 237, including independently and/or simultaneously. In this regard, depending on the configuration the motor(s) may operate either or both of the drive rollers 231, 237 to advance the sheet product along the dispensing pathway 213 (e.g., to the staged position (shown in FIG. 13) or the dispensing position (shown in FIG. 14).

FIG. 14 illustrates the sheet product dispenser 210 with a leading predetermined portion 255*a* in the dispensing position such that a leading edge 257*a* is hanging outside of the dispensing chute 218. Notably, however, the trailing edge 258*a* (and the corresponding line of perforations between the leading predetermined portion 255*a* and the next predetermined portion 255*b*) is located within a perforation detachment zone 299 located between the first nip 236 and the second nip 239. As noted herein, the controller (e.g., the controller 311 shown in and described with respect to FIG. 34) may be configured to operate the motor(s) to appropriately position the leading predetermined portion 255*a* in the dispensing position, such as using one or more markings and one or more mark detectors—as further described herein.

With the trailing edge 258*a* and the corresponding line of perforations in the perforation detachment zone 299, the controller may be configured to operate the motor(s) to cause a different speed and/or a direction of rotation between the first and second nips to cause sufficient tension to form across the line of perforations (in the perforation zone 299) to cause separation of the line of perforations (and, thus, separation of the leading predetermined portion 255*a*). Depending on the configuration, the difference in speed can be accomplished in a number of different ways. For example, the motor can operate only the first drive roller 231 while holding the second drive roller 237 with no operation. Alternatively, the motor can operate only the second drive roller 237 while holding the second drive roller 231 with no operation. As a further alternative, the motor(s) can operate both drive rollers, but have them operate at different speeds. Additionally or alternatively, the motor(s) can operate one or more of the drive rollers in different directions (although in some cases that may be considered a negative speed and, thus, be a different speed in addition to being in a different direction). By automatically separating the line of perforations, the dispenser 210 can ensure proper separation—thereby negating any chance of user error that may occur during separation. In this regard, the use of the two nips provides a perforation tear assist feature.

Once the leading predetermined portion 255*a* is detached, it may be provided to a user. For example, in some embodiments, the second nip 239 may retain the leading predetermined portion 255*a* in place but enable a user to pull the leading portion therethrough to cause a dispense. Additionally or alternatively, the controller may operate the motor to cause the drive roller 237 of the second nip 239 to advance the detached leading predetermined portion 255*a* further along the dispensing pathway 213 for presentment to the user (such as to form a second, further dispensing position). The user can then retrieve the detached leading predetermined portion 255*a*. As is similar to the dispenser 10, after removal of the leading predetermined portion 255*a*, the controller of the sheet product dispenser 210 may be configured to operate one or more of the drive rollers 231, 237 to cause the next predetermined portion 255*b* to advance to the staged position (e.g., shown in FIG. 13).

In other example embodiments, the sheet product dispenser may employ other features and/or components to provide a perforation tear assist feature. For example, FIGS. 15-18 illustrate example different possible configurations for sheet product dispensers 410, 510, 610, 710 to provide a perforation assist feature. Notably, the example sheet product dispensers 410, 510, 610, 710 may include other components/features described herein, such as with respect to sheet product dispensers 10, 110, 210, 310.

With reference to FIG. 15, the example sheet product dispenser 410 includes a dispensing pathway 413 leading from a sheet product roll 450 through a nip 436 and a clamping mechanism 481. The nip 436 is defined by contact between at least one drive roller 431 and at least one nip roller 433. A motor may operate the drive roller 431 (e.g., through gears 421) to cause advancement of the sheet product along the dispensing pathway 413. With the leading predetermined portion 455*a* in the dispensing position, the controller may be configured to engage the clamping mechanism 481 such that the one or more of the first clamp 481*a* or the second clamp 481*b* moves toward each other to clamp down on the sheet product (e.g., at a point on the next predetermined portion 455*b* such that the trailing edge 458*a* of the leading predetermined portion 455*a* is downstream thereof). With the clamping mechanism 481 engaged, the user can pull on the leading predetermined portion 455*a*, which causes tension to form (e.g., due to the next predetermined portion 455*b* being held in place by the clamping mechanism 481) that aids in proper separation of the line of perforations at the trailing edge 458*a* of the leading predetermined portion 455*a*. In this regard, the clamping mechanism 481 provides a similar tension to the sheet product as in the above described embodiments that employ a brake. After removal of the leading predetermined portion 455*a*, the controller may operate to disengage the clamping mechanism 481 and operate the drive roller 431 to advance the next predetermined portion 455*b* along the dispensing pathway 413, such as to a staged position.

With reference to FIG. 16, the example sheet product dispenser 510 includes a dispensing pathway 513 leading from a sheet product roll 550 through a nip 536 and a clamping mechanism 581. The nip 536 is defined by contact between at least one drive roller 531 and at least one nip roller 533. A motor may operate the drive roller 531 (e.g., through gears 521) to cause advancement of the sheet product along the dispensing pathway 513. Notably, the sheet product dispenser 510 also includes a cutting mechanism 585 that is configured to cut the sheet product, such as to cause separation of a predetermined portion. Such cutting may occur with or without a preformed line of perforations. Further, different types of cutters are contemplated (e.g., rotary cutters, straight blades, saws, etc.), which may or may not include serration. In some embodiments, the cutting mechanism 585 may move between a disengaged position that enables advancement of the sheet product along the dispensing pathway 513 and an engaged position that provides for cutting of the sheet product.

With the leading predetermined portion 555*a* in the dispensing position, the controller may be configured to engage the clamping mechanism 581 such that the one or more of the first clamp 581*a* or the second clamp 581*b* moves toward each other to clamp down on the sheet product (e.g., at a point on the leading predetermined portion 555*a* such that the trailing edge 558*a* of the leading predetermined portion 555*a* is aligned with and held at the cutting mechanism 585). With the clamping mechanism 581 engaged, the controller may operate the cutting mechanism 585 to cause separation of the leading predetermined portion 555*a* at its trailing edge 558*a*. Thereafter, the controller may operate to disengage the clamping mechanism 581 so that the user can retrieve the now separate leading predetermined portion 555*a*. After removal of the leading predetermined portion 555*a*, the controller may operate the drive roller 531 to advance the next predetermined portion 555*b* along the dispensing pathway 513, such as to a staged position.

With reference to FIG. 17, the example sheet product dispenser 610 includes a dispensing pathway 613 leading from a sheet product roll 650 through a nip 636 and a clamping mechanism 681. The nip 636 is defined by contact between at least one drive roller 631 and at least one nip roller 633. A motor may operate the drive roller 631 (e.g., through gears 621) to cause advancement of the sheet product along the dispensing pathway 613. Notably, the sheet product dispenser 610 also includes a cutting mechanism 686 with a cutting block 687 that is configured to cut the sheet product, such as to cause separation of a predetermined portion. Such cutting may occur with or without a preformed line of perforations. Further, different types of cutters are contemplated (e.g., rotary cutters, straight blades, saws, etc.), which may or may not include serration. In some embodiments, the cutting mechanism 686 may move between a disengaged position that enables advancement of the sheet product along the dispensing pathway 613 and an engaged position that provides for cutting of the sheet product.

With the leading predetermined portion 655*a* in the dispensing position, the controller may be configured to engage the clamping mechanism 681 such that the one or more of the first clamp 681*a* or the second clamp 681*b* moves toward each other to clamp down on the sheet product (e.g., at a point on the leading predetermined portion 655*a* such that the trailing edge 658*a* of the leading predetermined portion 555*a* is aligned with and held at the cutting mechanism 686). With the clamping mechanism 681 engaged, the controller may operate the cutting mechanism 686 to cause separation of the leading predetermined portion 655*a* at its trailing edge 658*a*. Thereafter, the controller may operate to disengage the clamping mechanism 681 so that the user can retrieve the now separate leading predetermined portion 655*a*. After removal of the leading predetermined portion 655*a*, the controller may operate the drive roller 631 to advance the next predetermined portion 655*b* along the dispensing pathway 613, such as to a staged position.

With reference to FIG. 18, the example sheet product dispenser 710 includes a dispensing pathway 713 leading from a sheet product roll 750 through a first nip 736 and a second nip 739. The first nip 736 is defined by contact between at least one drive roller 731 and at least one nip roller 733. The second nip 739 is defined by contact between at least one drive roller 737 and at least one nip roller 738. A motor may operate one or more of the drive roller 731 (e.g., through gears 721) or the drive roller 737 (e.g., through a drive belt 723—although the motor could be separately rotationally connected to the drive roller 737) to cause advancement of the sheet product along the dispensing pathway 713. Notably, the sheet product dispenser 710 also includes a cutting mechanism 786 with a cutting block 787 that is configured to cut the sheet product, such as to cause separation of a predetermined portion. Such cutting may occur with or without a preformed line of perforations. Further, different types of cutters are contemplated (e.g., rotary cutters, straight blades, saws, etc.), which may or may not include serration. In some embodiments, the cutting mechanism 786 may move between a disengaged position that enables advancement of the sheet product along the dispensing pathway 713 and an engaged position that provides for cutting of the sheet product.

With the leading predetermined portion 755*a* in the dispensing position, the controller may be configured to operate the cutting mechanism 786 to cause separation of the leading predetermined portion 755*a* at its trailing edge 758*a*. Thereafter, a user may retrieve the now separate leading predetermined portion 755*a*, such as by pulling it through the second nip 739. After removal of the leading predetermined portion 755*a*, the controller may operate the one or more of the drive roller 731 or the drive roller 737 to advance the next predetermined portion 755*b* along the dispensing pathway 713, such as to a staged position.

In some embodiments, a sheet product dispenser may include a movable chassis that moves within the dispenser housing and changes the pathway of the sheet product within the dispensing chute to provide increased tension at an appropriate position along the sheet product (e.g., at the line of perforations at the trailing edge of the leading predetermined portion). For example, with reference to FIG. 19, an example sheet product dispenser 810 includes a movable chassis 880 that includes a contact roller 885 that is in the dispensing pathway and configured to rotate as the user pulls downwardly on the leading predetermined portion 855*a*'. Additionally, however, the movable chassis 880 is movable between a first position (shown) and a second position (not shown, but generally below the shown position as, for example, the rollers 883 move along the track 882). In this regard, the pulling force applied by the user causes the contact roller 885 and the movable chassis 880 to move downwardly. Accordingly, the leading predetermined portion being pulled on also changes positions. To explain, the leading edge of the leading predetermined portion extends outwardly from a stationary dispensing chute 818, but the position of the trailing edge 858*a* (which includes the line of perforations) moves from the first position (shown as 858*a*) to a second position (shown as 858*a*'). This provides an advantage because the trailing edge moves to a position corresponding to the downward bend—thereby providing increased tension at the trailing edge. Another benefit created by such an embodiment is that more of the leading predetermined portion is held within the dispenser housing until the user pulls on the leading predetermined portion—thereby helping ensure hygiene is maintained.

In some embodiments, the sheet product dispenser may include a perforation tear feature for tearing a series of perforations defining a shape corresponding to the opening in the toilet. In this regard, the center hole in the predetermined portion may be pre-torn and/or removed prior to a user receiving the predetermined portion. For example, a perforation popping feature, such as similar to various features described herein, may be employed to perform the tear and/or removal prior to and/or during dispensing of the leading predetermined portion.

FIGS. 20A-20B illustrate an example portion 3130 of a sheet product dispenser, where the portion 3130 includes a perforation tear assist feature for tearing at least some of the series of perforations defining a shape corresponding to the opening in the toilet (e.g., the central opening for the predetermined portion). The portion 3130 includes a set of outside sheet nip rollers 3134 that are configured to enable translation and holding of the predetermined portion (e.g., the portion of the predetermined portion on the outside of the central opening) through the dispensing chute. Additionally, popping rollers 3132 are angled (e.g., at about 45 degrees) and are configured to operate at a different speed (e.g., ~1.414 times faster) than the outside sheet nip rollers 3134. In this regard, the popping rollers 3132 may have separate motors 3133*a*, 3133*b*. Notably, the popping rollers 3132 are positioned to interact with the portion of the predetermined portion that is inside the series of perforations defining the central opening. In this way, as the predetermined portion passes through the dispensing chute (and through the rollers 3132 and 3134), the speed differential causes increased focused tension that at least partially separates the series of perforations defining the central opening.

FIGS. 21A-21B illustrate another example portion 4130 of a sheet product dispenser, where the portion 4130 includes a perforation tear assist feature for tearing at least some of the series of perforations defining a shape corresponding to the opening in the toilet (e.g., the central opening for the predetermined portion). The portion 4130 includes a set of outside sheet nip rollers 4134 that are configured to enable translation and holding of the predetermined portion (e.g., the portion of the predetermined portion on the outside of the central opening) through the dispensing chute. Additionally, a set of popping rollers 4132, 4136 are positioned to interact with the portion of the predetermined portion that is inside the series of perforations defining the central opening. Notably, while the first set of popping rollers 4132 are on the same axis of rotation as the outside sheet nip roller 4134, the second set of popping rollers 4136 are on a separate axis 4139. The motor 4133 may be configured to drive the second set of popping rollers 4136 at a different speed than the remaining rollers, and the friction between the second set of popping rollers 4136 and the first set of popping rollers 4132 may cause a speed differential that creates increased focused tension that at least partially separates the series of perforations defining the central opening as the predetermined portion passes through the dispensing chute (and through the rollers 3132, 3134, 3136).

FIG. 22 illustrates another example portion 5130 of a sheet product dispenser, where the portion 5130 includes a perforation tear assist feature for tearing at least some of the series of perforations defining a shape corresponding to the opening in the toilet (e.g., the central opening for the predetermined portion). The portion 5130 includes a first set of nip rollers 5132 that have a corresponding motor 5133 and extend across the width of a predetermined portion that is passing through the dispensing chute. The portion 5130 also includes a second set of nip rollers 5136 that have a corresponding motor 5137 and extend across the width of a predetermined portion that is passing through the dispensing chute. Further, the portion 5130 includes a third set of nip rollers 5134 that are positioned to interact with the only the portion of the predetermined portion that is inside the series of perforations defining the central opening. The third set of nip rollers 5134 also have a separate corresponding motor 5135. Depending on the configuration, in some embodiments, the first set of nip rollers 5132 may operate at a different speed (e.g., slower than) the second set of nip rollers 5136—which may cause increased tension in the predetermined portion between the first and second set of nip rollers 5132, 5136. In this regard, the third set of nip rollers 5134 (which is positioned between the first and second set of nip rollers 5132, 5136) may then operate to cause increased tension in the central opening to cause the corresponding series of perforations to separate. Depending on the design, the third set of nip rollers 5134 may be operated either slower, faster, or pulse on and off to aid in creating the tension to separate the series of perforations of the central opening.

In some embodiments, such as described herein, the size of the dispensing chute (e.g., from the nip to the dispensing outlet) can be beneficial for maintaining hygiene (e.g., by blocking access to at least a portion of the leading predetermined portion) and/or for directing how tearing of the line of perforations occurs (e.g., by limiting lateral movement and directing where the user can grab the leading predetermined portion). In this regard, it may be desirable to provide a specific range of available sheet product past the end of the dispensing chute for grasping by the user. For example, if too little is present then the user may not be able to generate enough force across the sheet product to initiate a proper tear, whereas if too much is present than an improper tear may occur by allowing too much leeway for the direction of the pull. Based on the designed dimension of the predetermined portion, it has been determined that a range of ~2 in. to 5 in. of length of exposed sheet product (with a preferred range of 2.5 in. to 3.5 in) is desirable for encouraging a proper dispense.

Notably, however, the length of the dispensing chute may need to be relatively long because the line of perforations at the trailing edge of the leading predetermined portion may need to be positioned past the nip so as to allow removal of the leading predetermined portion once the line of perforations has been torn. In this regard, the relative length of the dispensing chute with respect to the length of the predetermined portion may be important for obtaining such benefits.

In some embodiments, the housing of the sheet product dispenser is designed to obtain a beneficial ratio of the length of the predetermined portion to the length of the dispensing chute (e.g., from the nip to the dispensing outlet). An example length of the dispensing chute of an example sheet product dispenser 5010 is shown in FIG. 23 as "DC"—which extends from "$DC_{Start}$" at the nip 5031 (defined between the nip roller 5033 and the drive roller 5037) to the end of the chute 5018 at "$DC_{End}$". In the example illustrated embodiment, an extension portion 5017 extends in portions (e.g., the center) beyond the end of the chute 5018. As detailed herein, in some embodiments, an extension portion may not be present.

As an example, in some embodiments, a length of the predetermined portion of the sheet product roll is between 12 inches and 22 inches, and the desired ratio of the length of the predetermined portion of the sheet product roll to a length of at least a portion of the pathway leading from the nip to the dispensing outlet is between 0.5 and 1 so as to cover a portion of a leading predetermined portion when the leading predetermined portion is in a dispensing position such that the leading predetermined portion extends along the pathway past the nip and at least partially out of the dispensing outlet. In some embodiments, the ratio of the length of the predetermined portion of the sheet product roll to the length of at least the portion of the pathway is between 0.6 and 0.8.

In some embodiments, the ratio may be defined based on a desired amount of sheet product extending outwardly of the dispensing chute for a user to grasp (e.g., ~4 in.-6 in.). In some such embodiments, this may help dictate the desired length of the portion of the pathway leading from the nip to the dispensing outlet—as the length of the predetermined portion may be known.

With further reference to FIG. 23, in some embodiments, the sheet product dispenser 5010 may include a product level sensor, such as a fuel gauge arm 5079. The fuel gauge arm 5079 may define a paddle section that rests against the outer circumference of the roll of sheet product 5050. As the sheet product is depleted, the paddle rotates about an axis inward toward the roll of sheet product 5050. That movement is measured and utilized to determine the remaining amount of product left on the roll 5050. The product level data may be monitored and utilized for various functionality, such as informing a maintainer of a need for a replacement roll of sheet product. Notably, a fuel gauge arm is just one example product level sensor, as other types are contemplated, such as an infrared sensor, time-of-flight sensor, mechanical switch(es), etc.

In some embodiments, the sheet product dispenser may include an extension portion (e.g., a chute extension) that extends from the housing to further elongate the dispensing chute and define/direct removal of the leading predetermined portion by the user. In some embodiments, the extension portion may extend the dispensing pathway a desired distance, such as at least 4 in. (although other distances are contemplated by embodiments of the present invention). In some embodiments, the extension portion may be designed to leave exposed a certain width of sheet product, which may have been determined to be desirable for encouraging a proper tear. In this regard, in some embodiments, a desirable range of available width of sheet product to grasp is ~4 in. to 6 in. (with a preferred width of ~5 in.).

With reference to FIGS. 24A-24B, an example sheet product dispenser 1010 includes a housing 1011 with an extension portion 1019 extending downwardly therefrom and thereby extending the dispensing pathway. As shown in FIG. 24B, the extension portion 1019 defines an elongated body 1019*a* with an outlet 1019*b*. The body 1019*a* extends downwardly from the housing 1011 of the dispenser 1010. The extension portion 1019 attaches to the housing 1011 in alignment with the dispensing pathway such that the leading predetermined portion 1055*a* is configured to advance such that its leading edge 1057*a* extends outwardly from the outlet 1019*b* (such as shown in FIG. 24A). In some embodiments, by providing an extension portion, more of the leading predetermined portion 1055*a* may be covered while in the dispensing position. This essentially extends the elongated dispensing chute and further limits the ability of user to improperly pull on the leading predetermined portion during dispensing (e.g., more of the leading predetermined portion 1055*a* is constrained by the extension portion 1019).

In the illustrated embodiment, instructions 1017 are printed on the extension portion 1019 to help direct a user as to how to properly use a dispensed predetermined portion (e.g., toilet seat cover). Notably, other images/instructions are contemplated by various embodiments of the present invention.

In some embodiments, different shapes may be used to block access to certain portions of the leading predetermined portion—thereby forcing removal using the exposed portions. For example, FIGS. 25A-25C illustrate example sheet product dispensers 1110, 1110', 1110" that each include a differently shaped extension portion 1119, 1119', 1119", respectively.

With reference to FIG. 25A, the sheet product dispenser 1110 includes a housing 1111 and an outlet for the dispensing chute 1118. The extension portion 1119 extends downwardly from the dispensing chute 1118 and defines a shape (e.g., a downwardly extending isosceles trapezoidal shape) that enables access for a user to grasp either side 1152*a*, 1152*b* of the leading predetermined portion 1155*a* in the dispensing position. In this regard, the extension portion 1119 defines a width (which may be defined as an average or as a width (e.g., $W_{EP1}$) across a specific portion of the extension portion 1119) that is less than a width of the leading predetermined portion 1155*a* such that the extension portion covers a portion of the leading predetermined portion 1155*a* without covering at least one remainder portion (e.g., 1152*a*, 1152*b*) of the leading predetermined portion 1155*a*. This forces a user to grasp the exposed portions (e.g., the remainder portions) of the leading predetermined portion 1155*a* and, thus, limits the pulling directions that the user can accomplish—thereby limiting the user from potentially forming an improper separation of the leading predetermined portion 1155*a*.

With reference to FIG. 25B, the sheet product dispenser 1110' includes a housing 1111' and an outlet for the dispensing chute 1118'. The extension portion 1119' extends downwardly from the dispensing chute 1118' and defines a shape (e.g., a rectangular shape with curved edges) that enables access for a user to grasp either side 1152*a*', 1152*b*' of the leading predetermined portion 1155*a*' in the dispensing position. In this regard, the extension portion 1119' defines a width (which may be defined as an average or as a width (e.g., $W_{EP2}$) across a specific portion of the extension portion 1119') that is less than a width of the leading predetermined portion 1155*a*' such that the extension portion covers a portion of the leading predetermined portion 1155*a*' without covering at least one remainder portion (e.g., 1152*a*', 1152*b*') of the leading predetermined portion 1155*a*'. This forces a user to grasp the exposed portions (e.g., the remainder portions) of the leading predetermined portion 1155*a*' and, thus, limits the pulling directions that the user can accomplish—thereby limiting the user from potentially forming an improper separation of the leading predetermined portion 1155*a*'.

With reference to FIG. 25C, the sheet product dispenser 1110" includes a housing 1111" and an outlet for the dispensing chute 1118". The extension portion 1119" extends downwardly from the dispensing chute 1118" and defines a shape (e.g., a right trapezoidal shape with curved edges) that covers one side 1152*a*" and enables access for a user to grasp the other side 1152*b*" of the leading predetermined portion 1155*a*" in the dispensing position. In this regard, the extension portion 1119" defines a width (which may be defined as an average or as a width (e.g., $W_{EP3}$) across a specific portion of the extension portion 1119") that is less than a width of the leading predetermined portion 1155*a*" such that the extension portion covers a portion of the leading predetermined portion 1155*a*" without covering at least one remainder portion (e.g., 1152*b*") of the leading predetermined portion 1155*a*". This forces a user to grasp the exposed portions (e.g., the remainder portions) of the leading predetermined portion 1155*a*" and, thus, limits the pulling directions that the user can accomplish—thereby limiting the user from potentially forming an improper separation of the leading predetermined portion 1155*a*". In this illustrated embodiment, a user is forced to grasp the leading predetermined portion from a certain side only (as the other side is covered).

In some embodiments, the sheet product dispenser may be configured to provide a notification for a user to know when it is ok to pull on the leading predetermined portion to perform removal thereof. For example, it has been determined that premature pulling on the leading predetermined portion (e.g., before the leading predetermined portion reaches the dispensing position) leads to a greater risk of performing an improper separation. As such, in some embodiments, the controller may be configured to provide a notification (e.g., emit a green light, such as from a light source on the housing) to indicate that the leading predetermined portion has reached a position where it is appropriate for the user to begin pulling thereon. In some embodiments, the controller may provide a notification (e.g., emit a red light) to indicate that the user should not yet pull on the leading predetermined portion. Notably, other forms of notifications can be used instead of lights, such as known to those of ordinary skill in the art (e.g., audible alerts, text, etc.).

FIGS. 26A-B illustrate an example sheet product dispenser 1210 that includes a light source 1226. As illustrated, while the leading predetermined portion 1255*a* is still advancing along the dispensing pathway out of the dispensing chute 1218 (such as shown in FIG. 26A), there is no light emitted (although there could be a red light or other "do not pull" notification). However, once the leading predetermined portion 1255*a* reaches the dispensing position such that its leading edge 1257*a* has extended further out of the dispensing chute 1218, a light (e.g., a green light) can be emitted from the light source 1226—thereby indicating that it is now OK for a user to pull on and remove the leading predetermined portion 1255*a*.

Notably, a further contemplated beneficial feature of various example sheet product dispensers described herein includes providing various monitoring and reporting capabilities. For example, the sheet product dispenser may include a communication interface (e.g., the communication interface 113, 313 shown in and described with respect to FIGS. 33 and 34, respectively). A controller (e.g., the controller 111, 311 shown in and described with respect to FIGS. 33 and 34, respectively) may be configured to transmit data using the communication interface to a remote device/server, such as for various reporting features. For example, data from the mark detector(s) may be sent to the remote device/server. Additionally or alternatively, other data (e.g., data from other sensors or the controller, such as various counts of dispenses or motor rotations) may be sent to the remote device/server. Such data may be utilized (e.g., by the controller or the remote device/server) to determine various information, such as the remaining number of predetermined portions on an installed sheet product roll, an estimated time when the sheet product roll will be depleted, the time since last roll replacement, the time since the last dispense, the number of dispenses within a time period (e.g., hour, day, etc.), the battery status, and a jam status of the dispenser. Along these lines, the data can be used to perform various functions, such as to form reports, determine the operational status of the dispenser, determine or perform maintenance for the dispenser, determine or perform inventory management for the dispenser (or a corresponding environment in which the dispenser is mounted—e.g., the inventory for the building), among other things.

As detailed herein, the sheet product dispenser may include a roll holder that is configured to receive and hold the sheet product roll. FIG. 27A illustrates an example roll holder 1317 that can be used with various example sheet product dispensers described herein. In some embodiments, the roll holder 1317 (or portions thereof) may be included (e.g., built-in) to various structures (e.g., the housing) of some example sheet product dispensers. Returning to FIG. 27A, the roll holder 1317 may include a first roll holder receiving portion 1317*a* configured to receive and hold a first side of the sheet product roll 1350 and a second roll holder receiving portion 1317*b* configured to receive and hold an opposite second side of the sheet product roll 1350.

With reference to FIG. 27B, the sheet product roll 1350 may include a plug 1350*a* on one side that is configured to fit within a central opening of the sheet product roll 1350. Additionally, the plug 1350*a* may be configured to be received and held by the first roll holder receiving portion 1317*a*. For example, with reference to FIG. 27C, the first roll holder receiving portion 1317*a* may include a center receptacle portion 1365 that is configured to hold a corresponding protrusion of the plug 1350*a*, while still enabling rotation of the plug 1350*a* therein.

The other side of the sheet product roll, in the illustrated embodiment, does not include a plug and may instead rely on the central opening of the sheet product roll to fit within a corresponding center projection 1375 of the second roll holder portion 1317*b* (shown in FIG. 27D).

Using such example embodiments, during installation of a new sheet product roll, a user may fit the protrusion of the plug 1350*a* into an insertion slot 1362 of the first roll holder receiving portion 1317*a* and past the snaps 1366 into the center receptacle portion 1365 (the snaps 1366 may flex outwardly to allow the plug to fit past them and then return to their biased position to help retain the plug 1350*a* in the center receptacle portion 1365). On the other side, the central opening of the sheet product roll 1350 may push the center projection 1375 of the second roll holder receiving portion 1317*b* inwardly (e.g., the center projection 1375 is cantilevered due to its arm 1376). Once the central opening is properly aligned, the center projection 1375 may return to its original position which may now be partially inside the central opening of the sheet product roll 1350—thereby helping hold the sheet product roll in place. Notably, a benefit of utilizing a sheet product roll with a plug on only one side, is that the user is forced to install the sheet product roll in only one orientation, which can be used to dictate whether the leading edge of the sheet product extends from the top or the bottom of the installed sheet product roll. This can help in determining (and perhaps counteracting) how curl is formed on the sheet product as it travels through the dispenser. Further, it may also help with aligning the markings with the mark detector (e.g., make sure the markings are on the correct side of the sheet product dispenser).

With the sheet product roll installed in the roll holder, the leading edge of the sheet product roll may be fed through the nip. In some embodiments, the motor can be operated to help feed the leading edge past the nip so that the sheet product dispenser is primed and ready for dispensing. In some embodiments, one or more buttons or other user inputs can be operated during installation to assist with priming of the sheet product dispenser.

The user can simply remove the sheet product roll by pulling it outwardly from the roll holder receiving portions 1317*a*, 1317*b*.

In some embodiments, the cover of the sheet product dispenser may be configured to open, such as to enable a user (e.g., a maintainer) to access various components of the sheet product dispenser and/or perform maintenance thereon (e.g., install a replacement roll of sheet product, clear a jam, etc.). In some embodiments, the cover may be configured to open upwardly, such as may be preferable based on the anticipated surroundings for the sheet product dispenser (e.g., the sheet product dispenser may be installed above a toilet)—although other directions of opening are contemplated (outwardly to the left and/or right, downwardly, etc.). FIGS. 28A-28B illustrate an example sheet product dispenser 6010 that includes a cover 6012 that opens upwardly (e.g., the cover rotates upwardly about an axis 6013 located near a top of the sheet product dispenser—as shown). In some embodiments, one or more features may be provided to help keep the cover in the open position to prevent the user from having to hold the cover open. For example, with reference to FIG. 30, another example sheet product dispenser 7010 includes a spring 7069 that biases the cover 7012 to the open position (e.g., the cover 7012 has been rotated upwardly about the axis 7068). Notably, some embodiments of the present invention contemplate other features for maintaining the cover in the open position, such as one or more ratchet-type ribs (e.g., friction hinges) that interact with the rotation of the cover to hold the cover in the open position until the rib is overcome (e.g., as the user rotates the cover back down to the closed position). Another example feature may include a movable brace arm that can be used to prop open the cover (e.g., similar to a hood of a car).

In some embodiments, the sheet product dispenser may include a lock feature (e.g., lock feature 2098 shown in FIG. 1A) near the bottom of the cover so that the lock interacts with the distal end of the cover (when the cover is in the closed position)—although other locations for the lock feature are contemplated. Depending on the desired security configuration, the lock feature may form an "unlocked" press button or a lock (e.g., unlockable with a key). In some embodiments, the user (e.g., maintainer) may choose which type of lock feature to utilize (as both options may be provided with each sheet product dispenser).

In some embodiments, the sheet product dispenser may include a chassis for holding one or more components (e.g., of various components described herein). The chassis may be mountable internal (or at least partially internal) to the housing and may enable maintenance by a user (e.g., a maintainer). For example, the chassis may house one or more components, such as the controller or sensors, and the user may be able to replace or fix such components in the chassis. In some embodiments, the chassis may be replaceable for easy upgrade or maintenance. For example, the user (e.g., maintainer) may be able to swap out the chassis for a new chassis.

FIG. 28A-28B illustrate an example sheet product dispenser 6010 with a chassis 6062. To access the chassis 6062, the user may open the cover 6012 (e.g., upwardly as shown). Once the cover 6012 is in the open position, the chassis 6062 may be revealed such that a user (e.g., a maintainer) may access the chassis 6062. In some embodiments, the chassis 6062 may include one or more roll holders 6017 configured to receive and hold a roll of sheet product 6050 (such as described herein). The user may install the roll of sheet product 6050 in the roll holders 6017 and feed a leading edge of the sheet product in a nip 6031 to prime the sheet product dispenser 6010 for dispensing therefrom.

With reference to FIG. 29, once the leading edge of the sheet product is positioned near the nip 6031, a user may initiate a feed operation to cause the motor to operate to pull the leading edge through the nip 6031 and prime the sheet product dispenser 6010 for the next dispense (e.g., the leading predetermined portion may be positioned into a staged position for dispensing). In some embodiments, the feed operation may be utilized to cause a dispense to occur (e.g., the leading predetermined portion 6055 can be positioned into a dispensing position, such as out of the dispensing chute 6018—as shown in FIG. 28B). Thus, the leading predetermined portion 6055 may be ready for removal by a user.

Returning to FIG. 29, the chassis (or other portion of the sheet product dispenser) may include one or more buttons or other user interface features. For example, a portion 6063 of the chassis may include a feed toggle 6066, such as may include an option to Advance Feed (e.g., make the motor operate to translate sheet product along the dispensing pathway through the nip 6031) and an option to Reverse Feed (e.g., make the motor operate in reverse to retract sheet product along the dispensing pathway through the nip 6031). Another example user interface feature is a sensor range toggle 6067 that enables selection of various hand sensor ranges (e.g., short, medium, long, etc.) for sensing a user's hand in order to initiate a dispense. Notably, various embodiments of the present invention contemplate other user interface features (e.g., buttons, touchscreen, switches, etc.) and corresponding other operations (e.g., setting a length of sheet product to hang past the dispensing chute, setting a delay between dispenses, etc.).

In some embodiments, the chassis may be movable while still being attached to the housing (or other portion of the sheet product dispenser). Depending on the arrangement of the dispensing pathway, such as described herein, in some embodiments, the sheet product may be configured to pass behind the chassis and down out of the dispensing chute (see e.g., the dispensing pathway illustrated in FIG. 23). Notably, however, there may be a chance of an occurrence of a jamming scenario (such as may be due to an extended distance of travel of the sheet product within the dispensing chute). With the chassis in the way, however, it may difficult for a maintainer to clear the jam. In such a regard, in some embodiments, the chassis may be configured to move between a stowed position and an unstowed position, where a maintainer may access at least a portion of the dispensing chute when the chassis is in the unstowed position. For example, with reference to FIG. 31, an example sheet product dispenser 8010 includes a housing with a cover 8012 that is shown in the open position. Further, a chassis 8062 is shown in an unstowed position, having been rotated (e.g., along arrow $C_{OPEN}$) from the stowed position (an example stowed position is illustrated in FIGS. 28A-B). In the illustrated embodiment, the chassis 8062 has been rotated about an axis 8061, although other movable connection features and options are contemplated. With the chassis 8062 in the unstowed position, the user has access to the dispensing chute 8018, such as to clear a jam (e.g., illustrated as bunched sheet product 8056). Once cleared, the user may close the chassis 8062 to the stowed position and reset the sheet product dispenser 8010 for the next dispense. FIG. 32 illustrates another example sheet product dispenser 9010 with an open cover 9012 and base portion 9014. The sheet product dispenser 9010 also includes a chassis 9062, shown in the unstowed position. In this illustrated embodiment, the chassis 9062 has been rotated downwardly about an axis 9061.

Example System Architecture(s)

A schematic representation of components of an example sheet product dispenser system 100 according to various embodiments described herein is shown in FIG. 33. It should be appreciated that the illustration in FIG. 33 is for purposes of description and that the relative size and placement of the respective components may differ. The sheet product dispenser system 100, which includes a product dispenser 110 (e.g., a sheet product dispenser according to various embodiments described herein), includes components and systems that are utilized in various embodiments described herein.

The product dispenser 110 may include many different components and/or systems (such as shown in FIG. 33), including, for example, a controller 111, a dispensing mechanism 121 that includes a motor 122 and one or more rollers 132 (e.g., drive roller(s) and/or nip roller(s)), a memory 112, a communication interface 113, one or more user interfaces 114, a power system 116, one or more activation sensors 120, other sensors 125 (e.g., a product sensor), mark detector(s) 140, chute sensor(s) 170, and other system(s)/sensor(s) such as described herein. Though shown in FIG. 33 as being a component of the product dispenser 110, such components are not required to be part of the product dispenser 110 according to various embodiments herein. For example, product dispensers of various embodiments described herein may include different components, but still function according to the desired embodiment. For example, some embodiments may include more than one product roll 150 and, in some cases, may include additional sets of components (e.g., additional reservoirs, additional dispensing mechanism, additional pumps, etc.). Further, other components/features described in various embodiments herein may also be included. For example, the sheet product dispenser 110 may include various clamp mechanisms, cutting mechanisms, light sources, or other described features. Along these lines, the depicted embodiment of FIG. 33 is provided for explanatory purposes and is not meant to be limiting.

As will be described in more detail herein, the controller 111 provides logic and control functionality used during operation of the product dispenser 110. Alternatively, the functionality of the controller 111 may be distributed to several controllers that each provides more limited functionality to discrete portions of the operation of product dispenser 110.

The product dispenser 110 may be configured to hold a full sheet product roll, such as the flushable and/or dispersible paper rolls described herein. For example, the depicted product dispenser 110 includes a cavity configured to receive and hold a product roll 150.

The activation sensor(s) 120 may be configured to sense/receive user input (such as a user's hand or portion thereof) indicating a desire to cause the product dispenser 110 to dispense a predetermined portion of sheet product (e.g., from the product roll 150)—e.g., a dispense request. The activation sensor(s) 120 may be any type of sensor or feature capable of receiving user input to begin dispensing, including for example, a capacitive sensor, a light sensor, an IR sensor, a mechanical lever or button, etc. The activation sensor(s) 120 may be in communication with the controller 111 such that the controller 111 can determine when to cause dispensing of the sheet product (e.g., advancement of the leading predetermined portion to the dispensing position).

The dispensing mechanism 121 may be configured to cause dispensing of a portion of the sheet product, such as a predetermined portion of the sheet product roll 150. Depending on the configuration, the dispensing mechanism 121 may comprise one or more motor(s) 122 that drive one or more rollers 132 (e.g., the drive roller(s) described herein). In the dispensing mechanism, a portion of the product roll may be sandwiched (e.g., in frictional contact) between a drive roller and a nip roller such that operation/rotation of the drive roller causes advancement of the sheet product along the dispensing pathway. The dispensing mechanism motor 122 may be in communication with the controller 111 such that the controller 111 may control operation of the motor 122.

The chute sensor(s) 170 may be positioned relative to an outlet of the sheet product dispenser 110 and configured to sense the sheet product. In some embodiments, the chute sensor(s) 170 may be configured to sense the leading edge of the sheet product. In some embodiments, the chute sensor(s) 170 may be configured to utilize IR sensing capabilities. In some embodiments, however, other types of sensors may be utilized (e.g., capacitive sensors, light sensors, mechanical sensors, etc.). The chute sensor(s) 170 may be in communication with the controller 111 such that the controller 111 may determine when product is present or absent. In this regard, the controller 111 may be configured to utilize the information from the chute sensor(s) 170 for operation of the motor as described herein.

The mark detector(s) 140 may be positioned along the dispensing pathway of the dispenser 110 and aimed at the dispensing pathway so as to enable detection (e.g., "reading") of one or more markings that are pre-formed or printed on the sheet product. In this regard, the mark detector(s) 140 may be configured to utilize known detection technology to determine one or more characteristics regarding the markings on the sheet product. For example, the mark detector(s) 140 may comprise one or more optical readers, cameras, reflective infrared, or the like so as to enable detection of the markings. In some embodiments, the mark detector(s) 140 may be configured to detect the occurrence of the markings. Additionally or alternatively, the mark detector(s) 140 may be configured to detect one or more characteristics of the markings (e.g., color, width, length, position, spacing within the marking, among other things). For example, in some embodiments, the mark detector(s) 140 may be configured to "read" or decode a marking, such as in the instance in which the marking forms a barcode or quick response (QR) code. The mark detector(s) 140 may be in communication with the controller 111 such that the controller 111 may receive the data from the mark detector(s) 140 and perform various operations accordingly (e.g., operate the motor 122, transmit data to a remote device/server using the communication interface 113, etc.).

The controller 111 is a suitable electronic device capable of executing dispenser functionality via hardware and/or software control, with the preferred embodiment accepting data and instructions, executing the instructions to process the data, and presenting the results. Controller 111 may accept instructions through the user interface 114, or through other means such as, but not limited to, the activation sensor(s) 120, other sensors, voice activation means, manually-operable selection and control means, radiated wavelength and electronic or electrical transfer. Therefore, the controller 111 can be, but is not limited to, a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a solid-state computer, a single-board computer, a buffered computer, a computer network, a desktop computer, a laptop computer, a personal digital assistant (PDA) or a hybrid of any of the foregoing.

The controller 111 may be operably coupled with one or more components of the product dispenser 110. Such operable coupling may include, but is not limited to, solid-core wiring, twisted pair wiring, coaxial cable, fiber optic cable, mechanical, wireless, radio, and infrared. Controller 111 may be configured to provide one or more operating signals to these components and to receive data from these components. Such communication can occur using a well-known computer communications protocol such as Inter-Integrated Circuit (I2C), Serial Peripheral Interface (SPI), System Management Bus (SMBus), Transmission Control Protocol/Internet Protocol (TCP/IP), RS-232, ModBus, or any other communications protocol suitable for the purposes disclosed herein.

The controller 111 may include one or more processors coupled to a memory device 112. Controller 111 may optionally be connected to one or more input/output (I/O) controllers or data interface devices (not shown). The memory 112 may be any form of memory such as an EPROM (Erasable Programmable Read Only Memory) chip, a flash memory chip, a disk drive, or the like. As such, the memory 112 may store various data, protocols, instructions, computer program code, operational parameters, etc. In this regard, controller 111 may include operation control methods embodied in application code. These methods are embodied in computer instructions written to be executed by one or more processors, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

In this regard, in some embodiments, the controller 111 may be configured to execute computer program code instructions to perform aspects of various embodiments of the present invention described herein.

The user interface 114 may be configured to provide information and/or indications to a user. In some embodiments, the user interface 114 may comprise one or more light emitting diodes (LEDs) to indicate such information (e.g., low battery, dispensing is occurring, low product amount, etc.). In some embodiments, the user interface 114 may include a screen to display such information. In some embodiments, the user interface 114 may be configured to receive user input such as through a keypad, touchscreen, buttons, or other input device. The user interface 114 may be in communication with the controller 111 such that the controller 111 can operate the user interface 114 and/or receive instructions or information from the user interface 114.

The communication interface 113 may be configured to enable connection to external systems (e.g., an external network 102). In this manner, the controller 111 may retrieve data and/or instructions from or transmit data and/or instructions to a remote, external device/server via the external network 102 in addition to or as an alternative to the memory 112.

In an example embodiment, the electrical energy (e.g., power 116) for operating the product dispenser 110 may be provided by a battery, which may be comprised of one or more batteries arranged in series or in parallel to provide the desired electrical energy. Additionally or alternatively, the power 116 may be supplied by an external power source, such as an alternating current ("AC") power source or a solar power source, or any other alternative power source as may be appropriate for an application.

The other sensor(s)/system(s) 125 may be any other type of sensors or systems that are usable in various embodiments of the present invention. Some example additional sensors or systems include a position sensor, a time sensor, a product sensor, a jam sensor (such as may be positioned within the dispensing chute), among many others.

FIG. 34 illustrates a schematic representation of components of another example sheet product dispenser system 300 according to various embodiments described herein. Notably, the sheet product dispenser system 300 and its components are similar to and, where appropriate, are the same as (or provide the same functionality as) the sheet product dispenser system 100 and its components (as shown in and described with respect to FIG. 33). In this regard, the product dispenser 310 may include many different components and/or systems, including, for example, a controller 311, a dispensing mechanism 321 that includes one or more motors 322 and one or more first rollers 332 (e.g., drive roller(s) and/or nip roller(s)) and second rollers 334 (e.g., drive roller(s) and/or nip roller(s)), a memory 312, a communication interface 313, one or more user interfaces 314 (e.g., to communication via an external network 302), a power system 316, one or more activation sensors 320, other sensors 325 (e.g., a product sensor), mark detector(s) 340, chute sensor(s) 370, and other system(s)/sensor(s) such as described herein—all of which may correspond to and encompass, as appropriate, such similar components described with respect to FIG. 24 (e.g., the controller 111, the dispensing mechanism 121 that includes a motor 122 and one or more rollers 132 (e.g., drive roller(s) and/or nip roller(s)), the memory 112, the communication interface 113, the one or more user interfaces 114, the power system 116, the one or more activation sensors 120, the other sensors 125 (e.g., a product sensor), the mark detector(s) 140, the chute sensor(s) 170, and the other system(s)/sensor(s).

Notably, however, the sheet product dispenser system 300 of FIG. 34 differs from the sheet product dispenser system 100 of FIG. 33 in that it includes two nips, where a first nip is defined by the first set of rollers 332 (e.g., at least one first drive roller and at least one first nip roller) and a second nip is defined by the second set of rollers 334 (e.g., at least one second drive roller and at least one second nip roller). The motor(s) 322 may be configured to cause rotation of either or both of the sets of rollers 332, 334 independently and/or simultaneously—such as is consistent with various embodiments described herein (e.g., the example sheet product dispenser 210 described with respect to FIGS. 13-14).

Example Flowchart(s)

Embodiments of the present invention provide methods, apparatuses and computer program products for controlling and operating sheet product dispensers according to various embodiments described herein. Various examples of the operations performed in accordance with embodiments of the present invention will now be provided with reference to FIGS. 35-37.

FIG. 35 illustrates a flowchart according to an example method for controlling operation of a sheet product dispenser, such as to provide a dispense of a leading predetermined portion (e.g., a toilet seat cover) according to an example embodiment 1500. The operations illustrated in and described with respect to FIG. 35 may, for example, be performed by, with the assistance of, and/or under the control of one or more of the controller 111, 311, memory 112, 312, communication interface 113, 313, user interface 114, 314, activation sensor(s) 120, 320, dispensing mechanism 121, 321, motor(s) 122, 322, roller(s) 132, 332, 334, other sensor(s) 125, 325, mark detector(s) 140, 340, chute sensor(s) 170, 370, and/or other sensor(s)/component(s) of the example sheet product dispensers described herein (e.g., sheet product dispenser 10, 110, 210, 310, 410, 510, 610, 710, 810, 1010, 1110, 1210).

Operation 1502 may comprise receiving user input indicating that the user desires occurrence of a dispense of sheet product. The activation sensor(s) 120, 320, controller 110, 310, memory 112, 312, communication interface 113, 313, and/or user interface 114, 314 may, for example, provide means for performing operation 1502. Operation 1504 may comprise causing operation of the motor to cause advancement of the sheet product to cause a leading predetermined portion to advance to the dispensing position. The controller 110, 310, memory 112, 312, communication interface 113, 313, mark detector(s) 140, 340, chute sensor(s) 170, 370, dispensing mechanism 121, 321, motor(s) 122, 322, and/or rollers 132, 332, 334 may, for example, provide means for performing operation 1504. Operation 1506 may comprise determining that the leading predetermined portion has been removed. The controller 110, 310, memory 112, 312, communication interface 113, 313, mark detector(s) 140, 340, and/or chute sensor(s) 170, 370 may, for example, provide means for performing operation 1506. Operation 1508 may comprise causing operation of the motor to cause advancement of the next predetermined portion to a staged position within the dispenser. The controller 110, 310, memory 112, 312, communication interface 113, 313, mark detector(s) 140, 340, chute sensor(s) 170, 370, dispensing mechanism 121, 321, motor(s) 122, 322, and/or rollers 132, 332, 334 may, for example, provide means for performing operation 1508.

FIG. 36 illustrates a flowchart according to an example method of controlling and operating an example sheet product dispenser to advance the sheet product to an appropriate position (e.g., to a staged position or a dispensing position) according to an example embodiment 1600. The operations illustrated in and described with respect to FIG. 36 may, for example, be performed by, with the assistance of, and/or under the control of one or more of the controller 111, 311, memory 112, 312, communication interface 113, 313, user interface 114, 314, activation sensor(s) 120, 320, dispensing mechanism 121, 321, motor(s) 122, 322, roller(s) 132, 332, 334, other sensor(s) 125, 325, mark detector(s) 140, 340, chute sensor(s) 170, 370, and/or other sensor(s)/component(s) of the example sheet product dispensers described herein (e.g., sheet product dispenser 10, 110, 210, 310, 410, 510, 610, 710, 810, 1010, 1110, 1210).

Operation 1602 may comprise causing operation of the motor to cause advancement of the sheet product along the dispensing pathway. The controller 110, 310, memory 112, 312, communication interface 113, 313, dispensing mechanism 121, 321, motor(s) 122, 322, and/or rollers 132, 332, 334 may, for example, provide means for performing operation 1602. Operation 1604 may comprise detecting one or more markings on the sheet product as it advances. The controller 110, 310, memory 112, 312, communication interface 113, 313, and/or mark detector(s) 140, 340 may, for example, provide means for performing operation 1604. Operation 1606 may comprise determining the remaining advancement needed (e.g., how long to operate the motor(s)) to properly position the sheet product (e.g., such that the leading predetermined portion is in the desired position, such as the staged position or the dispensing position). The controller 110, 310, memory 112, 312, communication interface 113, 313, mark detector(s) 140, 340, and/or chute sensor(s) 170, 370 may, for example, provide means for performing operation 1606. Operation 1608 may comprise causing operation of the motor to cease at the appropriate time to position the leading predetermined portion in the proper position (e.g., the staged position or the dispensing position). The controller 110, 310, memory 112, 312, communication interface 113, 313, mark detector(s) 140, 340, chute sensor(s) 170, 370, dispensing mechanism 121, 321, motor(s) 122, 322, and/or rollers 132, 332, 334 may, for example, provide means for performing operation 1608.

FIG. 37 illustrates a flowchart according to another example method for controlling operation of a sheet product dispenser, such as to provide a dispense of a leading predetermined portion (e.g., a toilet seat cover) according to an example embodiment 1700. The operations illustrated in and described with respect to FIG. 37 may, for example, be performed by, with the assistance of, and/or under the control of one or more of the controller 111, 311, memory 112, 312, communication interface 113, 313, user interface 114, 314, activation sensor(s) 120, 320, dispensing mechanism 121, 321, motor(s) 122, 322, roller(s) 132, 332, 334, other sensor(s) 125, 325, mark detector(s) 140, 340, chute sensor(s) 170, 370, and/or other sensor(s)/component(s) of the example sheet product dispensers described herein (e.g., sheet product dispenser 10, 110, 210, 310, 410, 510, 610, 710, 810, 1010, 1110, 1210).

Operation 1702 may comprise receiving user input indicating that the user desires occurrence of a dispense of sheet product. The activation sensor(s) 120, 320, controller 110, 310, memory 112, 312, communication interface 113, 313, and/or user interface 114, 314 may, for example, provide means for performing operation 1702. Operation 1704 may comprise causing operation of the motor to cause advancement of the sheet product to cause a leading predetermined portion to advance to the dispensing position. The controller 110, 310, memory 112, 312, communication interface 113, 313, mark detector(s) 140, 340, chute sensor(s) 170, 370, dispensing mechanism 121, 321, motor(s) 122, 322, and/or rollers 132, 332, 334 may, for example, provide means for performing operation 1704. Operation 1706 may comprise causing performance of a perforation tear assist feature operation (e.g., perform automatic perforation tearing, perform braking, perform cutting, and/or perform other perforation tear assist feature operations as described in various embodiments herein). The controller 110, 310, memory 112, 312, communication interface 113, 313, mark detector(s) 140, 340, chute sensor(s) 170, 370, dispensing mechanism 121, 321, motor(s) 122, 322, rollers 132, 332, 334, and/or other components/features described in various embodiments herein may, for example, provide means for performing operation 1706. Operation 1708 may comprise determining that the leading predetermined portion has been removed. The controller 110, 310, memory 112, 312, communication interface 113, 313, mark detector(s) 140, 340, and/or chute sensor(s) 170, 370 may, for example, provide means for performing operation 1708. Operation 1710 may comprise causing operation of the motor to cause advancement of the next predetermined portion to a staged position within the dispenser. The controller 110, 310, memory 112, 312, communication interface 113, 313, mark detector(s) 140, 340, chute sensor(s) 170, 370, dispensing mechanism 121, 321, motor(s) 122, 322, and/or rollers 132, 332, 334 may, for example, provide means for performing operation 1710.

FIGS. 35-37 illustrate example flowcharts of a system, method, and computer program product according to various example embodiments described herein. It will be understood that each block of the flowcharts, and combinations of blocks in the flowcharts, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 112 and executed by, for example, the controller 111. As will be appreciated, any such computer program product may be loaded onto a computer or other programmable apparatus, such that the computer program product including the instructions which execute on the computer or other programmable apparatus creates means for implementing the functions specified in the flowcharts block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowcharts block(s).

Associated systems and methods for manufacturing example sheet product dispensers described herein are also contemplated by some embodiments of the present invention.

CONCLUSION

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A sheet product dispenser for dispensing sheet product from a roll of sheet product, wherein the sheet product defines a plurality of sheets with consecutive sheets separated by a line of perforations, the sheet product dispenser comprising:

a roll holder configured to support the roll of sheet product;

a dispensing mechanism operable to dispense the sheet product from the roll, wherein the dispensing mechanism comprises a drive roller;

a dispensing chute extending from the dispensing mechanism to an end of the dispensing chute;

a dispensing pathway extending through the sheet product dispenser for dispensing of the sheet product therealong, wherein a portion of the dispensing pathway extending within the dispensing chute from the dispensing mechanism to the end of the dispensing chute defines a length that is at least half of a length of a sheet of the sheet product;

a motor operable to cause the driver roller to rotate to cause the sheet product to move along the dispensing pathway;

a sensor configured to detect detachment of a leading sheet from the sheet product roll; and a controller configured to:

receive an indication of detachment of the leading sheet from the sensor; and cause, in response to receiving the indication of detachment of the leading sheet, the motor to operate the dispensing mechanism to move a next leading sheet of the sheet product from the roll of sheet product into a staged position such that the next leading sheet of the sheet product is positioned along the dispensing pathway with a leading edge inside the dispensing chute, wherein, when the next leading sheet is in the staged position, the leading edge of the next leading sheet is positioned less than 6 inches from the end of the dispensing chute.

2. The sheet product dispenser of claim 1 further comprising an activation sensor, wherein the controller is further operable to:

receive an indication of user input from the activation sensor; and cause, in response to receiving the indication, the motor to operate the dispensing mechanism to move the next leading sheet from the staged position into a dispensing position such that the next leading sheet is positioned with the leading edge outside of the end of the dispensing chute and a trailing edge inside the dispensing chute and along the dispensing pathway downstream of the dispensing mechanism.

3. The sheet product dispenser of claim 2, wherein the controller is further operable to wait a predetermined amount of time after receiving the indication of detachment of the leading sheet before causing the motor to operate the dispensing mechanism to move the next leading sheet into the staged position.

4. The sheet product dispenser of claim 1, wherein the roll holder is positioned vertically below a nip of the dispensing mechanism in general vertical alignment and the end of the dispensing chute is positioned vertically below the roll holder, wherein the dispensing pathway leads upwardly from the roll holder through the nip and back down through the dispensing chute.

5. The sheet product dispenser of claim 1, wherein the portion of the dispensing pathway extending within the dispensing chute from the dispensing mechanism to the end of the dispensing chute is between 14 inches and 24 inches in length.

6. The sheet product dispenser of claim 1, wherein the housing of the sheet product dispenser defines a length between 12 inches and 24 inches, a width between 16 inches and 22 inches; and a depth between 4 inches and 6 inches.

7. The sheet product dispenser of claim 1, wherein, when the next leading sheet is in the staged position, a trailing edge of the next leading sheet is positioned along the dispensing pathway between the dispensing mechanism and the roll holder.

8. The sheet product dispenser of claim 1, wherein each of the plurality of sheets defines a length extending from a leading edge to a trailing edge, wherein the line of perforations extends along a width direction of the sheet product at the trailing edge, the sheet product dispenser further comprising a perforation tear assist feature that is configured to aid in removal of the next leading sheet along the line of perforations at the trailing edge of the next leading sheet, and wherein, in response to receiving an indication of an activation request, the controller is configured to cause the motor to operate to cause the next leading sheet to move into the dispensing position such that the trailing edge of the next leading sheet aligns with the perforation tear assist feature.

9. The sheet product dispenser of claim 8, wherein the perforation tear assist feature comprises at least one rib that extends into the dispensing pathway within the dispensing chute such that, when a user pulls on the next leading sheet for removal thereof, tension is focused at a position on the sheet product corresponding to the trailing edge of the next leading sheet so as to aid in removal via separation of the line of perforations at the trailing edge.

10. The sheet product dispenser of claim 9, wherein the at least one rib comprises a plurality of ribs that extend into the dispensing pathway at varying heights.

11. The sheet product dispenser of claim 10, wherein the plurality of ribs are positioned across the width direction so as to each align with a perforation opening of the line of perforations.

12. The sheet product dispenser of claim 10, wherein the plurality of ribs are positioned across the width direction, wherein at least two gaps between consecutive ribs of the plurality of ribs define different distances.

13. The sheet product dispenser of claim 10, wherein the plurality of ribs define a stepped reduction in height extending into the dispensing pathway leading from a position proximate a side edge of the line of perforations at the trailing edge of the next leading sheet toward a center of the line of perforations at the trailing edge of the next leading sheet.

14. The sheet product dispenser of claim 8, wherein the perforation tear assist feature comprises a brake feature movable between a first position and a second position, wherein the brake feature comprises a body extending into the dispensing pathway, wherein the brake feature is biased to the first position, wherein, when the brake feature is in the second position, the brake feature engages with at least one of the drive roller or the nip roller to prevent further rotation thereof, and wherein the brake feature is configured to move to the second position when a user pulls on the next leading sheet for removal thereof so as to cause a nip of the dispensing mechanism to hold the sheet product therein without enabling further translation therethrough and to create tension in the sheet product to aid in removal of the next leading sheet via separation of the line of perforations at the trailing edge.

15. The sheet product dispenser of claim 14, wherein the brake feature is a roller, wherein the roller further includes at least one rib that extends into the dispensing pathway within the dispensing chute such that, when a user pulls on the next leading sheet for removal thereof, tension is focused at a position on the sheet product corresponding to the trailing edge of the next leading sheet so as to aid in removal via separation of the line of perforations at the trailing edge.

16. The sheet product dispenser of claim 8, wherein the perforation tear assist feature comprises:

a lever that is movable between a first position and a second position, wherein the lever comprises a body with a top surface and a hole extending through the body and the top surface, wherein the lever is biased to the first position; and a projection that extends toward the dispensing pathway and into the hole of the lever, wherein the projection is configured to focus pressure onto a position of the sheet product when a user pulls on the next leading sheet for removal thereof, wherein the top surface is positioned above the projection with respect to the dispensing pathway when the lever is in the first position, wherein the top surface is positioned below a top of the projection with respect to the dispensing pathway when the lever is in the second position, wherein the lever is configured to move to the second position when the user pulls on the next leading sheet for removal thereof so as to enable the projection to contact the sheet product to focus pressure onto the sheet product to aid in removal of the next leading sheet via separation of the line of perforations at the trailing edge.

17. The sheet product dispenser of claim 1 further comprising a mark detector configured to detect one or more markings on the sheet product, and wherein the controller is configured to cause, based on mark detector data received from the mark detector, the motor to cease operation to position the next leading sheet of the sheet product in the staged position.

18. The sheet product dispenser of claim 17, wherein the controller is configured to determine a type or characteristic of the sheet product installed on the roll holder based on the mark detector data received from the mark detector.

19. The sheet product dispenser of claim 1, wherein each of the plurality of sheets comprises printed indicia indicating one or more directions for a user regarding converting the sheet into a use configuration using the at least one cut-out or the series of perforations.

20. The sheet product dispenser of claim 1, wherein the sheet product is dispersible paper-based sheet product.

21. The dispenser of claim 1, wherein the roll of sheet product is a roll of toilet seat covers.

22. The dispenser of claim 21, wherein each of the toilet seat covers is configured such that at least one of a cut-out or a series of perforations defines at least a second portion of a shape corresponding to an opening in a toilet seat.

23. The dispenser of claim 1, wherein the staged position is such that the next leading sheet of the sheet product is positioned along the dispensing pathway such that the leading edge is not accessible through the opening of the dispenser.

24. A method comprising:

providing a sheet product dispenser for dispensing sheet product from a roll of sheet product, wherein the sheet product defines a plurality of sheets with consecutive sheets separated by a line of perforations, the sheet product dispenser comprising:

a roll holder configured to support the roll of sheet product;

a dispensing mechanism operable to dispense the sheet product from the roll, wherein the dispensing mechanism comprises a drive roller;

a dispensing chute extending from the dispensing mechanism to an end of the dispensing chute;

a dispensing pathway extending through the sheet product dispenser for dispensing of the sheet product therealong, wherein a portion of the dispensing pathway extending within the dispensing chute from the dispensing mechanism to the end of the dispensing chute defines a length that is at least half of a length of a sheet of the sheet product;

a motor operable to cause the driver roller to rotate to cause the sheet product to move along the dispensing pathway;

a sensor configured to detect detachment of a leading sheet from the sheet product roll; and a controller;

receiving, via the controller, an indication of detachment of the leading sheet from the sensor; and causing, via the controller and in response to receiving the indication of detachment of the leading sheet, the motor to operate the dispensing mechanism to move a next leading sheet of the sheet product from the roll of sheet product into a staged position such that the next leading sheet of the sheet product is positioned along the dispensing pathway with a leading edge inside the dispensing chute, wherein, when the next leading sheet is in the staged position, the leading edge of the next leading sheet is positioned less than 6 inches from the end of the dispensing chute.

25. The method of claim 24 further comprising:

receiving, via the controller, an indication of a dispense request; and causing, via the controller and in response to receiving the indication of the dispense request, the motor to operate to cause advancement of the sheet product along a dispensing pathway such that the next leading sheet of the sheet product moves into a dispensing position with the leading edge of the next leading sheet positioned outside of the end of the dispensing chute of the sheet product dispenser and a trailing edge of the next leading sheet positioned inside the dispensing chute.

26. The method of claim 25, wherein causing the motor to operate to cause advancement of the sheet product along the dispensing pathway such that the next leading sheet of the sheet product moves into the dispensing position comprises causing the trailing edge of the next leading sheet to align with a perforation tear assist feature positioned along the dispensing pathway within the dispensing chute, wherein the perforation tear assist feature is configured to aid in removal of the next leading sheet along a line of perforations at the trailing edge of the next leading sheet.

27. The method of claim 25, wherein causing the motor to operate to cause advancement of the sheet product along the dispensing pathway such that the next leading sheet of the sheet product moves into the dispensing position comprises causing, based on mark detector data from a mark detector, the motor to cease operation to position the next leading sheet of the sheet product in the dispensing position, wherein the mark detector is configured to detect one or more markings on the sheet product.

28. A sheet product dispenser for dispensing sheet product from a roll of sheet product, wherein the sheet product defines a plurality of sheets with consecutive sheets separated by a line of perforations, the sheet product dispenser comprising:

a roll holder configured to support the roll of sheet product;

a dispensing mechanism operable to dispense the sheet product from the roll, wherein the dispensing mechanism comprises a drive roller;

a dispensing chute extending from the dispensing mechanism to an end of the dispensing chute;

a motor operable to cause the drive roller to rotate to cause the sheet product to move through the sheet product dispenser to the dispensing chute;

a sensor configured to detect detachment of a leading sheet from the sheet product roll; and a controller configured to:

receive an indication of detachment of the leading sheet from the sensor; and cause, in response to receiving the indication of detachment of the leading sheet, the motor to operate the dispensing mechanism to move a next sheet of the sheet product from the roll of sheet product to a staged position with a leading edge inside the dispensing chute, wherein, when the next leading sheet is in the staged position, the leading edge of the next leading sheet is positioned less than 6 inches from the end of the dispensing chute.

29. The sheet product dispenser of claim 28, wherein a nip of the dispensing mechanism is formed by at least the drive roller, and wherein the controller is operable to cause, in response to receiving the indication of detachment of the leading sheet, the motor to operate the dispensing mechanism to move the next sheet to the staged position from a first position where the leading edge was positioned past the nip along a dispensing pathway with respect to the roll holder.

* * * * *